US008156586B2

(12) United States Patent
Reed et al.

(10) Patent No.: US 8,156,586 B2
(45) Date of Patent: Apr. 17, 2012

(54) AMBULANCE COT SYSTEM

(75) Inventors: Jaime C. Reed, Mukwonago, WI (US); Jeffrey J. Krieger, Mukwonago, WI (US); Richard T. Seizer, Wauwatosa, WI (US); Shawn G. Bhend, Waukesha, WI (US); Jarod M. Sulik, Elkhorn, WI (US); James R. Hanson, Brownsburg, IN (US)

(73) Assignee: Rauch & Romanshek Industries, LLC, Milwaukee, WI (US)

( * ) Notice: Subject to any disclaimer, the term of this patent is extended or adjusted under 35 U.S.C. 154(b) by 350 days.

(21) Appl. No.: 12/397,072

(22) Filed: Mar. 3, 2009

(65) Prior Publication Data

US 2009/0222988 A1 Sep. 10, 2009

Related U.S. Application Data

(60) Provisional application No. 61/033,297, filed on Mar. 3, 2008.

(51) Int. Cl.
*A61G 7/012* (2006.01)
*A61G 1/02* (2006.01)

(52) U.S. Cl. ..... 5/611; 5/86.1; 296/20

(58) Field of Classification Search ..... 5/86.1, 5/611, 628; 296/20
See application file for complete search history.

(56) References Cited

U.S. PATENT DOCUMENTS

| | | | | |
|---|---|---|---|---|
| 5,432,966 | A * | 7/1995 | Berta et al. | 5/611 |
| 5,435,027 | A * | 7/1995 | Bourgraf et al. | 5/611 |
| 5,537,700 | A * | 7/1996 | Way et al. | 5/611 |
| 6,526,611 | B2 * | 3/2003 | Flynn et al. | 5/611 |
| 7,131,151 | B2 * | 11/2006 | Ferneau et al. | 5/86.1 |
| 7,540,047 | B2 * | 6/2009 | Lambarth | 5/611 |
| 7,685,660 | B2 * | 3/2010 | Chinn | 5/611 |
| 7,694,368 | B2 * | 4/2010 | Lewis, Jr. | 5/611 |

* cited by examiner

*Primary Examiner* — Michael Trettel
(74) *Attorney, Agent, or Firm* — Quarles & Brady LLP; George E. Haas

(57) ABSTRACT

The present invention relates to ambulance cots, cot systems and methods of using the same. In particular, the present invention provides an ambulance cot comprising one or more control features (e.g., a notched ladder rail assembly (e.g., for preventing hot dropping of cot); a hand braking system; and/or team lift rails) and methods of using the same (e.g., to transport a subject (e.g., into and/or from an ambulance)).

20 Claims, 49 Drawing Sheets

AMBULANCE COT SYSTEM

This Application claims priority to U.S. Provisional Patent Application Ser. No. 61/033,297, filed 3 Mar. 2008, hereby incorporated by reference in its entirety.

FIELD OF THE INVENTION

The present invention relates to ambulance cots, cot systems and methods of using the same. In particular, the present invention provides an ambulance cot comprising one or more control features (e.g., a notched ladder rail assembly (e.g., for preventing hot dropping of cot); a hand braking system; and/or team lift rails) and methods of using the same (e.g., to transport a subject (e.g., into and/or from an ambulance)).

BACKGROUND OF THE INVENTION

An Emergency Medical Technician (EMT) is an emergency responder trained to provide medical services to the ill and injured. Once thought of as an "ambulance driver or attendant," the modern EMT performs many more duties than in the past, and responds to many types of emergency calls, including medical emergencies, hazardous materials exposure, mass casualty/triage events, childbirth, patient transport, fires, rescues, injuries, trauma and other types of calls. EMTs may be part of an Emergency Medical Service (EMS), hospital-based EMS, fire department, or independent response team.

EMTs are trained in practical emergency medicine and skills that can be deployed within a rapid time frame. In general, EMT intervention aims to expedite the safe and timely transport of a subject (e.g., to a hospital for definitive medical care, or from one location to another).

EMTs generally utilize ambulance cots to transport subjects. Ambulance cots typically comprise a generally rectangular patient support frame (e.g., supporting a patient litter) located above a generally rectangular wheeled base frame, as well as one or more collapsible assemblies. Various ambulance cots are described in U.S. Pat. Nos. 4,097,941 to Merkel, 4,192,541 to Ferneau, 4,767,148 to Ferneau and Dunn, 5,537,700 to Way et al., and 5,575,026 to Way et al.

However, each one of these references suffers from one or more of the following disadvantages: they utilize a raising, lowering and/or height locking mechanism that allows an inadvertent, uncontrolled and rapid dropping of the patient litter ("hot dropping"); they lack means to assist a user of the cot to control cot speed (e.g., while descending a sloped surface); and/or they lack grab areas for a team of EMTs to distribute (e.g., equally) the weight of the cot (e.g., supporting the weight of a subject transported thereon) among each member of the team without exposing the members to dangerous pinch points (e.g., in which an EMT may pinch, cut and/or break fingers, hands, etc.). Thus, using a cot disclosed in the above identified references has in turn led to injuries to subjects transported on cots as well as to injuries to EMTs and other users of cots (e.g., musculoskeletal injuries) as a result of poor control of the cot (e.g., overexertion lifting and/or straining to raise/lower a subject and/or to regain control of a wayward cot).

DESCRIPTION OF DRAWINGS

FIG. 3A shows a cot with guards protecting the inner legs and outer legs of the telescoping leg assemblies whereas FIG. 3B shows a cot with the guards removed.

DEFINITIONS

Figure 1:
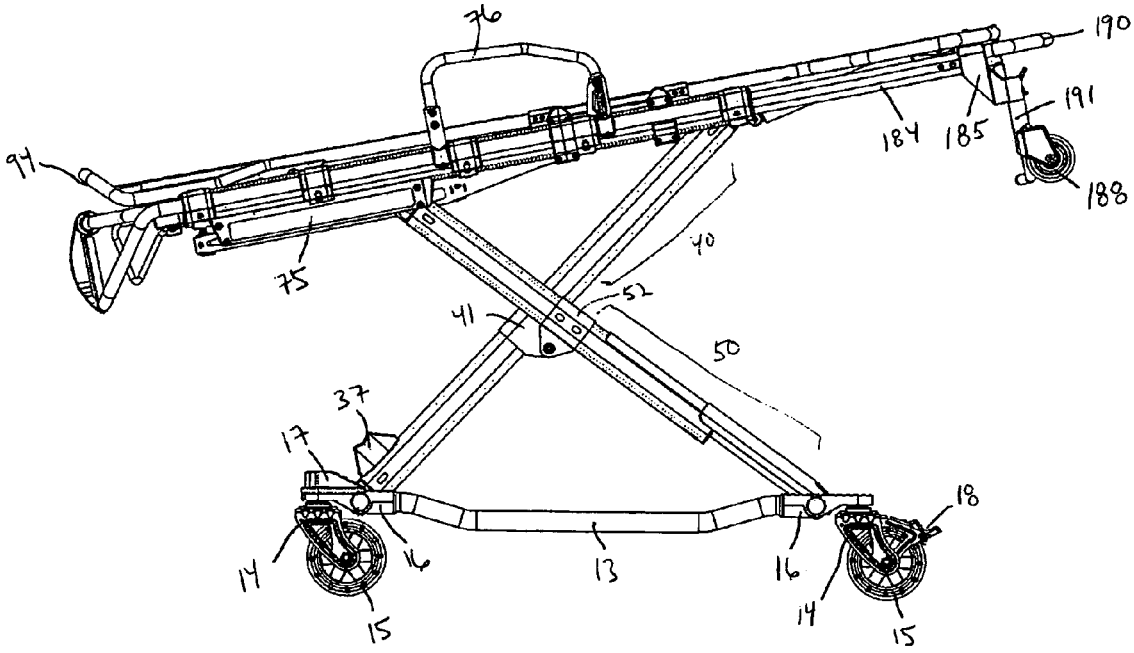
FIG. 1 shows an illustrated side view of a cot according to the invention in a fully raised position.

To facilitate an understanding of the present invention, a number of terms and phrases are defined below:

As used herein, the term "subject" refers to a human or other vertebrate animal. It is intended that the term encompass patients.

As used herein, the term "amplifier" refers to a device that produces an electrical output that is a function of the corresponding electrical input parameter, and increases the magnitude of the input by means of energy drawn from an external source (i.e., it introduces gain). "Amplification" refers to the reproduction of an electrical signal by an electronic device, usually at an increased intensity. "Amplification means" refers to the use of an amplifier to amplify a signal. It is intended that the amplification means also includes means to process and/or filter the signal.

As used herein, the term "receiver" refers to the part of a system that converts transmitted waves into a desired form of output. The range of frequencies over which a receiver operates with a selected performance (i.e., a known level of sensitivity) is the "bandwidth" of the receiver.

As used herein, the term "transducer" refers to any device that converts a non-electrical parameter (e.g., sound, pressure or light), into electrical signals or vice versa.

The term "circuit" as used herein, refers to the complete path of an electric current.

As used herein, the term "resistor" refers to an electronic device that possesses resistance and is selected for this use. It is intended that the term encompass all types of resistors, including but not limited to, fixed-value or adjustable, carbon, wire-wound, and film resistors. The term "resistance" (R; ohm) refers to the tendency of a material to resist the passage of an electric current, and to convert electrical energy into heat energy.

The term "housing" refers to the structure encasing or enclosing at least one component (e.g., circuit board) of the devices of the present invention. In some embodiments, the housing comprises at least one hermetic feedthrough through which leads extend from the component inside the housing to a position outside the housing.

As used herein, the term "hermetically sealed" refers to a device or object that is sealed in a manner that liquids or gases located outside the device are prevented from entering the interior of the device, to at least some degree. "Completely hermetically sealed" refers to a device or object that is sealed in a manner such that no detectable liquid or gas located outside the device enters the interior of the device. It is intended that the sealing be accomplished by a variety of means, including but not limited to mechanical, glue or sealants, etc. In particularly preferred embodiments, the hermetically sealed device is made so that it is completely leak-proof (i.e., no liquid or gas is allowed to enter the interior of the device at all).

As used herein the term "processor" refers to a device that is able to read a program from a computer memory (e.g., ROM or other computer memory) and perform a set of steps according to the program. Processor may include non-algorithmic signal processing components (e.g., for analog signal processing).

As used herein, the terms "memory component," "computer memory" and "computer memory device" refer to any storage media readable by a computer processor. Examples of computer memory include, but are not limited to, RAM, ROM, computer chips, digital video disc (DVDs), compact discs (CDs), hard disk drives (HDD), and magnetic tape.

As used herein, the term "computer readable medium" refers to any device or system for storing and providing information (e.g., data and instructions) to a computer processor. Examples of computer readable media include, but are not limited to, DVDs, CDs, hard disk drives, magnetic tape, flash memory, and servers for streaming media over networks.

As used herein the terms "multimedia information" and "media information" are used interchangeably to refer to information (e.g., digitized and analog information) encoding or representing audio, video, and/or text. Multimedia information may further carry information not corresponding to audio or video. Multimedia information may be transmitted from one location or device to a second location or device by methods including, but not limited to, electrical, optical, and satellite transmission, and the like.

As used herein, the term "Internet" refers to any collection of networks using standard protocols. For example, the term includes a collection of interconnected (public and/or private) networks that are linked together by a set of standard protocols (such as TCP/IP, HTTP, and FTP) to form a global, distributed network. While this term is intended to refer to what is now commonly known as the Internet, it is also intended to encompass variations that may be made in the future, including changes and additions to existing standard protocols or integration with other media (e.g., television, radio, etc). The term is also intended to encompass non-public networks such as private (e.g., corporate) Intranets.

As used herein the term "security protocol" refers to an electronic security system (e.g., hardware and/or software) to limit access to processor, memory, etc. to specific users authorized to access the processor. For example, a security protocol may comprise a software program that locks out one or more functions of a processor until a certain event occurs (e.g., until an appropriate password is entered, authorized radio-frequency identification (RFID) tag is presented, proper biometric match is made, or the like).

As used herein the term "resource manager" refers to a system that optimizes the performance of a processor or another system. For example a resource manager may be configured to monitor the performance of a processor or software application and manage data and processor allocation, perform component failure recoveries, optimize the receipt and transmission of data, and the like. In some embodiments, the resource manager comprises a software program provided on a computer system of the present invention.

As used herein the term "in electronic communication" refers to electrical devices (e.g., computers, processors, communications equipment) that are configured to communicate with one another through direct or indirect signaling. For example, a conference bridge that is connected to a processor through a cable or wire, such that information can pass between the conference bridge and the processor, are in electronic communication with one another. Likewise, a computer configured to transmit (e.g., through cables, wires, infrared signals, telephone lines, etc) information to another computer or device, is in electronic communication with the other computer or device.

As used herein the term "transmitting" refers to the movement of information (e.g., data) from one location to another (e.g., from one device to another) using any suitable means.

As used herein, the terms "hot drop," "hot dropping" and the like refer to a rapid and/or uncontrolled lowering of a patient litter of an ambulance cot (e.g., supporting a subject). Hot dropping is one of the most common safety issues in emergency medicine. Generally, hot drops occur due to inadvertent squeezing of a handle and/or lever (e.g., used to release a mechanism used to maintain the height of the patient litter (e.g., release of a rod from a rail)). For example, hot drops occur when an emergency medical technician or other type of responder inadvertently squeezes a handle (e.g., that releases a mechanism used to maintain patient litter height) and one or more other persons are not ready (e.g., prepared) to bear the weight of the litter (e.g., thereby resulting in the litter rapidly and uncontrollably falling to a lower position (e.g., a completely collapsed cot position). For example, conventional cots have notches in ladder rail systems that run within a horizontal plane (e.g., with or without a tip). Thus, when a handle is inadvertently squeezed (e.g., when someone else is lifting up on a portion of the cot), conventional cots are unable to support the weight of the litter (e.g., supporting a subject) and the litter (e.g., and anything supported thereon) rapidly descends to the ground. Hot drops occur under all types of conditions including, but not limited to, when a cot is moved across a surface and when a cot is unloaded from an ambulance deck (e.g., anytime when the patient litter is in an elevated position).

DETAILED DESCRIPTION OF THE INVENTION

The present invention relates to ambulance cots, cot systems and methods of using the same. In particular, the present invention provides an ambulance cot comprising one or more control features (e.g., a notched ladder rail assembly (e.g., for preventing hot dropping of cot); a hand braking system; and/or team lift rails) and methods of using the same (e.g., to transport a subject (e.g., into and/or from an ambulance)).

The following embodiments are provided by way of example and are not intended to limit the invention to these particular configurations. Numerous other applications and configurations will be appreciated by those of ordinary skill in the art.

An ambulance cot system of the present invention is depicted in the drawings. For example, an ambulance cot system, and components thereof, embodied by the invention is shown in FIGS. 1-37.

Figure 2A:
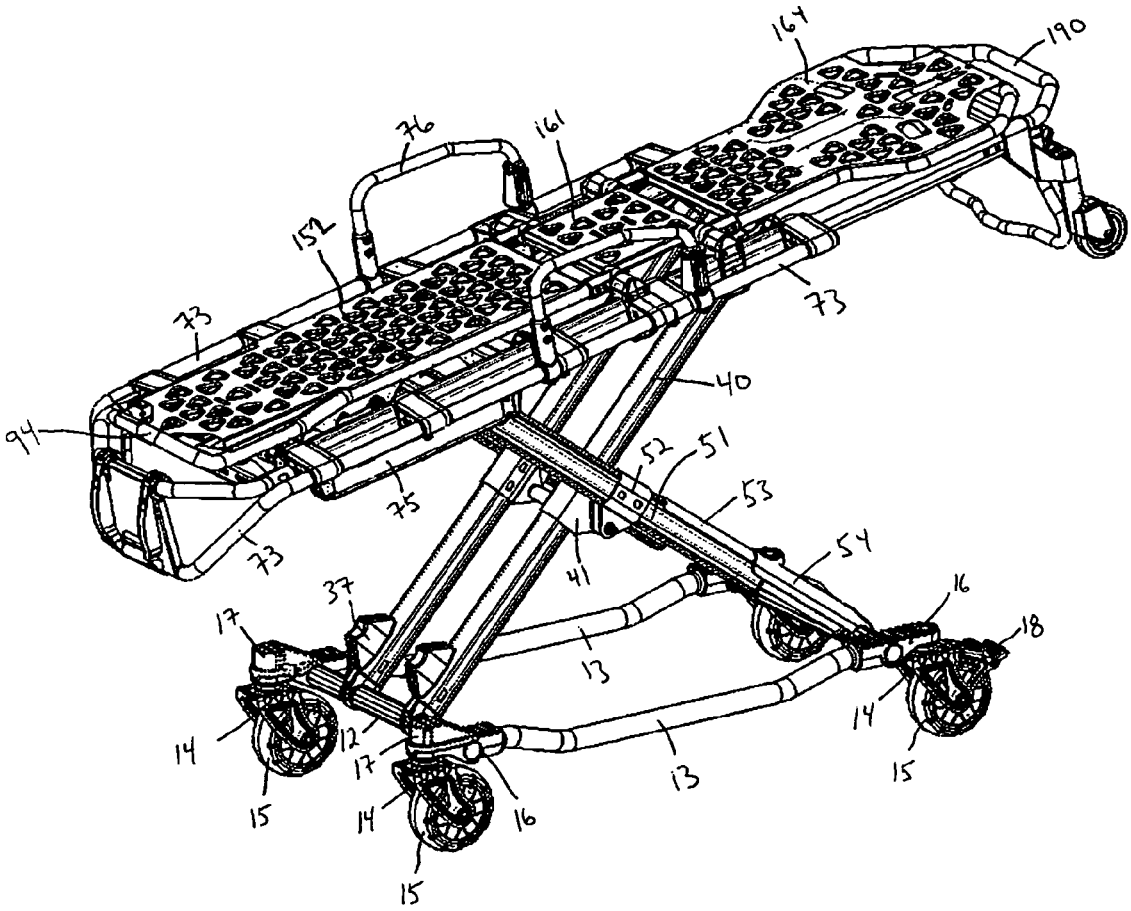
FIG. 2 shows an illustrated side view of a cot according to the invention in (A) a fully raised and (B) a fully collapsed position.
Figure 3A:
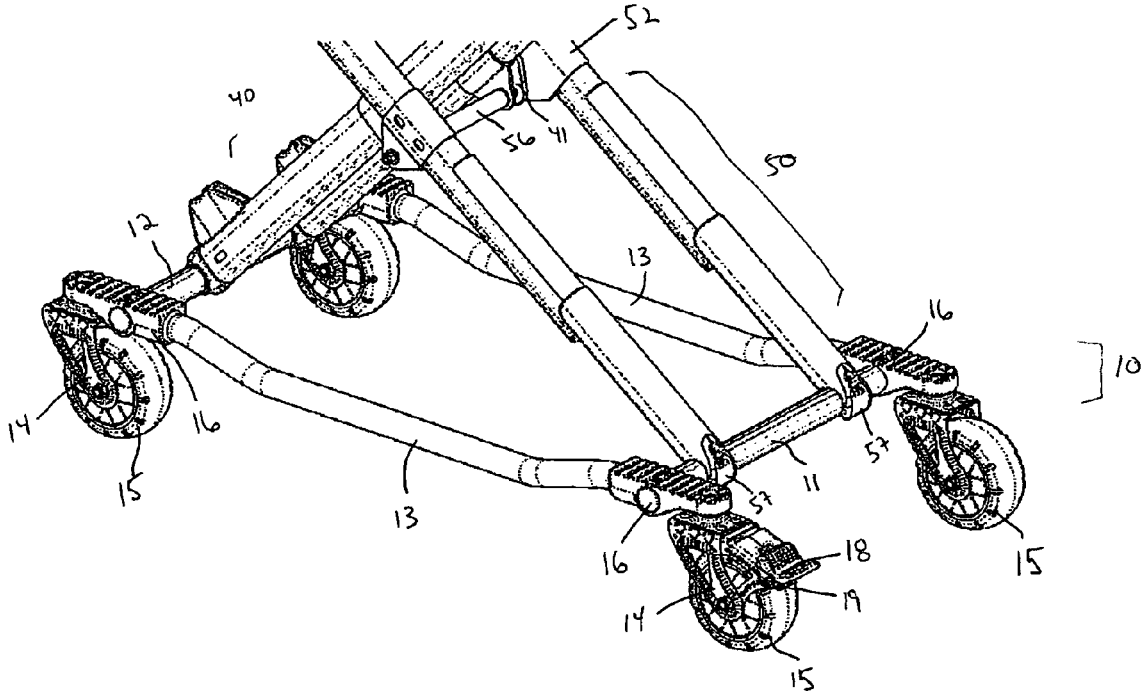
FIGS. 3A-3B shows components of the base frame, wheels and leg assemblies of a cot according to the invention.
Figure 11:
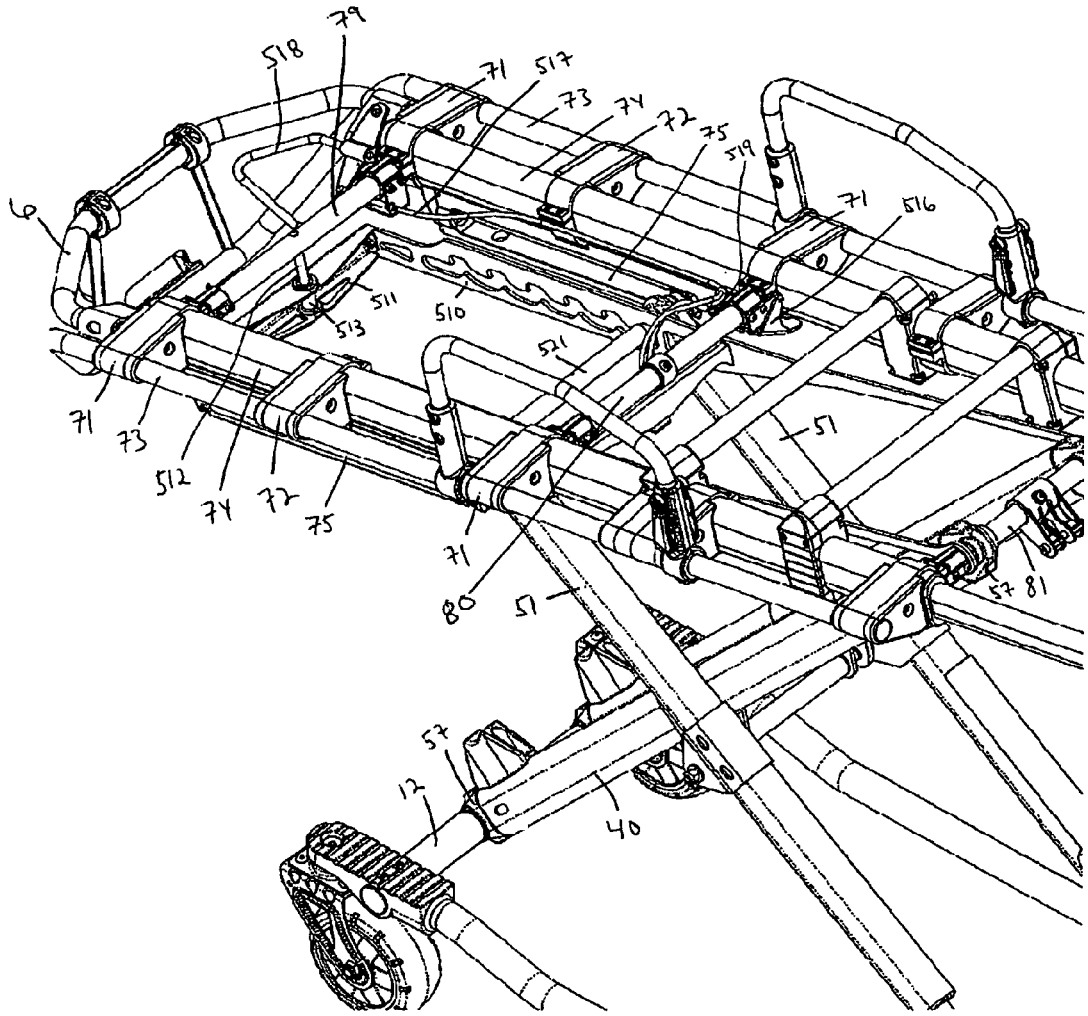
FIG. 11 shows a view of several components of a cot of the present invention including the team lift rail, top frame, notched ladder rail assembly, and slider housing, wherein the patient litter is not shown, in one embodiment of the invention.

In some embodiments, the ambulance cot system comprises a pair of frames comprising a base frame 10 and a top frame 74 as shown, for example, in FIGS. 2A, 3A and 11.

The base frame 10 includes a foot-end cross tube 12 and a head-end cross tube 11, a plurality of base connectors 16 and base side rails 13. In some embodiments, the cross tubes 11, 12 are connected on each end to a base connector 16, as are the base side rails 13 (e.g., as shown in FIG. 3). The base connectors 16 provide a foot placement point (e.g., non-slip foot placement point) for a user of the cot (e.g., for placement of the user of the cot in a position above a subject upon the cot).

As shown in FIG. 3, the base frame 10 can be connected via each base connector 16 to caster forks 14 that attach to wheels 15. The present invention is not limited by the type of wheels utilized. In some embodiments, cot wheels are constructed of rubber, plastic, composite (e.g., polycarbonate), or other type of material. It is preferred that the wheel material is not too hard (e.g., thereby reducing vibration artifacts (e.g., while the cot is in motion over a surface and/or while the cot is mounted in a moving ambulance)) nor too soft or porous (e.g., such that debris (e.g., rocks, glass, mud, etc.) could collect and/or build up in and/or on the wheels). Thus, the wheels are an important component of the cot in that by decreasing vibration artifacts (e.g., by utilizing a wheel with an optimal durometer) they can reduce the risk of erroneous readings of a subject's vital signs (e.g., blood pressure, heart monitor, EKG tracings, etc.) that might otherwise occur (e.g., due to vibration artifacts that occur with use of poorly constructed wheels). In some embodiments, cot wheels comprise greaseless, sealed bearings (e.g., titanium or other metallic bearing (e.g., that prevent entrance of patient body fluids, water, snow, or other fluids). In some embodiments, the bearings provide a smooth roll of the cot and permit a user to maneuver the cot more easily (e.g., with less back twist and/or torsion). In some embodiments, wheel bearings prevent wheel wobble.

The present invention is not limited by the size of the wheels utilized. In some embodiments, the diameter of the wheels utilized is greater than 6.5 inches, although larger (e.g., greater than 6.7 inches, greater than 7 inches, greater than 7.5 inches, greater than 8 inches or larger) and smaller (e.g., diameter greater than 3 inches, greater than 4 inches, greater than 4.5 inches, greater than 5 inches, greater than 6 inches) are utilized. In some embodiments, the width of a wheel is 1-1.5 inches, 1.5-2.0 inches, 2.0-2.5 inches, 2.5-3.0 inches, 3.0-3.5 inches or larger. In some embodiments, the wheels utilized are 6.5 inches in diameter and are 2.25 inches wide. Wider wheels provide superior handling and maneuverability over rough terrain and also provide a lower initial push weight to get a cot moving (e.g., rolling). In some embodiments, cot wheels comprise a customizable trim ring on the sidewall of the wheel (e.g., that permit users (e.g., purchasers of a cot of the present invention)) to customize the cot (e.g., the wheels). In some embodiments, a user may utilize alpha numeric characters for customization (e.g., for departmental customization (e.g., City Fire, City EMS, etc.).

The trim ring and/or alpha numeric characters may be any color (e.g., thereby permitting easy recognition of a cot (e.g., thereby reducing "cot confusion" in a mass casualty or multiple service response)). In some embodiments, the wheels comprise a camber (e.g., that provides the least amount of resistance to roll while providing sufficient surface contact for maximum traction). In some embodiments, the wheels comprise a tread pattern that permits maximum traction, water, snow and/or ice displacement, and/or low resistance. In some embodiments, the wheels are utilized in the context of an independent suspension and/or traction control system. In some embodiments, wheel rotation is utilized to generate electric power and/or to charge one or more batteries associated with the cot's use.

A caster fork 14 that is connected to a cot wheel 15 is designed to prevent bearing wear at the top of the caster where it connects and rotates about a base connector 16. In some embodiments, the top caster bearing is constructed of a material that allows maximum rotation and that prevents the bearing from cracking and disintegrating (e.g., TEFLON or other suitable material known to those of ordinary skill in the art).

As illustrated in FIGS. 1, and 4A-4C, in some embodiments, the base connectors 16 attached to the foot-end cross tube 12 attach to connector covers 17 that house a hand brake assembly comprising a ramping mechanism 2. In some embodiments, the hand brakes allow a cot user (e.g., EMT, fire department personnel, etc.) to control the speed of the cot (e.g., while in motion (e.g., thereby providing a safety control feature benefiting both a subject transported by the cot as well as users of the cot)). Thus, a hand brake system provided herein allows a cot to be used under conditions that no rapid stops of the cot occur (e.g., ameliorating twisting and stress placed on a cot user's back and legs) and also reduces the risk of unsafe cot speed and/or movements (e.g., thereby preventing tipping of a cot).

Figure 22:
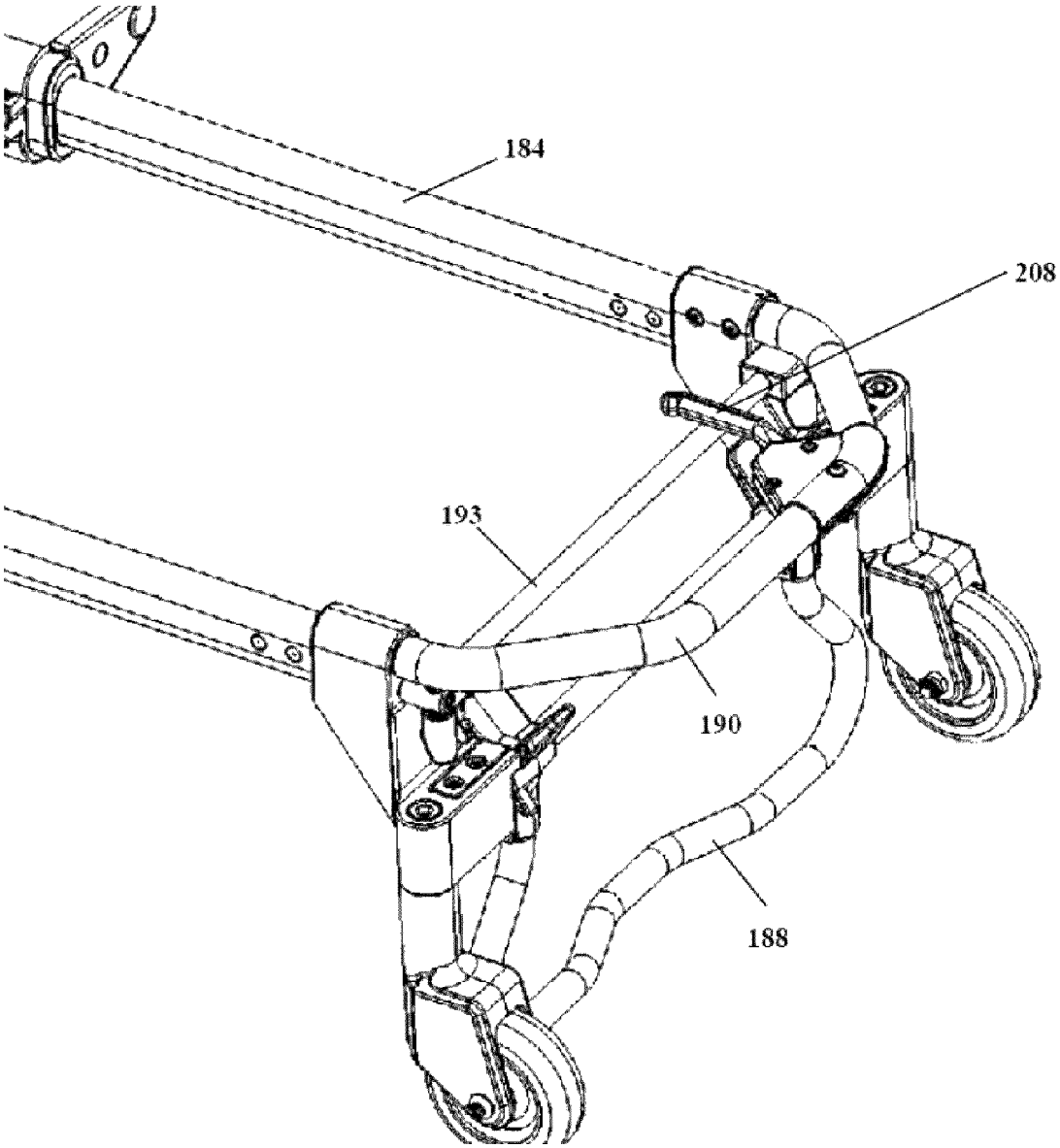
FIG. 22 shows components of a telescoping load rail assembly in one embodiment of the invention.
Figure 23:
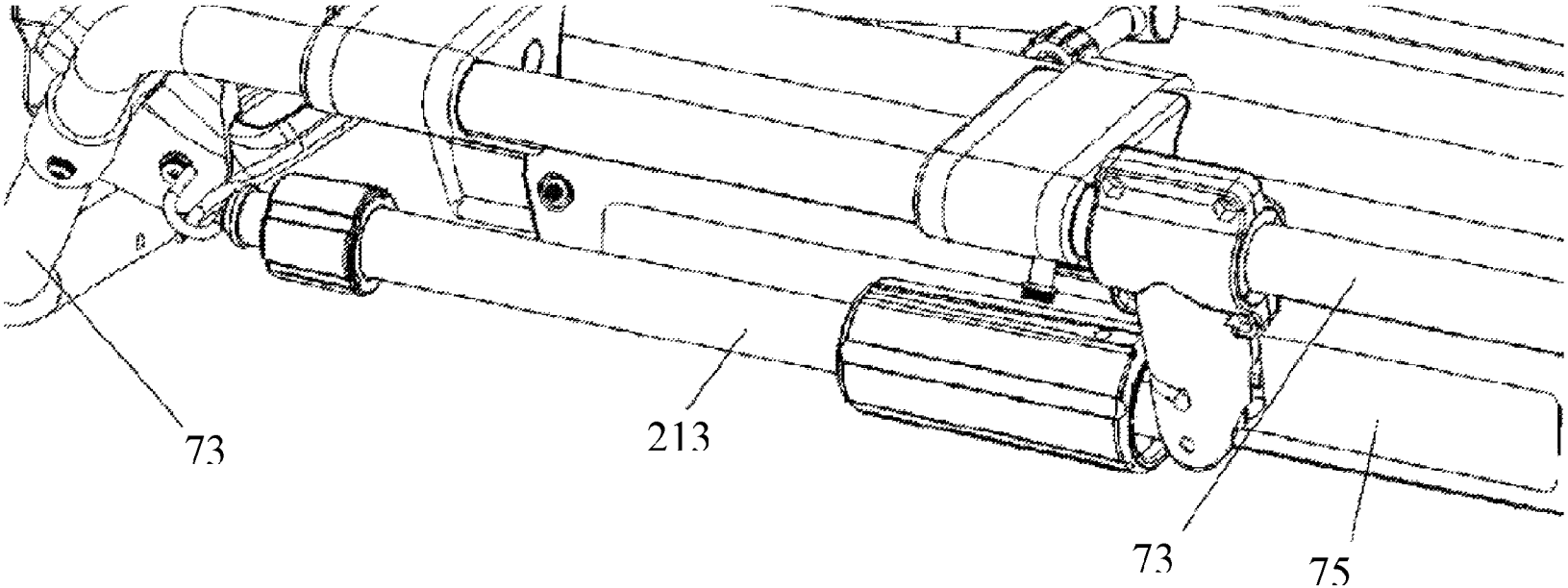
FIG. 23 shows an IV pole and its attachment to a cot in one embodiment of the invention.

In some embodiments, a hand braking assembly provided herein works by transferring motion created by the user to the wheels, causing a temporary interference at the wheel. For example, in some embodiments, a user applies a force to a hand brake lever 208 (e.g., fastened to a component of a telescoping load rail assembly (e.g., as shown in FIG. 22)) that is connected to a hand brake lever cable 20, which allows a linear motion to be transferred. The single hand brake lever cable 20 is connected to two other hand brake lever cables via a hand brake pull block 243 (e.g., fastened to a cross tube of the top frame 81 (e.g., shown in FIG. 11)) that act on two different wheels (e.g., the foot end wheels of the base frame), allowing a single hand brake lever 208 to actuate two separate brakes.

Figure 4A:
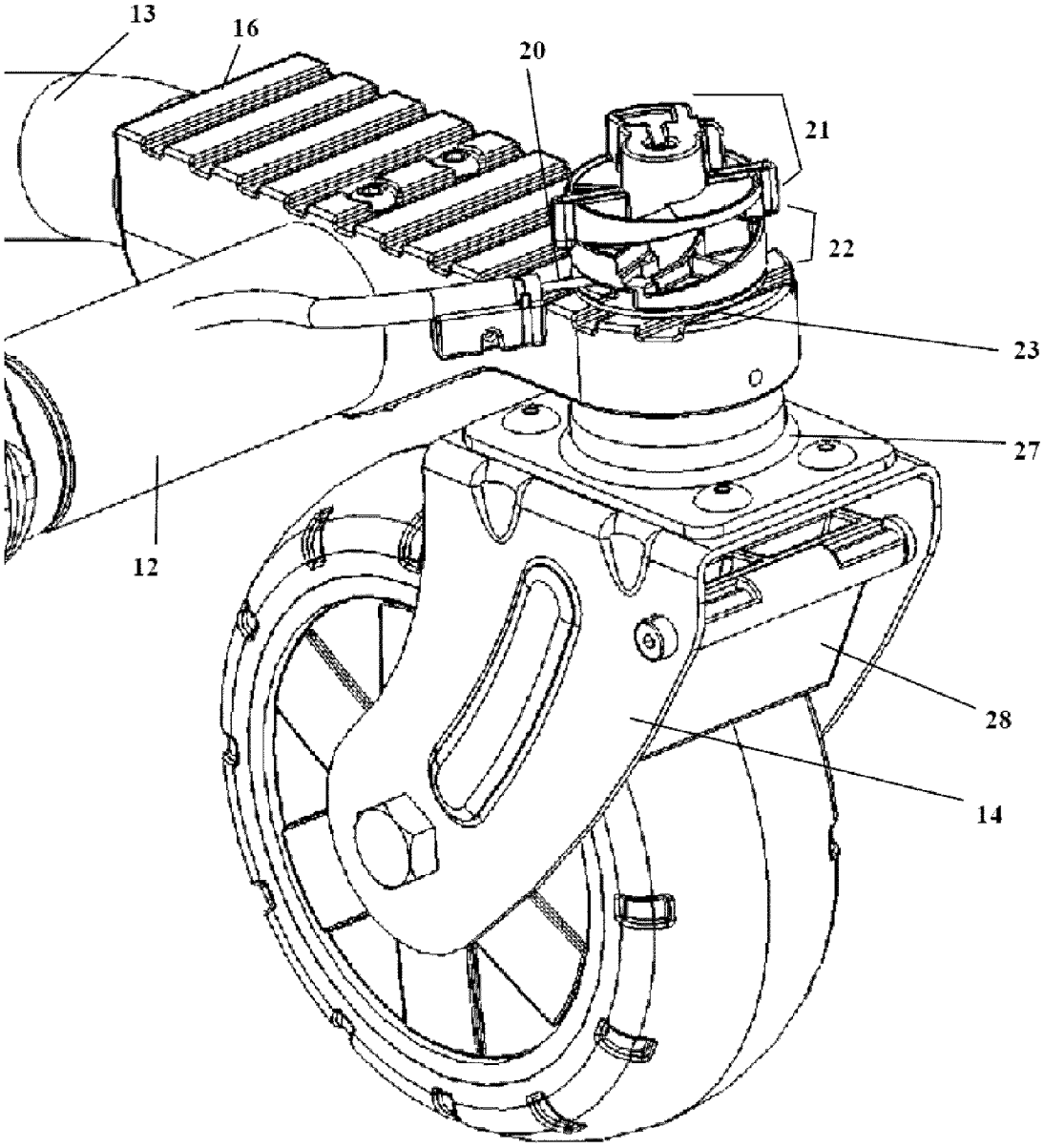
FIGS. 4A-4D show components of a hand braking mechanism of one embodiment of the invention.
Figure 4B:
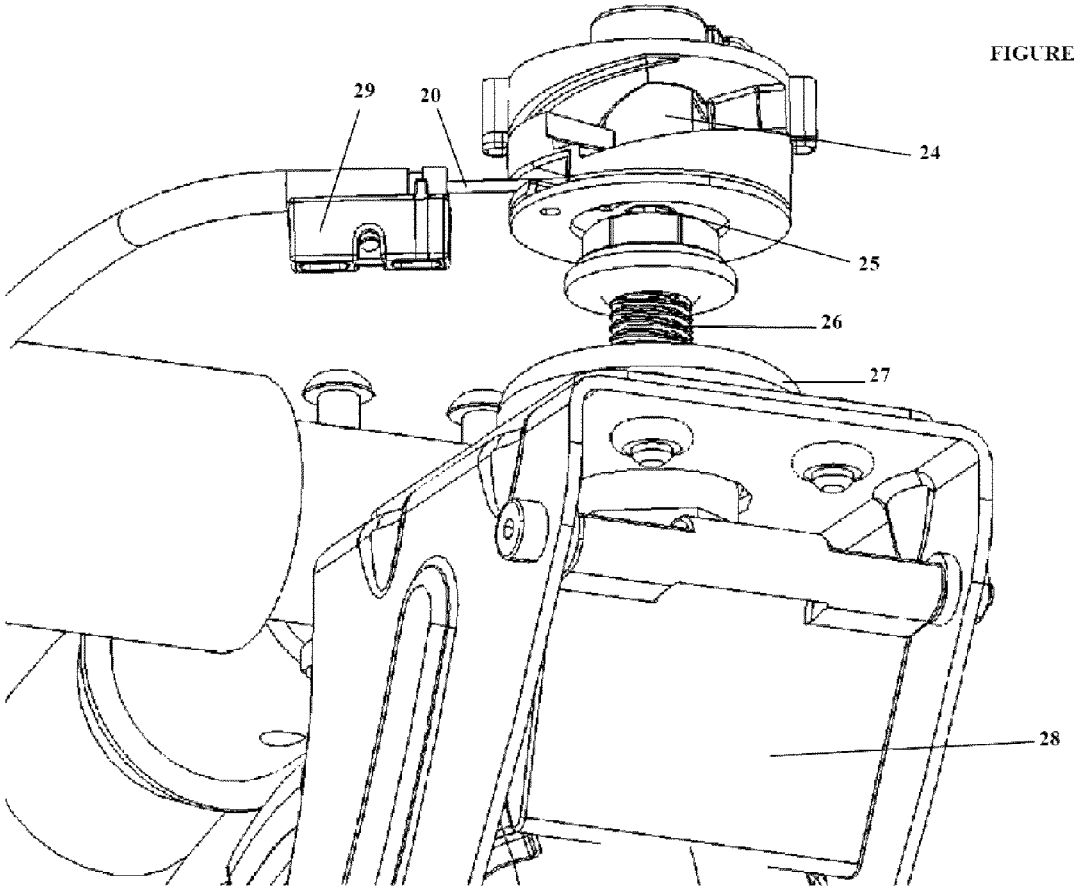
Figure 4C:
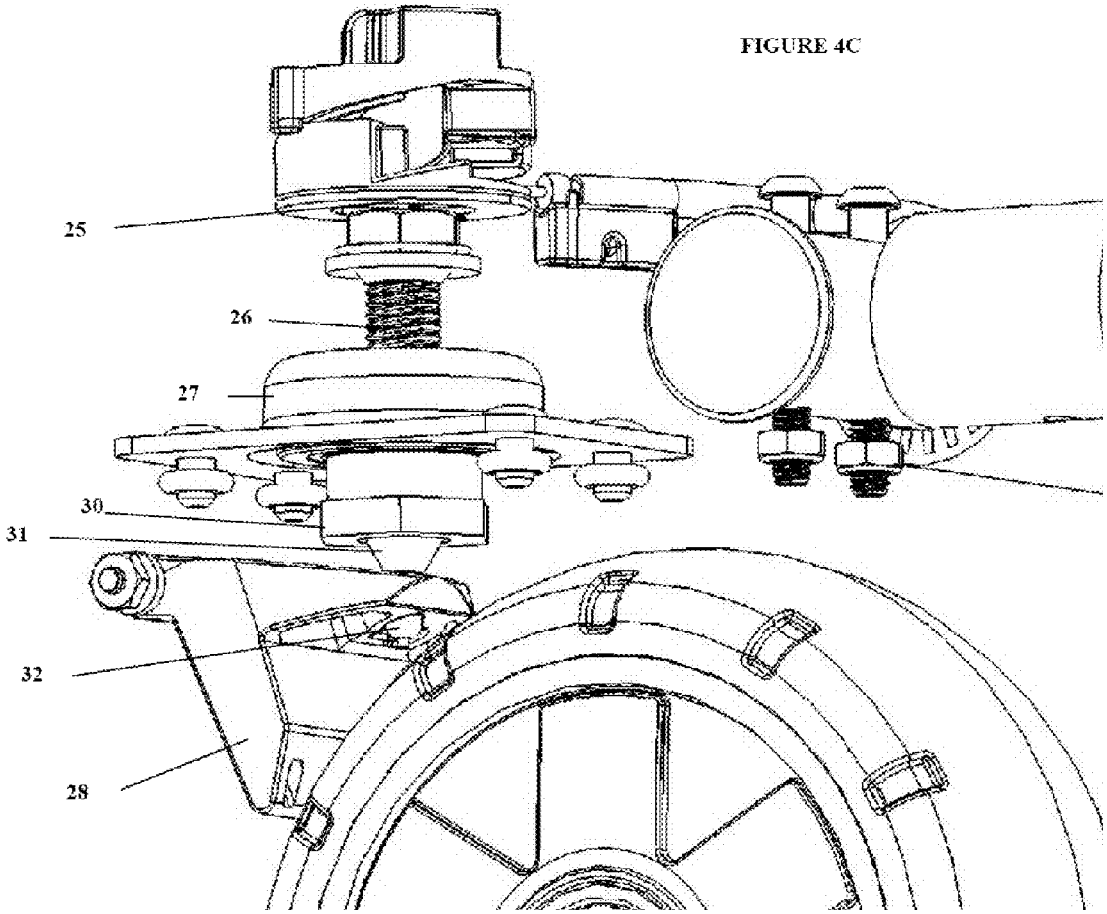
Figure 4D:
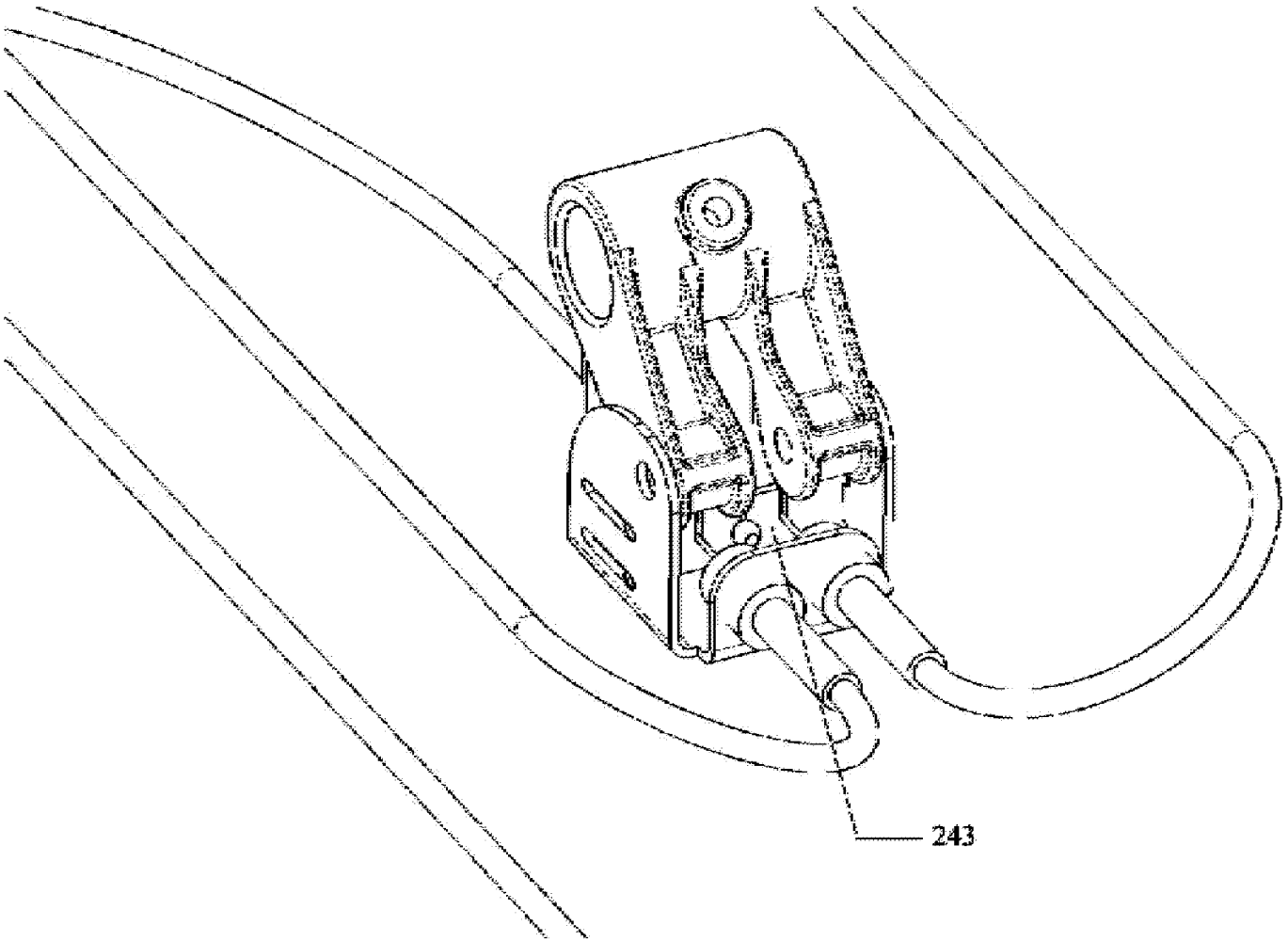

As shown in FIGS. 4A-C, at each wheel, a hand brake lever cable 20 is connected to a rotary ramped lifter 22 that transfers the linear motion from the cable to a rotary motion. The rotary motion is then converted back to a linear motion via a cam surface of the linear ramped lifter 21, and is lifted up. The brake arm cable 25 connects the linear ramped lifter 21 and the brake arm 28. The linear motion of the linear ramped lifter 21 is used to pivot the brake arm 28, which pivots into the outside diameter of the wheel. A hand brake ramping mechanism of the invention may be configured as shown in FIGS. 4A-4C.

In some embodiments, a hand brake lever cable 20 connects to a hand brake lever 208 via a cable stop 32 located in a pocket (e.g., as shown in FIG. 4C). In some embodiments, a hand brake lever 208 is fastened to a component of a telescoping load rail assembly (e.g., a tube 190 as shown in FIG. 22) by having a shoulder screw run through the hand brake lever 208 pivot. The hand brake lever mount top and hand brake lever mount bottom retain the hand brake lever by having the shoulder screw attached. The shoulder screw can be tightened, but still allow for clearance for the lever to rotate. The hand brake lever mount top and hand brake lever mount bottom can be fastened to a cot component (e.g., a tube 190 of the telescoping load rail assembly (e.g., by a screw that runs through a hole in the tube 190)). In some embodiments, the lever 208 is actuated approximately 45 degrees, and is stopped by the tube 190 to limit travel. The hand brake lever cable 20 goes to the hand brake cable mount where a threaded end of the covering sheath is attached to the plate. In some embodiments, the threaded end allows for adjustment of the length of the hand brake cable to account for manufacturing conditions.

The hand brake lever cable 20 end mounts to the hand brake pull block 243 via cable stop 32, and two other hand brake lever cables 20 are attached via cable stops 32. The force and motion of the first hand brake lever cable 20 is transferred to the second two, allowing for two brakes to be used simultaneously. The second two hand brake lever cables are attached to the same hand brake cable mount via threaded ends. In some embodiments, the threaded ends allow for adjustment of the cable length to account for manufacturing conditions. At each wheel, the hand brake lever cable 20 pulls on the rotary ramped lifter 22 and rotates it approximately 90 degrees. The hand brake lever cable 20 is covered in a sheath that has a slotted metal end to allow for it to be located on the connector cover 17 with the hand brake cable locator 29. The hand brake cable locator 29 is riveted to the connector cover and has a tab that fits into the hand brake lever cable 20 locator slot. The hand brake lever cable 20 has a cable stop 32 on the end that is located in a pocket of the rotary ramped lifter 22. The rotary ramped lifter 22 has a slot to allow for clearance. The rotary ramped lifter 22 is housed in a connector cover 17 which constrains the outside diameter of the rotary ramped lifter 22 and a thrust washer 23 constrains the rotary ramped lifter 22. The thrust washer 23 is constrained by the base connector 16 and the connector cover 17. The thrust washer 23 is used to reduce friction of the bottom surface of the rotary ramped lifter 22. The linear ramped lifter 21 is constrained in the connector cover 17 by two tabs that do not allow for rotary motion, only linear. The cam surface of the rotary ramped lifter 22 pushes onto the linear ramped lifter 21 and moves it upwards (e.g., approximately 0.280 inches, or more) during braking. The rotary ramped lifter is biased such that the brake is relaxed (e.g., collapsed) by way of a torsion spring between linear ramped lifter and the rotary ramped lifter. The brake arm cable 25 is constrained in a pocket of the linear ramped lifter 21 by a cable stop 32 on its end, and is located at the center of the wheel caster rotation. This allows for the wheel to rotate freely without the cable becoming twisted. The brake arm cable 25 has a cable stop 32 on the other end that is constrained in a pocket of the brake arm 28. The rotary ramped lifter 22, linear ramped lifter 21, and the brake arm 28 have a sufficient hole and slot that allow for the cables to be attached to the part with the balls already swaged. The brake arm 28 pivots about a shoulder bolt. The brake arm 28 is biased such that the brake arm 28 is not in contact with the wheel unless a force is applied by the user by way of a conical spring 31 applying a force. In some embodiments, the brake arm 28 is located such that it drags against the wheel (e.g., rather than digging into the wheel (e.g., that could cause a sudden complete and un-safe stop)). A conical spring 31 is used to allow for a larger range of motion. The caster wheel nut 30 is used to fasten the base connector 16 to inner raceway of the ball bearing that is pressed into the caster bracket sleeve 27. The caster wheel nut 30 has a counter bore that allows for the retention of the conical spring 31.

The present invention also provides other types of hand braking systems. For example, in some embodiments, a braking system configuration (e.g., shown in FIGS. 4A-4C) comprising a brake arm 28 utilizes replaceable pads (e.g., brake pads (e.g., thereby making maintenance easier)). In some embodiments, a hand braking system comprising a cable system as described above is utilized to actuate one or a plurality of brake arms into the side(s) of a wheel or hub (e.g., the brake arm rotates on an axis at 90 degrees compared to the configuration as shown in FIGS. 4A-4C). In some embodiments, a cot of the present invention comprises two or more separate hand brake levers that engage a braking system as described herein.

In some embodiments, the present invention provides a cot comprising wheels that are easily changeable in order to adapt to a particular environment. For example, in some embodiments, a cot user may change cot wheels to a nobbied wheel for an off pavement rescue/recovery (e.g., through a corn field or forest). In some embodiments, a cot utilizes skis and/or treads (e.g., an adapted tank tread) in place of wheels (e.g., for a snow environment). In some embodiments, a cot of the present invention comprises a locking mechanism that engages a pair of wheels (e.g., the wheels on the foot-end, and/or the wheels on the head-end) in a fixed, straight position. This type of fixing/locking provides a means to keep the wheels, and the cot, straight (e.g., allowing the cot to track better (e.g., precluding the cot from getting sideways (e.g., on inclines))). In some embodiments, because each caster fork 14 can move independently from the others, this allows a cot of the present invention to roll forward (e.g., down or up an incline) at a sideways angle. In some embodiments, a caster fork 14 comprises an integrated spring suspension system (e.g., reducing and/or preventing vibration artifacts, increasing patient/subject comfort, and/or participating in a traction control system).

Figure 5:
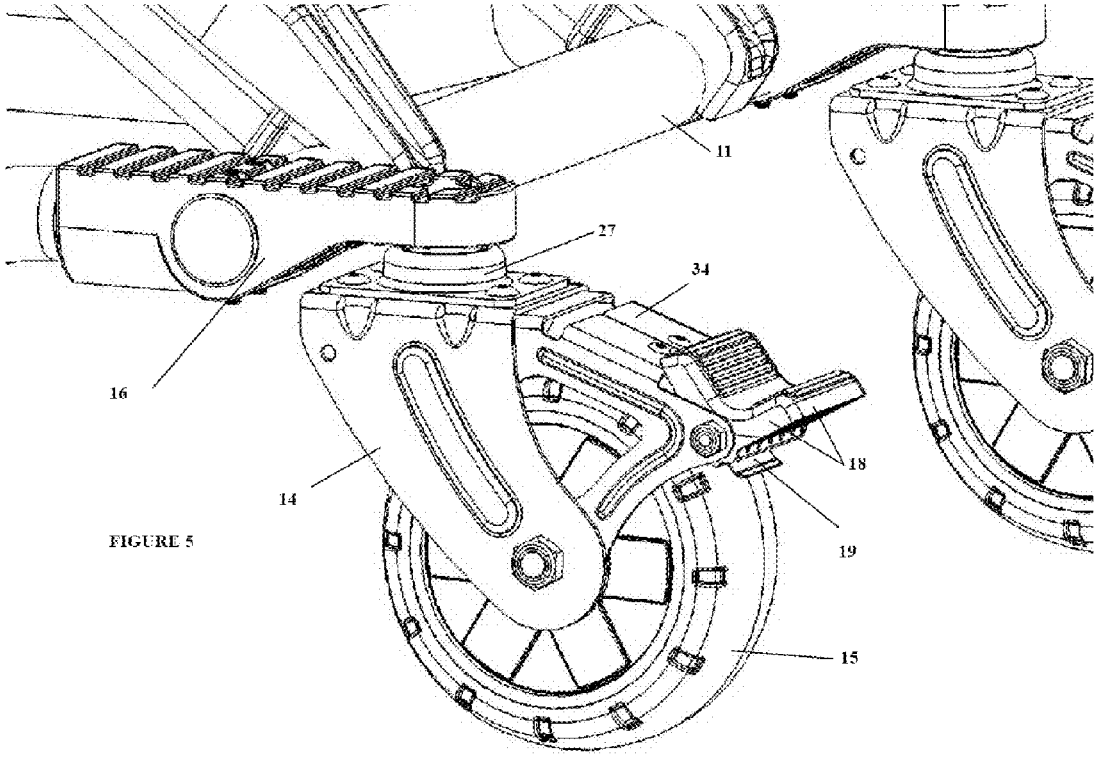
FIG. 5 shows components of a foot brake of one embodiment of the invention.

As shown in FIG. 5, caster forks 14 attached to base connectors 16 (e.g., via a caster bracket covered by a caster bracket sleeve 27) attached to the head-end cross tube 11 can attach to a foot brake 18 comprising a wheel brake plate 19 (e.g., fastened to the caster fork 14 via a wheel brake bracket 34).

As illustrated in the figures (e.g., FIGS. 3A and 3B), the head-end cross tube 11 and foot-end cross tube 12 of the base frame 10 attach to leg assemblies of the cot. For example, the head-end cross tube 11 pivotally attaches to a telescoping leg assembly comprising a pair of telescoping legs 50, and the foot-end cross tube 12 pivotally attaches to a fixed leg assembly comprising a pair of fixed legs 40. In some embodiments, the base frame 10 may comprise a light emitting component (e.g., a light, a light tube, rope light, etc.) that illuminates the base frame and/or surrounding area (e.g., for nighttime visibility and/or daytime safety (e.g., in the event the cot is utilized to function as a "safety cone," indicator or other type of barrier)). Additionally, the base frame 10 may comprise storage plates (e.g., top mounted storage plate) and/or fasteners (e.g., for attaching other components (e.g., a resuscitation system and/or other accessories)). The base frame 10 may be utilized to house and/or support a traction control system, suspension package (e.g., independent suspension), and/or attachment components for a cot mounting system.

Figure 3B:
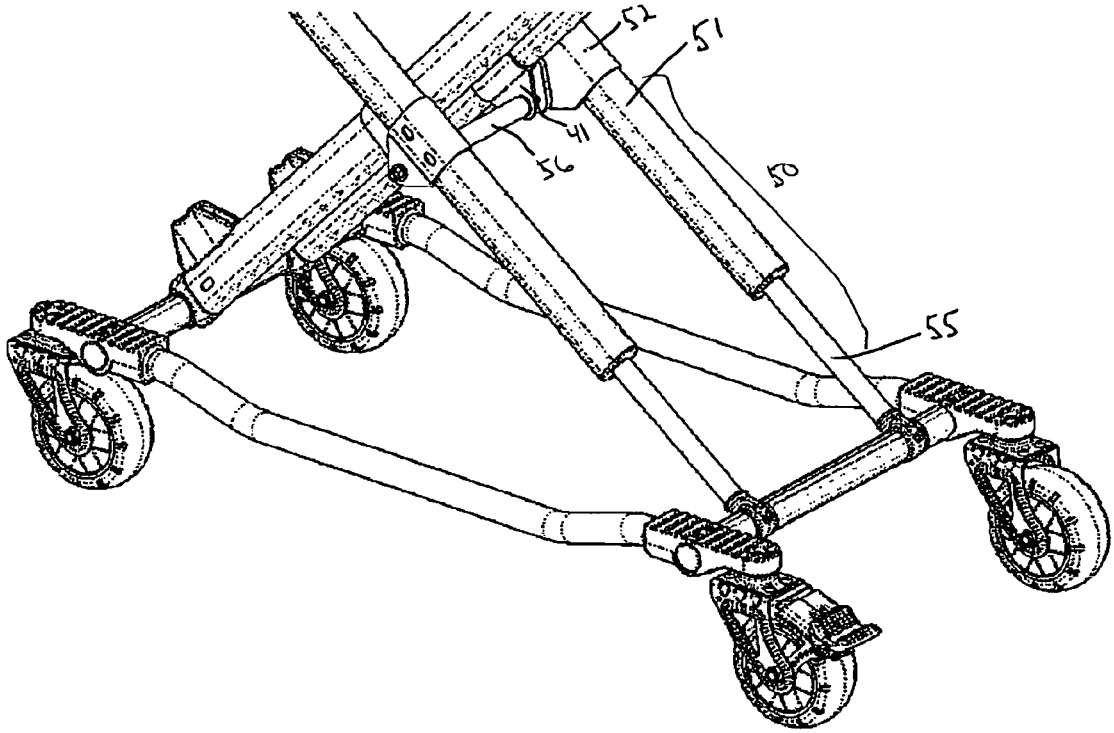
Figure 6:
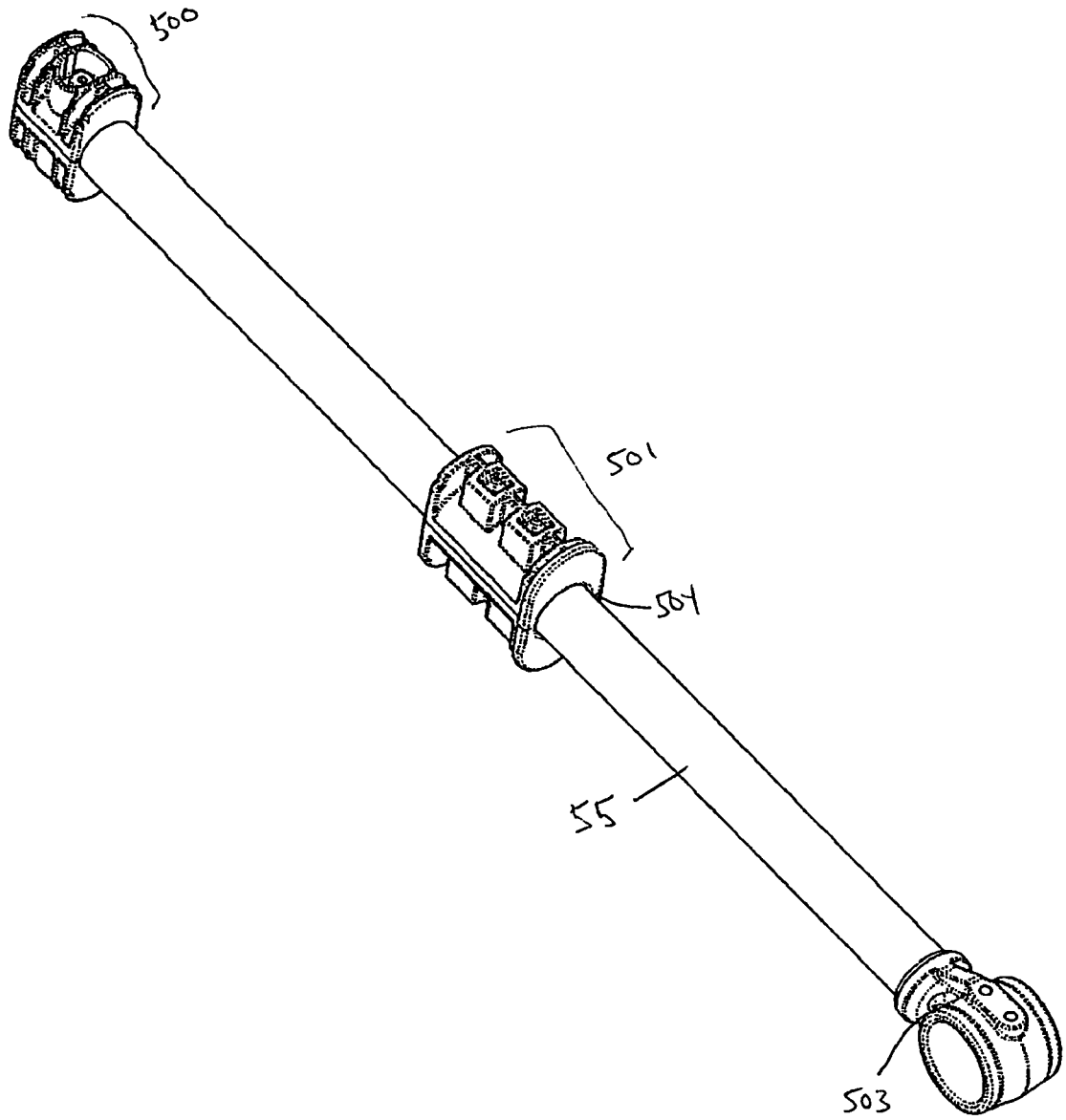
FIG. 6 shows an inner leg, slider bushing and end bushing components of a telescoping leg assembly in one embodiment of the invention.

As further illustrated in FIGS. 3A and 3B, in some embodiments, an ambulance cot system of the invention comprises a telescoping leg assembly comprising a pair of telescoping legs 50. The telescoping legs 50 comprise a main, outer leg 51 and an inner leg 55 wherein the inner leg 55 moves in a telescoping manner within and outward from the main, outer leg 51. In some embodiments, the present invention provides telescoping legs 50 comprising a main, outer leg 51 and an inner leg 55, wherein the inner leg is a fixed length and is fixed to one or more bushings (e.g., a slider bushing 500 (e.g., fastened to the end portion of the inner fixed length leg that resides within the outer leg (e.g., as shown in FIG. 6))). The telescoping legs 50 may also comprise one or more bushings (e.g., end bushings 501) that are fastened to the outer telescoping leg (e.g., at the end portion of the main, outer leg through which the inner leg telescopingly moves (e.g., shown in FIG. 6)), wherein the end bushing 501 comprises a bore 504 through which the inner leg moves. In some embodiments, the slider bushing 500 comprises a slotted opening 505 through which a shoulder bolt 506 attaches the inner leg 55 to the slider bushing 500.

Figure 7:
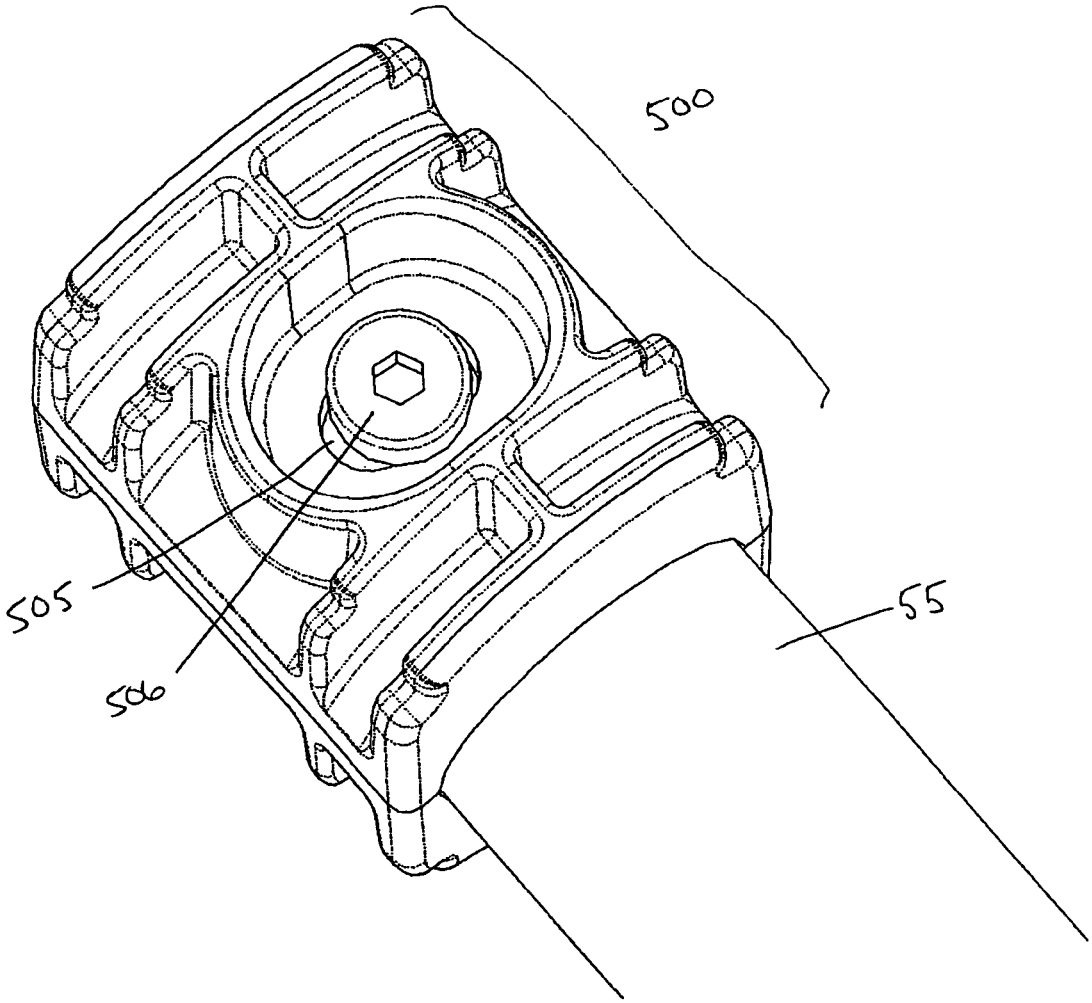
FIG. 7 shows the connection of a slider bushing to an inner rail of the telescoping leg assembly in one embodiment of the invention.
Figure 8:
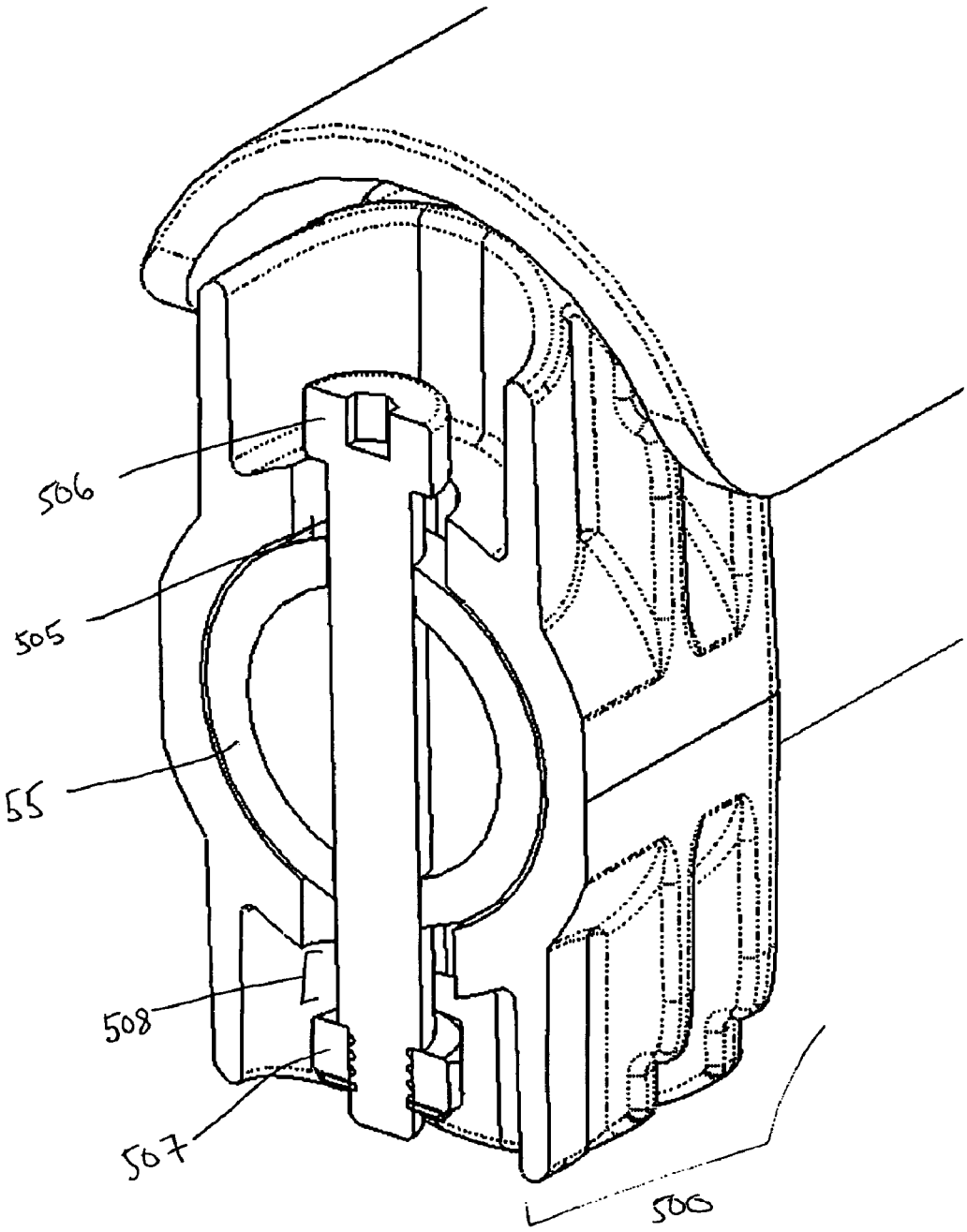
FIG. 8 shows a cross section of a slider bushing comprising a slotted opening, shoulder bolt, inner rail, nut and clearance space of a telescoping leg assembly in one embodiment of the invention.
Figure 9:
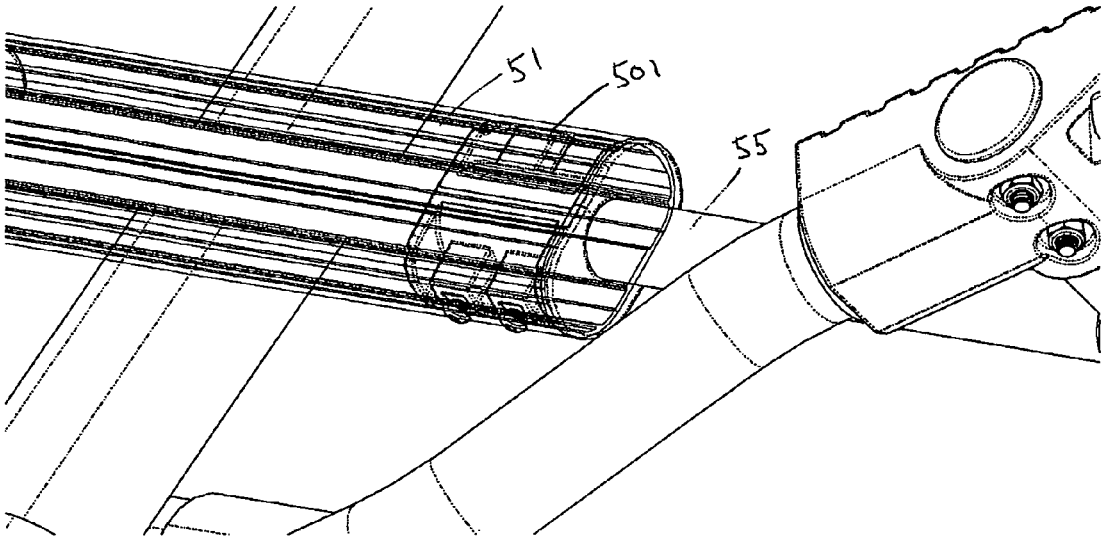
FIG. 9 shows a view of a telescoping leg assembly of a cot wherein the outer leg has been drawn in a transparent fashion in one embodiment of the invention.

As shown in FIGS. 7 and 8, in some embodiments, a nut 507 tightens to the shoulder bolt 506 to attach the inner leg 55 to the slider bushing 500, wherein the length of the bolt 506 is such that when the inner leg 55 is attached to the bushing 500, there is a certain amount of clearance 508 of the nut such that the bolt 506 is able to pivot freely within the slotted opening 505 (e.g., providing a degree of flex and/or rotation of the inner leg 55).

In some embodiments, the present invention provides telescoping legs 50 comprising a outer leg 51 and an inner leg 55, wherein each of the outer legs 51 are fastened to an extruded portion comprising a pivot 52 (e.g., as shown in FIGS. 1, 2A, 3A and 3B). A pivot 503 attached to the inner leg 55 is pivotally attached to the head end cross tube 11 of the base frame 10 (e.g., as shown in FIGS. 1, 2A, 3A and 3B). Also illustrated in FIGS. 1, 2A, 3A and 3B, a cot of the present invention comprises a pair of fixed length legs 40 that are pivotally attached to the foot end cross tube 12 of the base frame 10. In some embodiments, the fixed length legs 40 are also fastened to an extruded portion comprising a pivot 41 as shown in FIGS. 1, 2A, 3A and 3B. In some embodiments, a cross tube 56 is fastened to each of the extruded portions comprising a pivot 41 attached to the fixed length legs 40.

The cross tube 56 serves multiple functions in a cot of the present invention. The cross tube 56 harmonizes the movement of each of the telescoping legs 50 (e.g., the outer legs 51 and inner legs 55) when the cot is raised or collapsed. Additionally, the cross tube 56 steadies the cot when the cot is raised or lowered (e.g., by absorbing energy associated with movement about a pivot point of the cot (e.g., that occurs when a cot is raised or collapsed)).

Thus, in some embodiments, the present invention provides a cot comprising a pair of fixed legs 40 and a pair of telescoping legs 50, wherein the outer legs 51 of the telescoping legs 50 and the fixed length legs 40 are fastened to each other via a cross tube 56 that is fastened to each of the extruded portions (41,52) of the fixed legs 40 and outer telescoping leg 51 (e.g., as shown in FIG. 2A). In some embodiments, each of the extruded portions 41, 52 comprise a pivot through which the cross tube 56, and thus the legs, are pivotally attached.

In some embodiments, the present invention provides an ambulance cot comprising a telescoping leg assembly comprising a roller bearing system. In some embodiment, the telescoping leg assembly comprising a roller bearing system comprises both a main, outer rail/leg and an inner rail/leg. In some embodiments, the main rail comprises a top side and bottom side, wherein the top side of the main rail comprises an extruded portion fastened to the main rail that comprises a roller bearing, wherein the roller bearing rolls along the top side of the inner rail (e.g., when the telescoping leg assembly is expanded (e.g., when the cot is raised) or contracted (e.g., when a cot is lowered or collapsed). In some embodiments, a cot comprises two telescoping leg assemblies (e.g., with each comprising a roller bearing system) that are parallel to each other wherein the main rails of each telescoping leg assembly are fastened to each other via a cross tube that is irremovably attached to each of the extruded portions of the main rails. In some embodiments, a cot comprises four telescoping leg assemblies (e.g., with each comprising a roller bearing systems). In some embodiments, the inner rail comprises a top side and a bottom side, wherein one or more roller bearings (e.g., two, three, four or more) are connected to a top portion and one or more roller bearings (e.g., two, three, four or more) are connected to a bottom portion of the inner leg, wherein the roller bearings roll along the inside face of the top side of the main rail and the inside face of the bottom side of the main rail when the telescoping leg is expanded (e.g., when a cot is raised) or contracted (e.g., when a cot is lowered or collapsed). In some embodiments, the roller bearing system reduces frictional force of the telescoping legs (e.g., the frictional force associated with an increase or decrease in length of the telescoping legs (e.g., that occurs with raising or lowering of the cot)).

Figure 10:
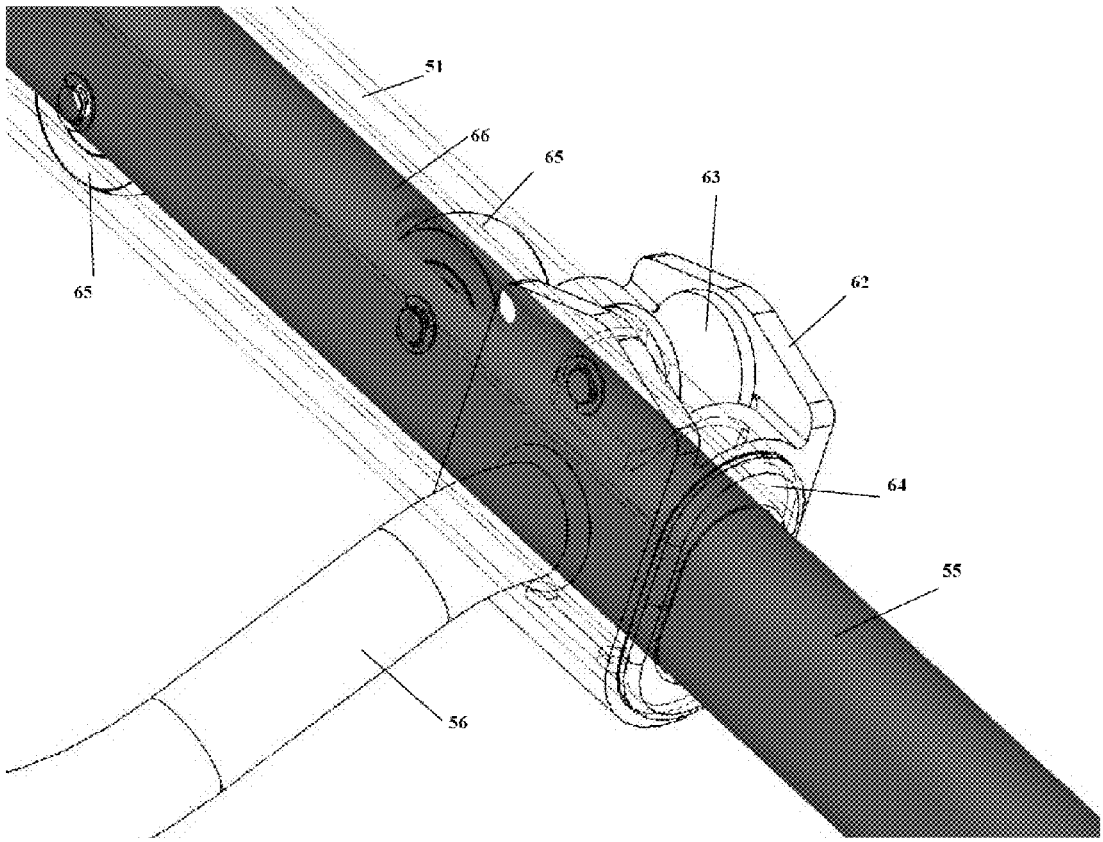
FIG. 10 shows a view of the telescoping leg assembly wherein the main rail has been made transparent (represented by the plurality of parallel lines) thereby providing a view of the inner rail (shaded) including openings therein, and rollers attached thereto and extruding therefrom, in one embodiment of the invention.

For example, FIG. 10 illustrates one configuration of a roller bearing system of the invention. The main rail 51 is shown in a transparent manner in order to visualize components of the roller bearing system within the main rail 51. For example, the inner rail 55 is shown in grey, comprising a roller bearing 65 present on a top portion (e.g., the roller bearing 65 attached to the inner rail 55 that is adjacent to the extruded portion 62 of the main rail 51) as well as a roller bearing 65 attached to a bottom portion of the inner rail 55 that rests upon and rolls along the inside face of the bottom side of the main rail 51. Thus, the present invention provides telescopic movement of the inner rails 55 along and outward from the main rails 51 made possible by the presence of roller bearings 65 attached to the inner rail 55 that roll along the inside of the main rail 51, as well as by roller bearings 63 attached to the extruded portion 62 of the main rail 51 that roll along the top side of the inner rail 55.

The present invention is not limited by the number of roller bearings 65 attached to the inner rail 55 (e.g., on a top portion or on a bottom portion of the inner rail 55). For example, an inner rail 55 may comprise two, three, four, five or more roller bearings 65 attached to a top portion of the inner rail 55 (e.g., that contact and/or roll along the inside face of the top side of the main rail 51) and/or two, three, four, five or more roller bearings 65 attached to a bottom portion of the inner rail 55 (e.g., that contact and/or roll along the inside face of the bottom side of the main rail 51). Similarly, the main rail 51 may comprise a plurality of roller bearings 63 attached to the extruded portion 62 of the main rail 51. For example, in addition to the roller bearing 63 attached to the extruded portion 62 of the main rail 51 (e.g., shown in FIG. 10), a cot system 1 of the present invention may comprise additional roller bearings 63 (e.g., attached to a bottom portion of the extruded portion 62 (e.g., whereby the roller bearing 63 contacts and rolls along the bottom of the inner rail 55)). In some embodiments, a roller bearing 63 attached to the extruded portion 62 of the main rail 51 comprises a concave surface (e.g., that contacts and rolls along a convex inner rail 55 surface). In some embodiments, a roller bearing 65 attached to an upper portion or a lower portion of the inner rail 55 comprises a convex surface (e.g., that contacts and rolls along a concave main rail 51 surface (e.g., the inside face of the top side or the inside face of the bottom side of the main rail 51)). The present invention is not limited by the type of material utilized for roller bearings 63, 65. Indeed, a variety of materials are well known to those of ordinary skill in the art including, but not limited to, rubber, metal (e.g., steel), plastics, composites, glass, or ceramic. In some embodiments, roller bearings 63, 65 utilized in a cot system 1 of the present invention comprise a cross section that matches the profile of the inner rail 55 and/or main rail 51 of the telescoping leg 50.

Thus, in some embodiments, the present invention provides a telescoping leg assembly 50 comprising a roller bearing system, wherein the system comprises a telescoping leg comprising a main rail and an inner rail, wherein the main rail comprises one or more roller bearings that contact and roll along the inner rail and wherein the inner rail comprises one or more roller bearings that contact and roll along the inside of the main rail (e.g., during telescoping movement of a portion of the inner rail from within the main rail to a position outside of the main rail). Thus, a roller bearing system of the present invention reduces frictional force associated with raising and/or lowering a patient on a cot (e.g., increasing or decreasing the length of the telescoping legs). In alternative embodiments, a roller bearing system of the present invention utilizes any rolling means known to one of skill in the art (e.g., a polymeric roller or the like (e.g., DELRIN roller (DUPONT, Wilmington, Del.))) that reduces and/or eliminates sliding friction associated with raising and/or lowering cot legs (e.g., telescoping legs).

As illustrated in FIG. 2A, components of the telescoping legs may be attached to one or more pieces of material that act as guards 53, 54 of the telescoping leg assembly 50 (e.g., that protect the leg assembly (e.g., from ambulance rear bumper). For example, the outer leg may comprise a lower guard 54 and/or an upper guard 53 that protect the telescoping leg components (e.g., the outer rail/leg 51 and inner rail/leg 55) during loading and/or unloading of a cot of the invention into or out of an ambulance. In some embodiments, each inner leg 51 that attaches to the head-end cross tube 11 of the base frame 10 comprise attachment points (e.g., screw and/or mount holes (e.g., within pivot attachment 57 (e.g., shown in FIG. 3A) between the telescoping leg 50 and head-end cross tube 11)) for attachment of a guard (e.g., plastic or other type of material) that protects the leg (e.g., when being loaded into and/or unloaded from the back of an ambulance (e.g., that absorbs contact forces between the cot and ambulance)).

Figure 12:
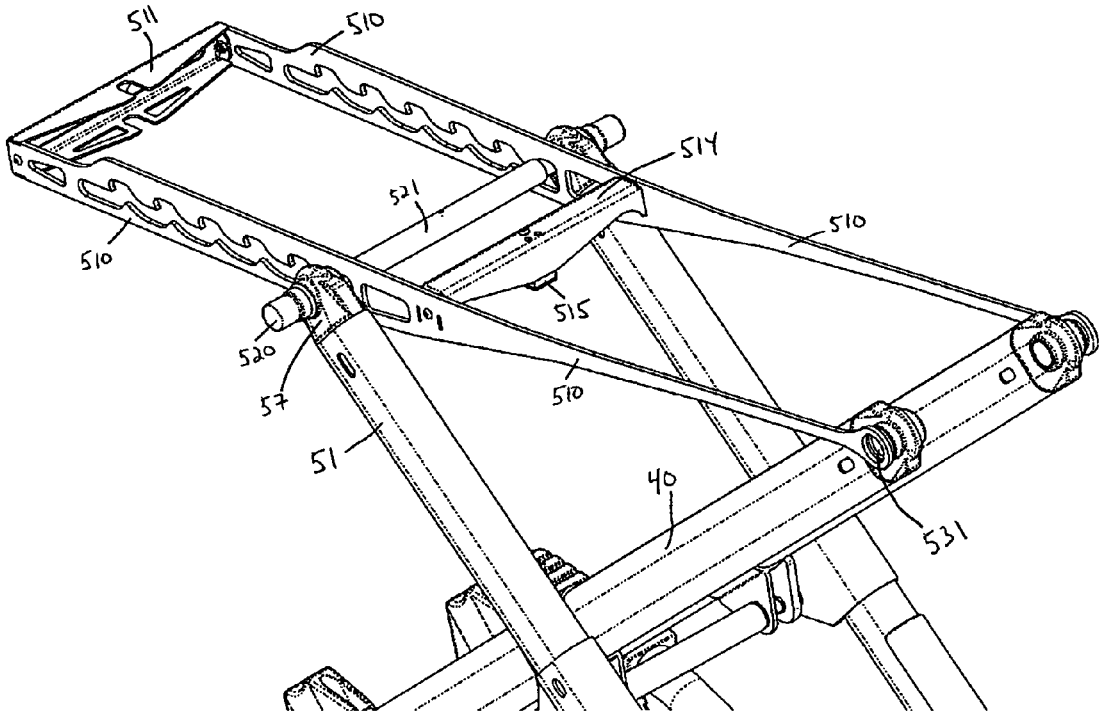
FIG. 12 shows a view of components of a notched ladder rail assembly in one embodiment of the invention.

FIG. 3A illustrates that, in some embodiments, the telescoping leg assembly 50 comprising a main rail/leg 51 and an inner rail/leg 55 pivotally connects to the head-end cross tube 11 of the base frame 10. In particular, the inner rails/legs 55 pivotally connect 57 to the head-end cross tube 11 of the base frame 10. As illustrated in FIG. 12, the main rails/legs 51 pivotally connect 57 to a ladder rod 520. In some embodiments, the ladder rod 520, covered by a ladder rod sleeve 521, is covered on each end by a bearing holder 522, wherein the bearing holders 522 are attached to slider blocks 83 that reside within slider housings 75 attached to a foot-end portion of the top frame 74 (e.g., as shown in FIG. 11).

In some embodiments, a cot system of the present invention comprises a fixed leg assembly comprising a pair of fixed-length legs 40 (e.g., as illustrated in FIGS. 2, 3A, and 11). The fixed length legs 40 are parallel to each other and pivotally connect 57 to the foot-end cross tube 12 of the base frame 10 and a head-end cross tube 81 of the top frame 74 (See, e.g., FIGS. 3A and 11). In some embodiments, a pair of fixed-length legs provide a cot of the present invention a sturdier, more robust configuration (e.g., than a cot figured without a pair of fixed-length legs (e.g., comprising two pairs of telescoping legs).

In some embodiments, the configuration of a cot system shown in FIGS. 1-3 and 11 provides leg assemblies (e.g., fixed leg and telescoping leg assemblies) that pivot about an axis that resides below the legs themselves. Thus, the present invention provides a cot pivot point that is below the legs (e.g., compared to other cots that pivot about an axis that runs through the center of the legs). In some embodiments, a configuration of a cot of the present invention (e.g., comprising a pivot about an axis that resides below the legs) provides a sturdier and more robust cot. For example, the pivot axis running below the legs allows a fixed-length leg, together with a telescoping leg, to be configured such that the cot at its fully collapsed position is low enough (e.g., comprises a litter seat height of about 15.5 inches to the ground, and at its fully raised position is high enough (e.g., comprises a load wheel height of about 36 inches to be useful (e.g., from an energy usage perspective (e.g., for loading a subject onto a cot and/or loading a cot carrying a subject onto and/or off of an ambulance)).

In some embodiments, the present invention provides a cot that comprises a position of the pivot point that satisfies certain requirements. For example, in some embodiments, a cot comprising a fixed leg assembly (e.g., comprising one pair of legs of fixed length) and a telescoping leg assembly (e.g., comprising a pair of legs with variable length) comprises a litter seat height that, at the lowest cot position (e.g., a fully collapsed position), is around 15 inches from the ground. The present invention is not limited to this height. Indeed, at the lowest cot position (e.g., a fully collapsed position), several different litter seat heights are contemplated including, but not limited to, around 9 inches, 10 inches, 11 inches, 12 inches, 13 inches 14 inches, 16 inches, 17 inches, 18 inches, or heights below or above these amounts. In some embodiments, it is preferred to keep the litter as close to "level" as possible when to cot is at its lowest (e.g., most compact) position. Accordingly, in some embodiments, some degree of "negative slope" (e.g., head lower than feet) is tolerated (e.g., due to the combination of fixed and variable length legs). In some embodiments, the negative slope of the cot when the cot is at the lowest cot position (e.g., is fully collapsed) is around 2 degrees (although lower (e.g., 1 degree or less) and higher (e.g., 3 degrees 4 degrees, 5 degrees or more) are also contemplated). Similarly, in some embodiments, some degree of "positive slope" (e.g., head higher than feet) is tolerated (e.g., due to the combination of a fixed leg assembly and a telescoping leg assembly). In some embodiments, the positive slope of the cot when the cot is at a fully raised position (e.g., when a load wheel height of 36 inches or higher is achieved and/or when the litter seat height is about 43 inches and is around 12 degrees "positive slope".

In some embodiments, when the litter is in a semi-raised position to a point at which the litter is approximately parallel to the ground, the litter seat height is about 28 inches high. In some embodiments, the litter seat height will be less than 28 inches (e.g., 27, 26, 25, 24 inches or less) or more than 28 inches (e.g., 29, 30, 31, 32 or more inches) when the litter is approximately parallel to the ground. In some embodiments, having the litter seat parallel to the ground at about 28 inches from the ground helps to facilitate the transfer of a patient (e.g., to and/or from a bed, to and/or from another cot, etc.).

Thus, in some embodiments, a cot system of the present invention comprises a pivot point that is fixed about an axis residing below (e.g., that is 0.125 inches to 0.25 inches below, 0.25-0.5 inches below, 0.5-1.0 inch below, 1.0-1.5 inches below, 1.5-2.0 inches below, more than two inches below) the centerline of the legs (e.g., fixed legs and/or telescoping legs). In some embodiments, placement of the pivot point location (e.g., fixed about an axis residing below the centerline of the legs) provides a sturdier, more robust, more energy efficient and therefore a more useful cot.

Figure 13:
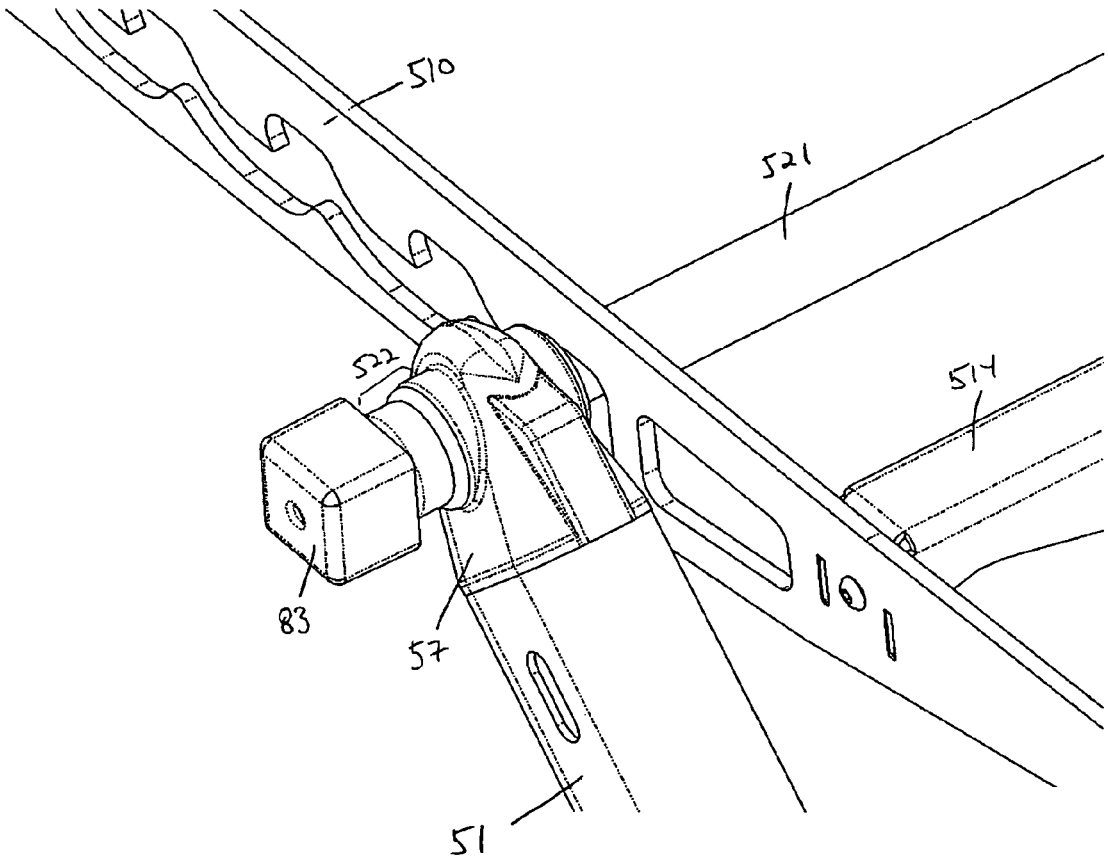
FIG. 13 shows components of a notched ladder rail assembly in one embodiment of the invention.
Figure 14:
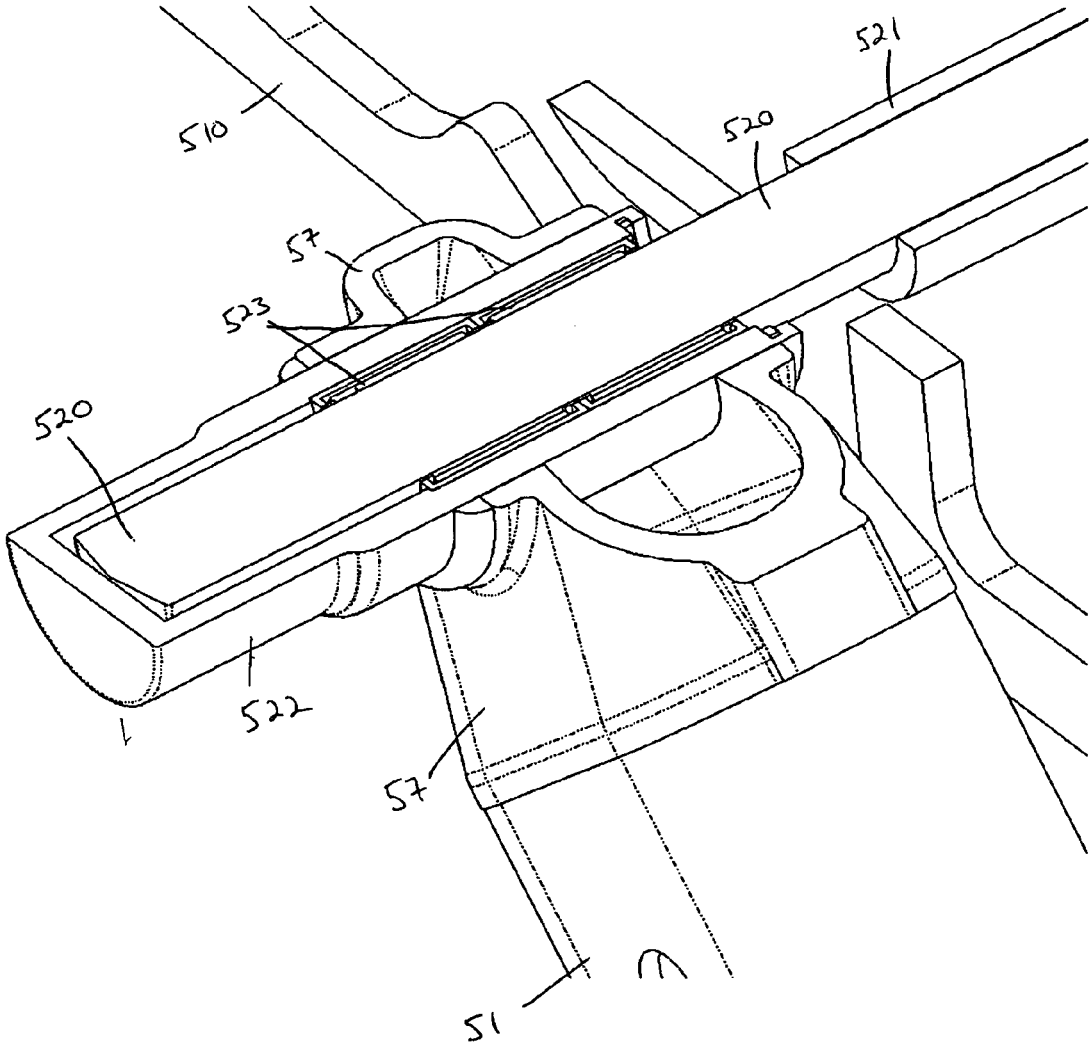
FIG. 14 shows a cross sectional view of components of a notched ladder rail assembly in one embodiment of the invention.

FIGS. 11-15 and 17 show components of a top frame as well as components of a notched ladder rail assembly in one embodiment of the invention. As illustrated in FIG. 11, foot end portions of the top frame 74 are attached to slider housings 75. The slider housings 75 are configured to hold a slider block 83 (e.g., depicted in FIG. 13) that is attached to a bearing holder 522 housing a ladder rod 520 (e.g., depicted in FIG. 14), wherein the bearing holder is pivotally connected to the outer leg 51 of the telescoping legs 50. As shown in FIG. 14, which represents a cross sectional view of components of the notched ladder rail assembly, bearing holders 522 present on each end of the ladder rod 520 are rotatably connected to the ladder rod 520 via one or a plurality of bearings (e.g., needle bearings 523 shown in FIG. 14). The slider blocks 83 attached to the bearing holders 522 slide within the slider housing 75 (e.g., when the cot is raised or lowered). In some embodiments, the ladder rod 520 is pointed on each end (e.g., as shown in FIG. 14), thereby reducing friction between the ladder rod 520 and the inside of the bearing holder 522 as the ladder rod 520 rotates about the bearings 523. In some embodiments, this configuration provides determination of cot height information used in a cot tip angle monitoring, recording and alert system of the present invention.

Figure 16:
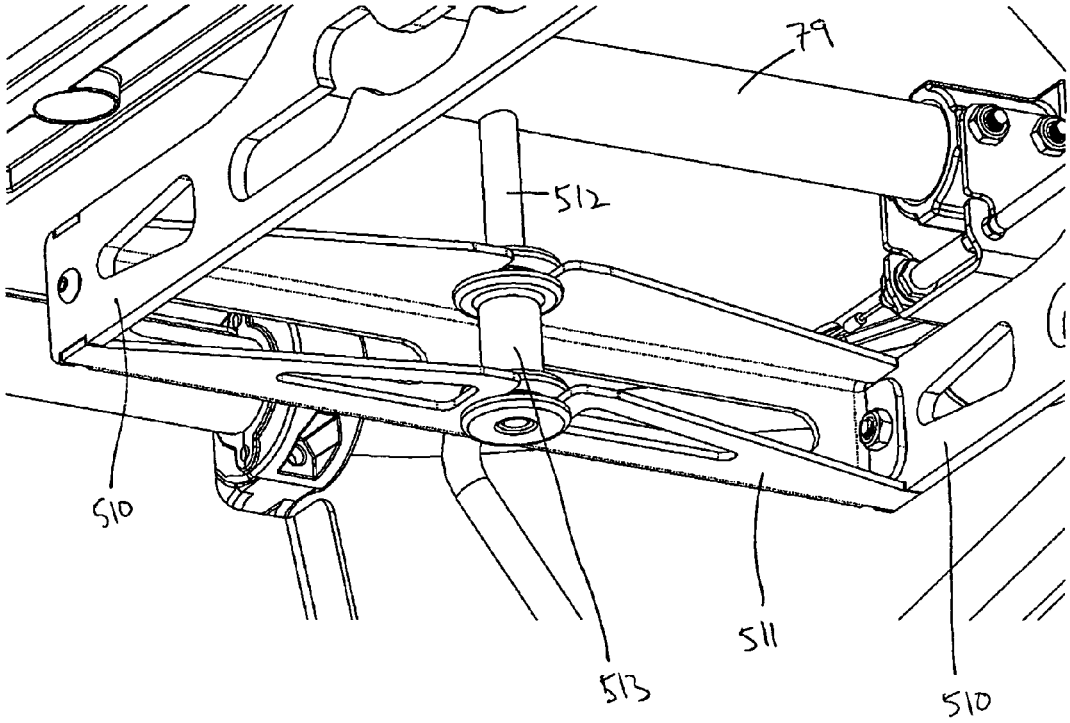
FIG. 16 shows components of a foot end notched ladder rail stiffener in one embodiment of the invention.
Figure 17:
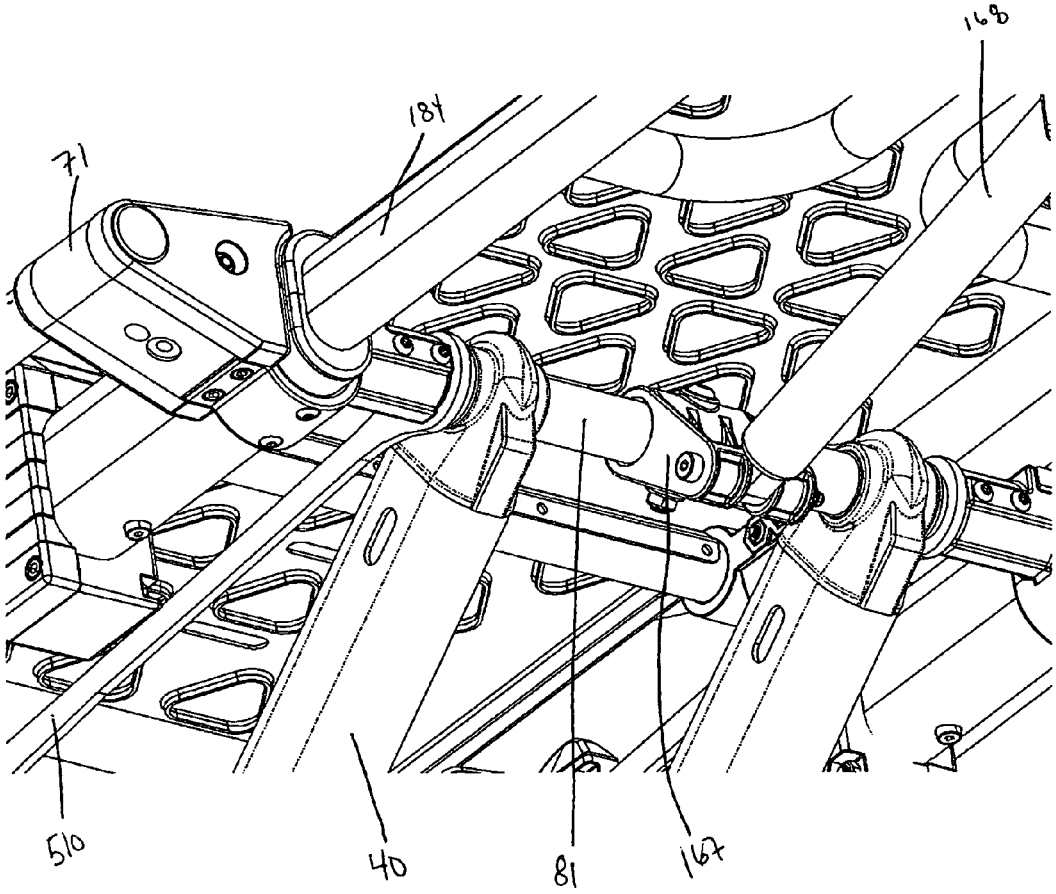
FIG. 17 shows components attached to a head end cross tube in a cot in one embodiment of the present invention.
Figure 18:
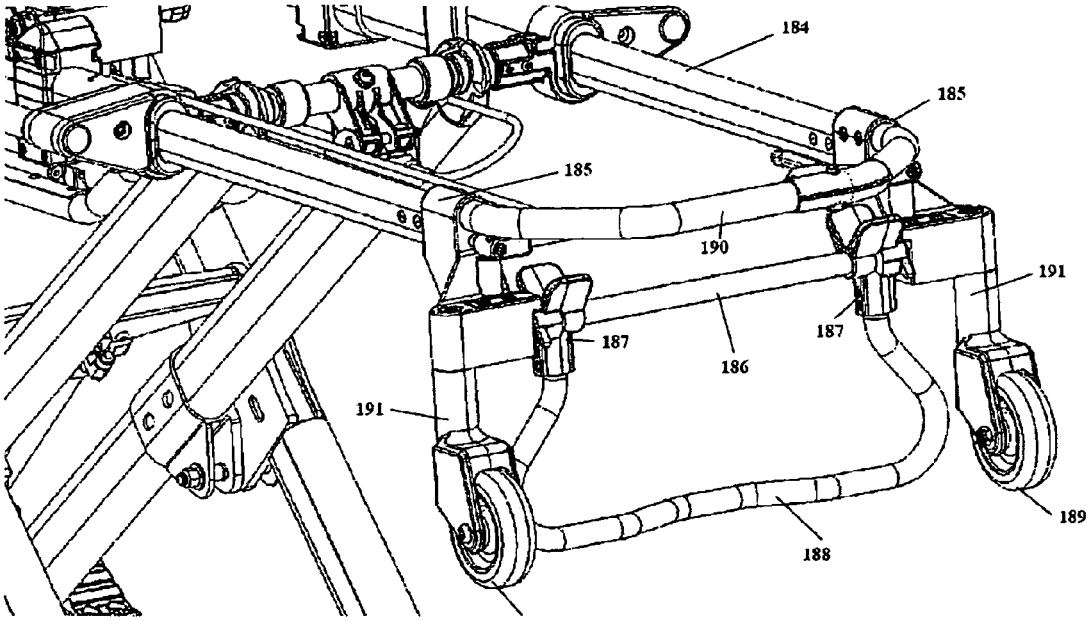
FIG. 18 shows components of a telescoping load rail assembly in one embodiment of the invention.
Figure 28:
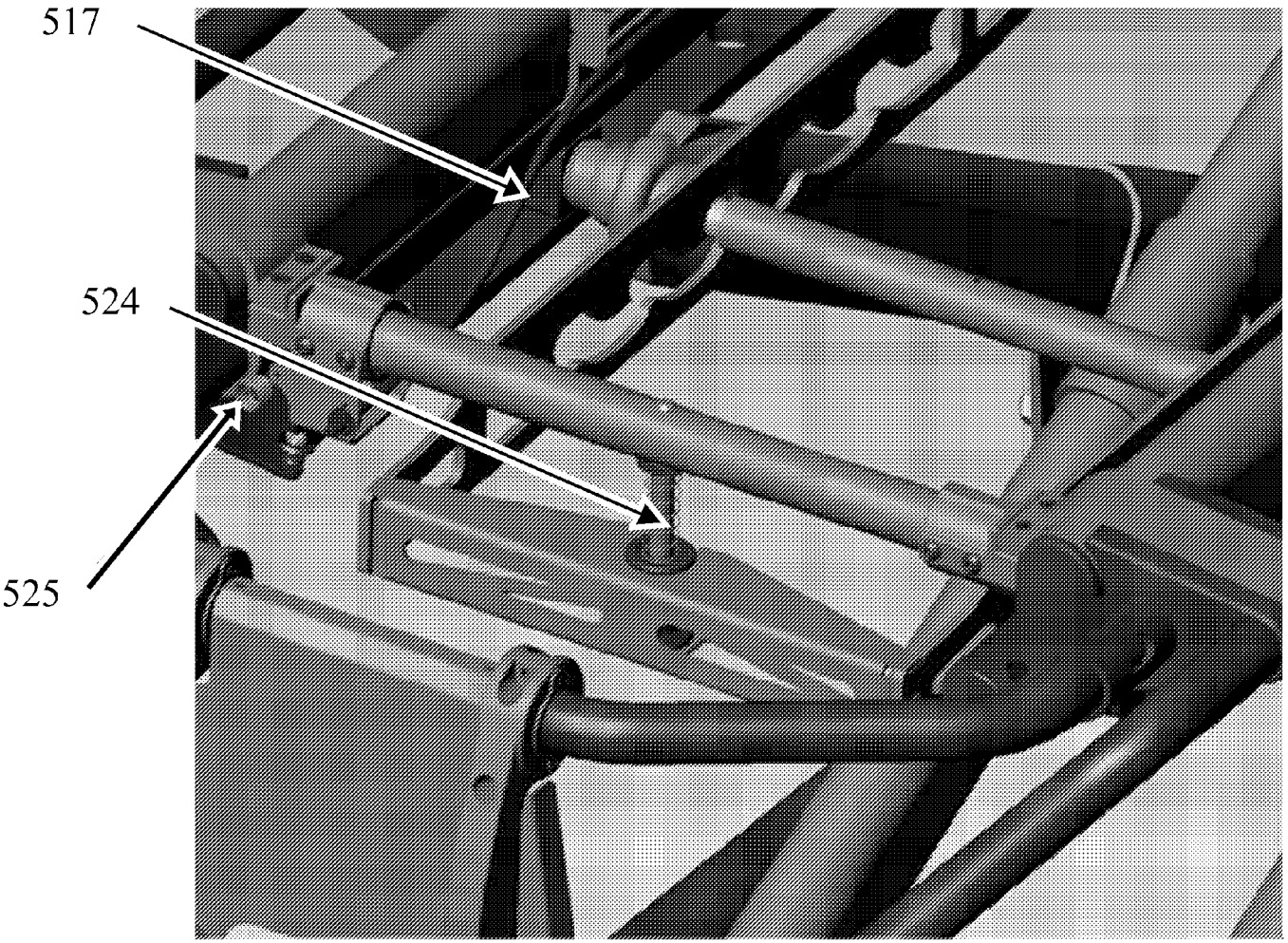
FIG. 28 shows components of a ladder rail assembly in one embodiment of the invention.
Figure 29:
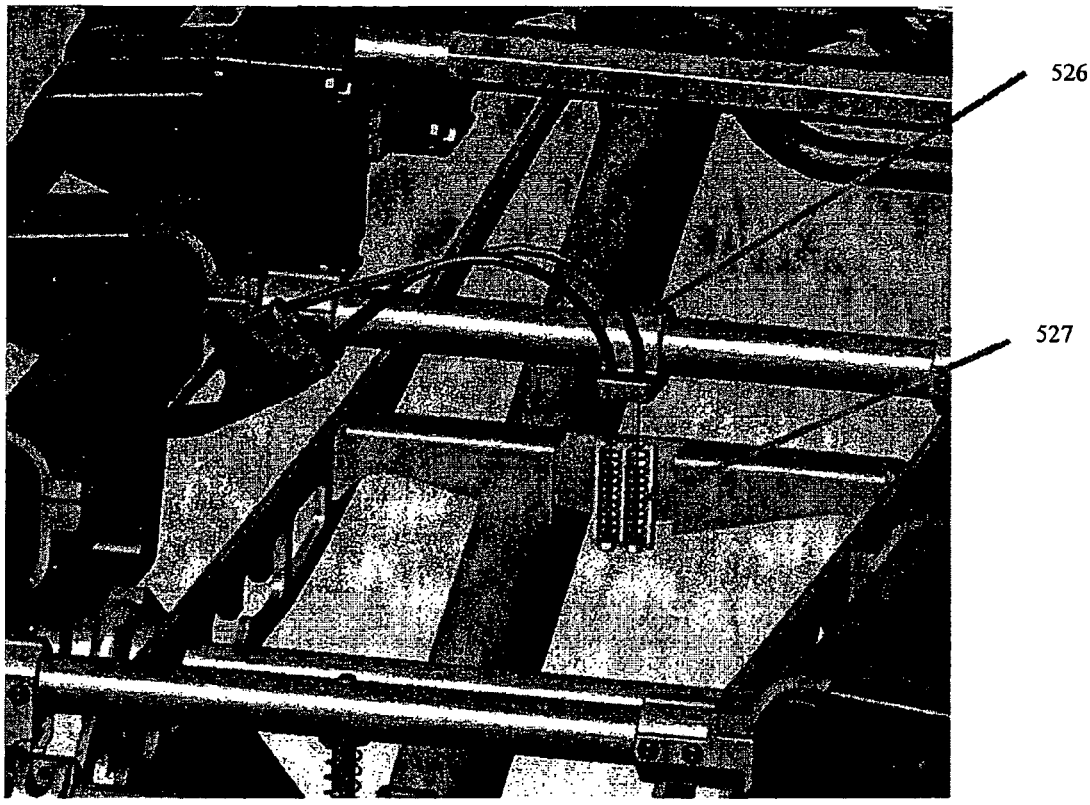
FIG. 29 shows components of a ladder rail assembly in one embodiment of the invention.

As shown in FIGS. 11 and 16, in addition to attaching to the slider housing 75 attached to the top frame 74, the notched ladder rail assembly is pivotally connected to a head end cross tube 81, and comprises a foot end notched ladder rail stiffener 511 and a more centrally located notched ladder rail stiffener 514 (e.g., shown in FIG. 13). In some embodiments, the foot end notched ladder rail stiffener 511 fastened to each notched ladder rail 510 is fastened to a foot end cross tube 79 via a notched ladder guide rod 512 that itself is attached to the foot end notched ladder rail stiffener 511 via a guide bearing 513. In some embodiments, a down spring 524 (e.g., as shown in FIG. 28) surrounds the ladder guide rod 512 and assists ladder rail assembly engagement when a handle 518 or 516 is released. In some embodiments, the lift spring module 515 (e.g., shown in FIG. 12) comprises lift springs 527 (e.g., as shown in FIG. 29). The lift springs 527 are retained under preload such that when handles 518 or 516 are activated (e.g., pulled), the lift force is greater than the sum of down force of front down spring 524 plus the ladder rails 510 weight. As shown in the figures (e.g., FIGS. 27, 28 and 30), angled teeth 529 prevent ladder rail 510 disengagement from ladder rod 520 when the cot is unsupported (e.g., when a release handle 518 or 516 is activated, the ladder lift springs 527 do not provide enough force to lift ladder rails 510 away from ladder rod 520 unless cot is supported at both ends (e.g., supported by multiple EMTs and/or supported by a surface (e.g., ambulance deck) on one end and a user of the cot (e.g., EMT) on the other end)).

Figure 30:
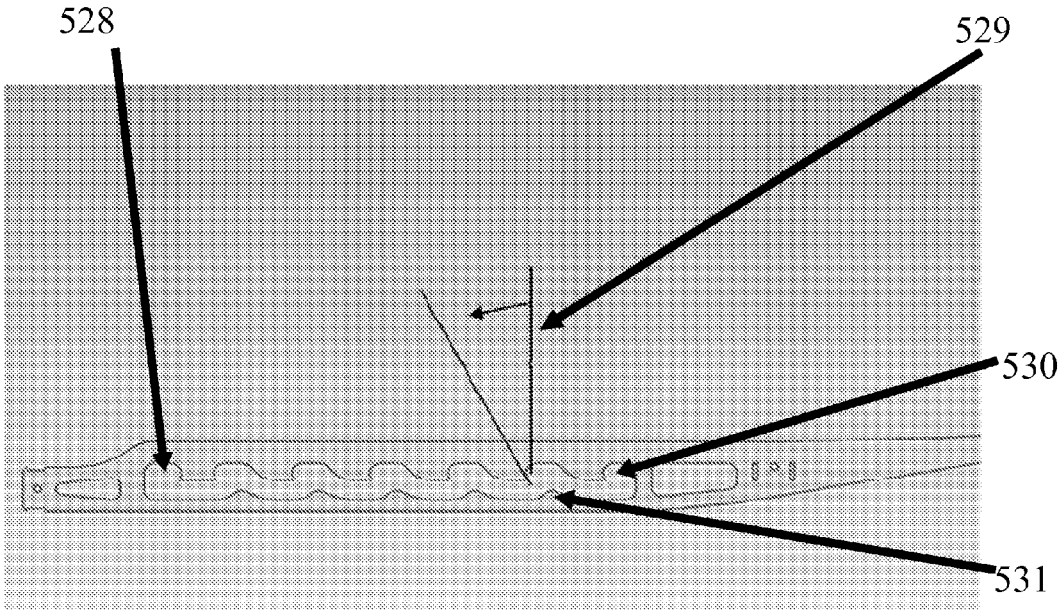
FIG. 30 shows a ladder rail in one embodiment of the invention.
Figure 31:
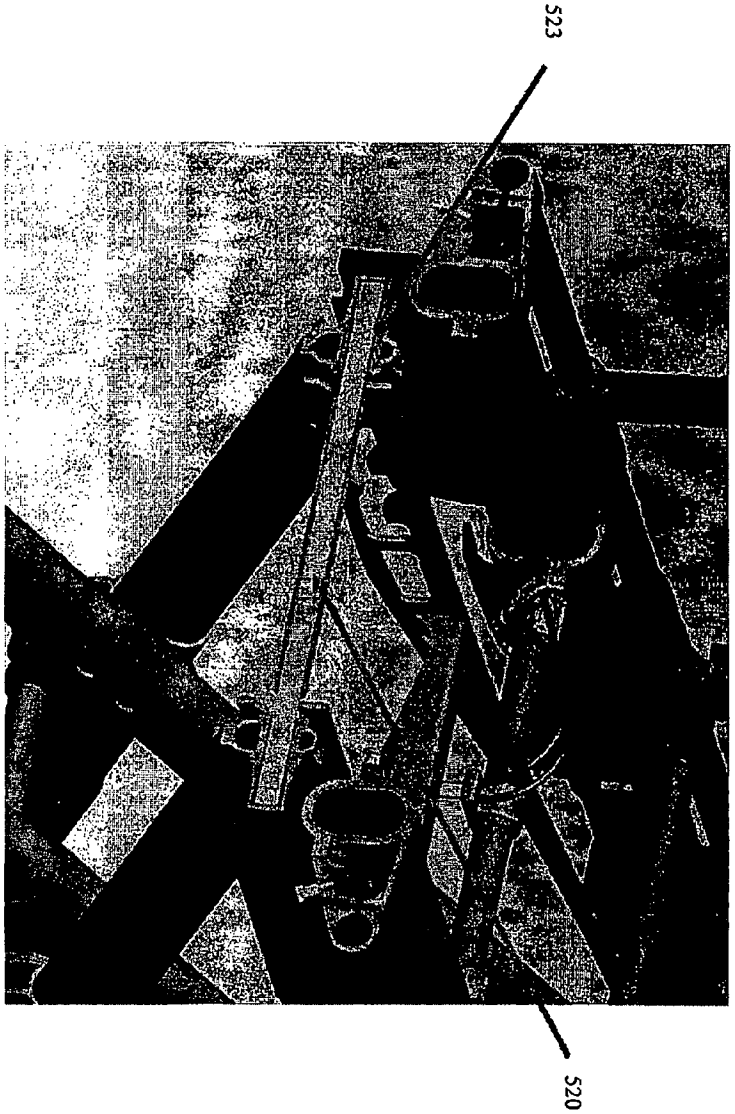
FIG. 31 shows a cross sectional view of a ladder rod, ladder rail assembly and cot in one embodiment of the invention.
Figure 32:
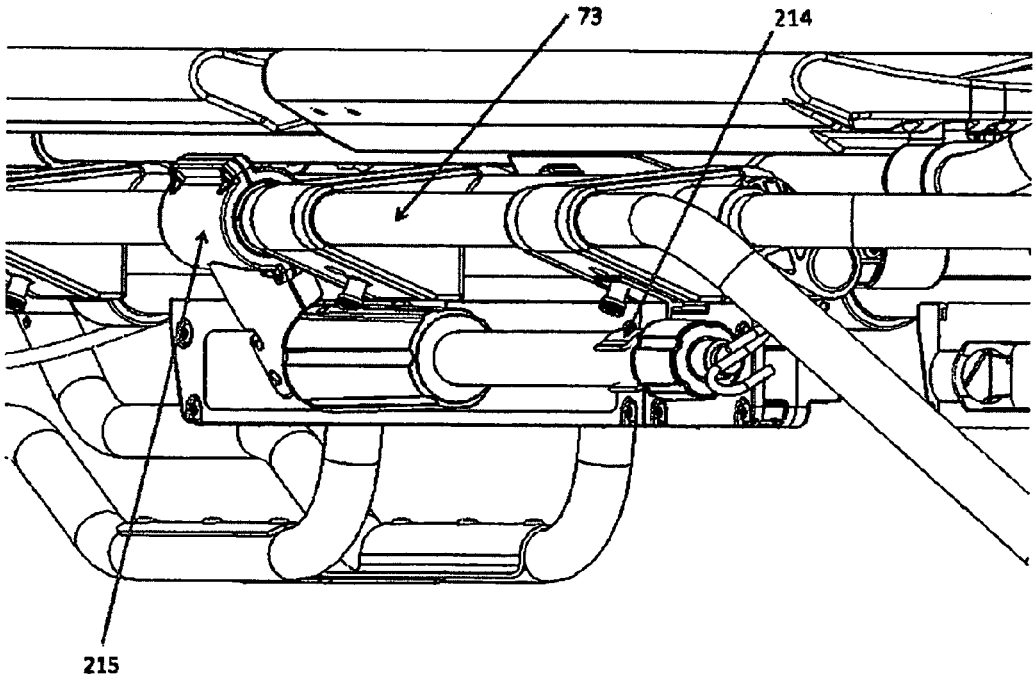
FIG. 32 shows a diagram of an intravenous (IV) pole in one embodiment of the invention.
Figure 33:
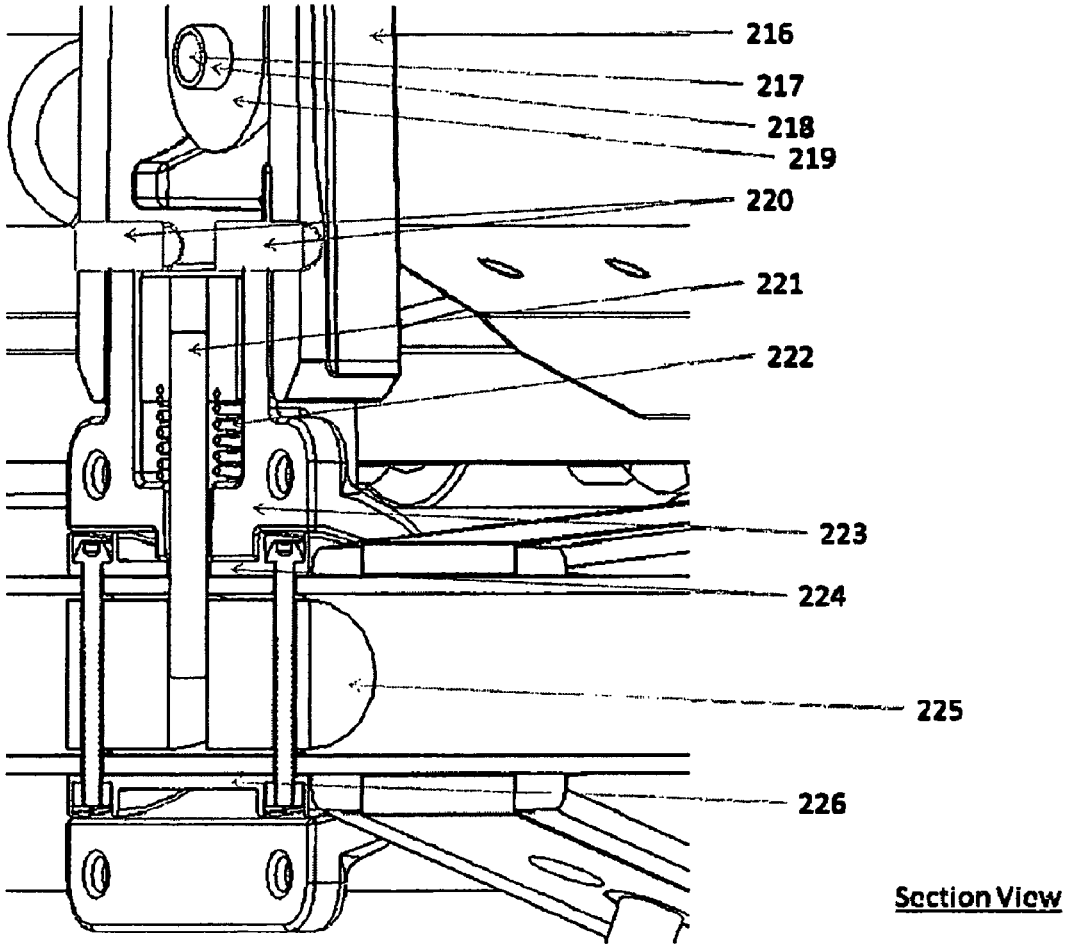
FIG. 33 shows a diagram of components of an IV pole in one embodiment of the invention.
Figure 34:
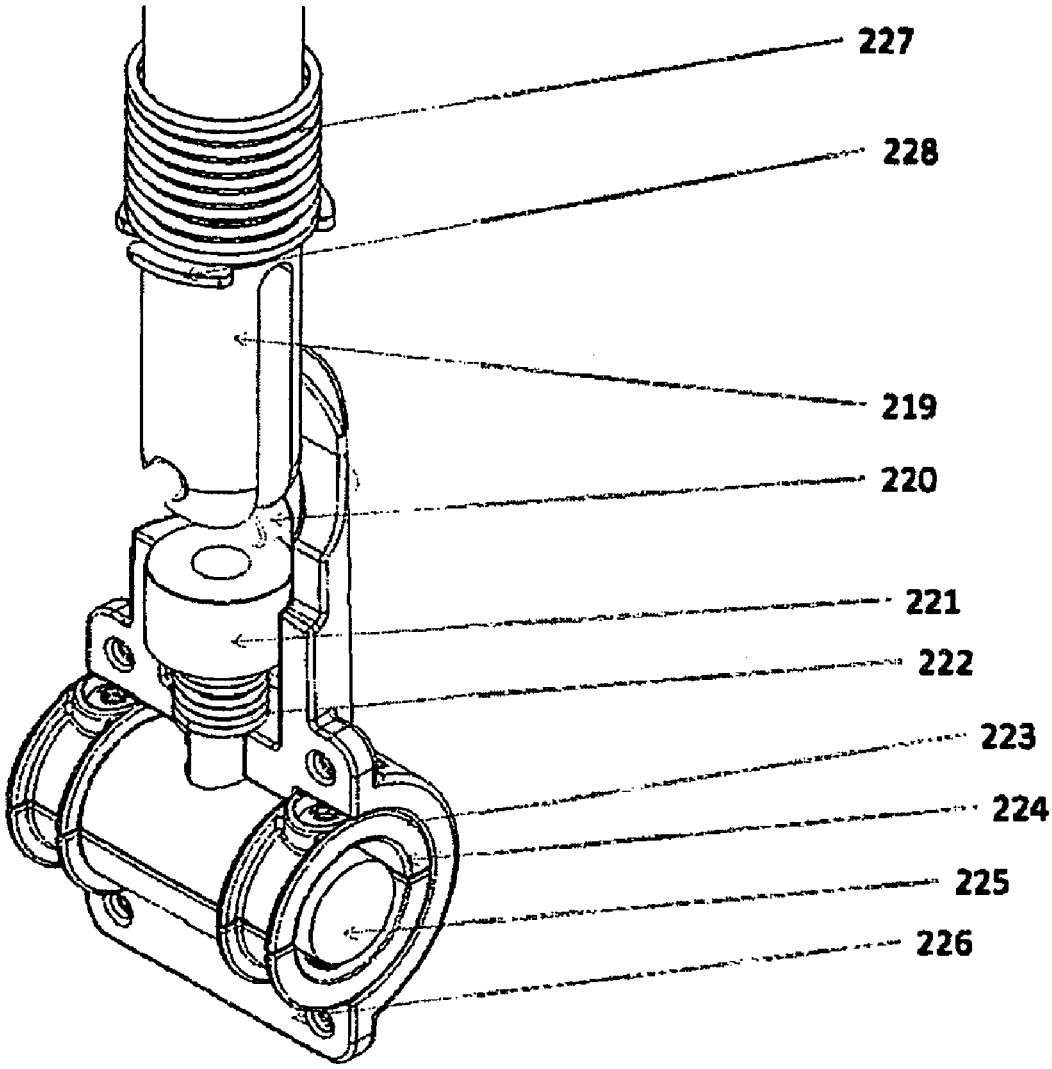
FIG. 34 shows a diagram of components of an IV pole in one embodiment of the invention, with the position grip not shown and only one pivot housing.
Figure 35:
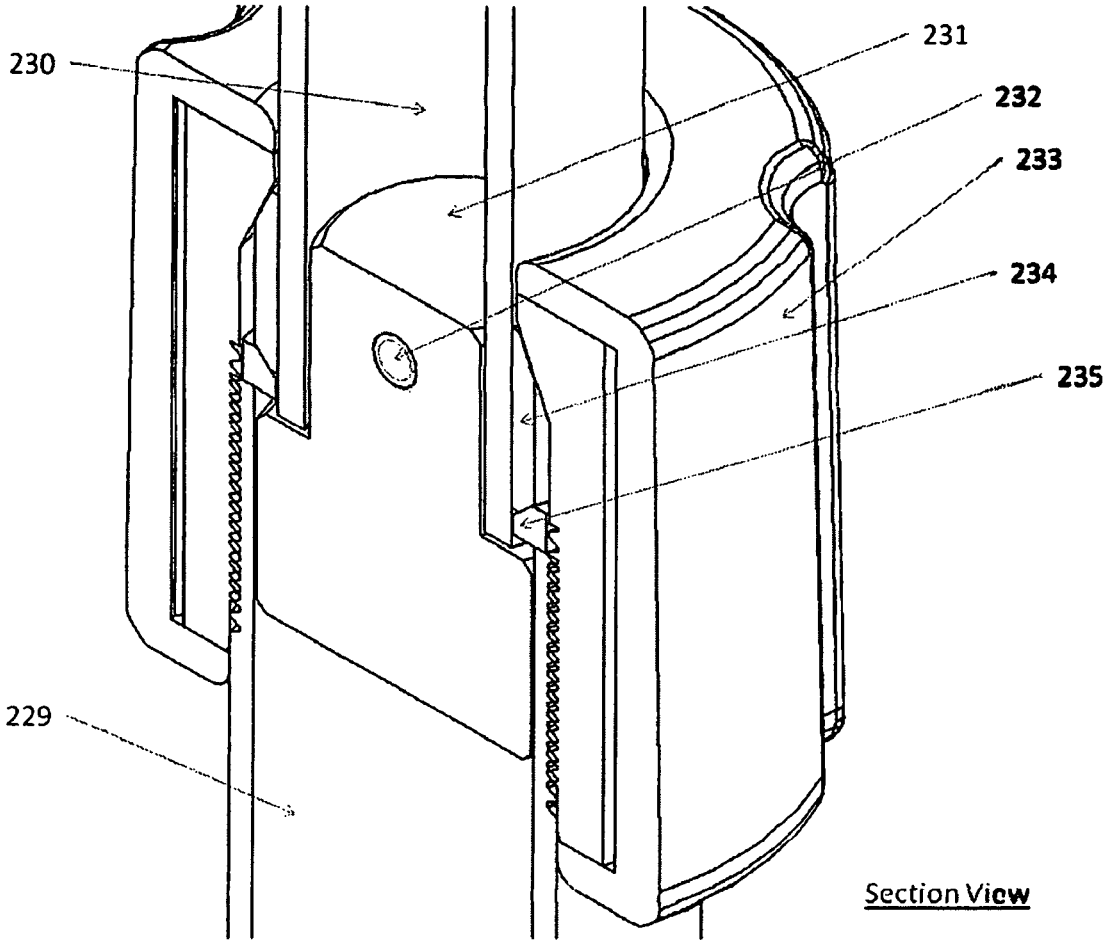
FIG. 35 shows a diagram of components of an IV pole in one embodiment of the invention.
Figure 36:
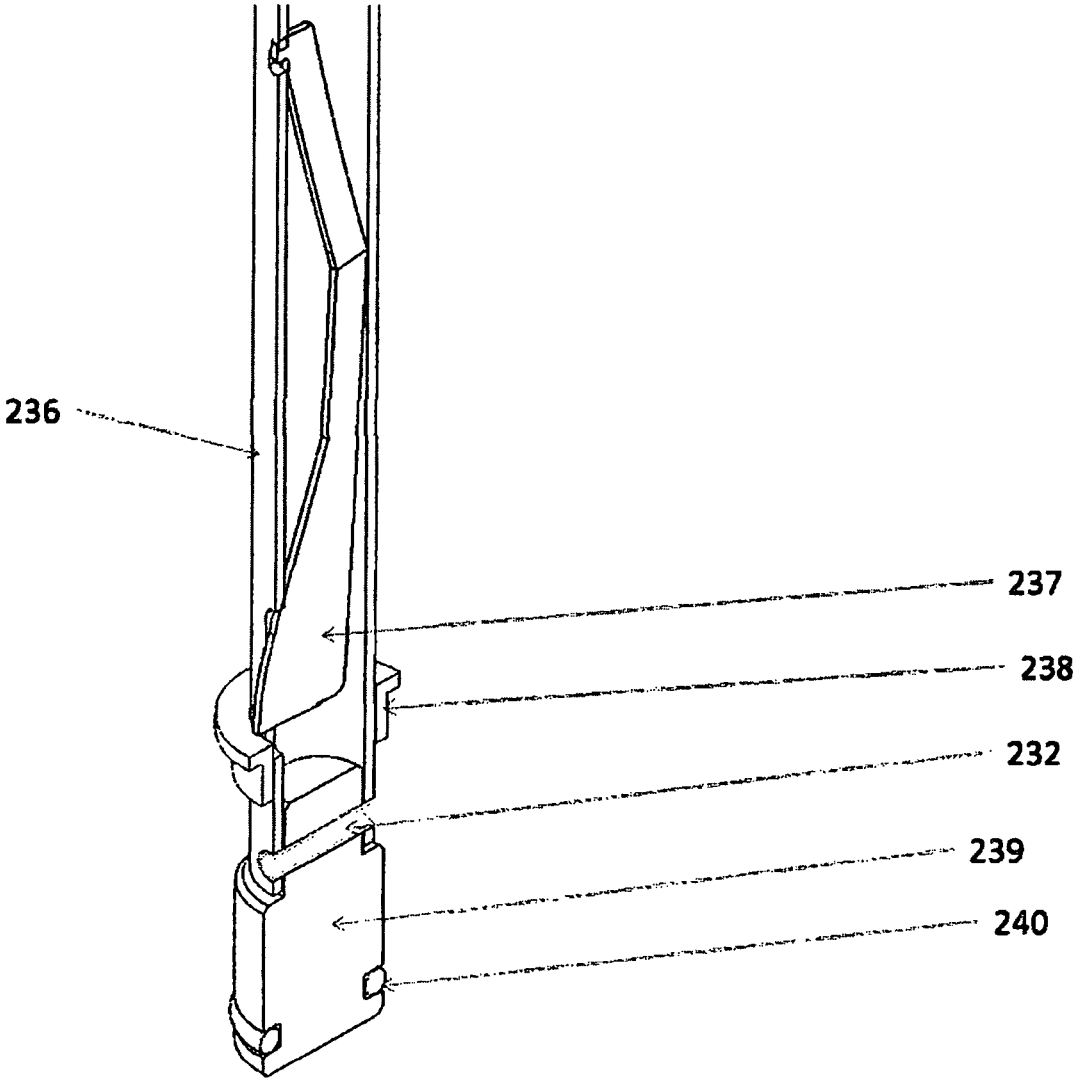
FIG. 36 shows a diagram of components of an IV pole in one embodiment of the invention, shown in a sectioned format without IV stage 2.
Figure 37:
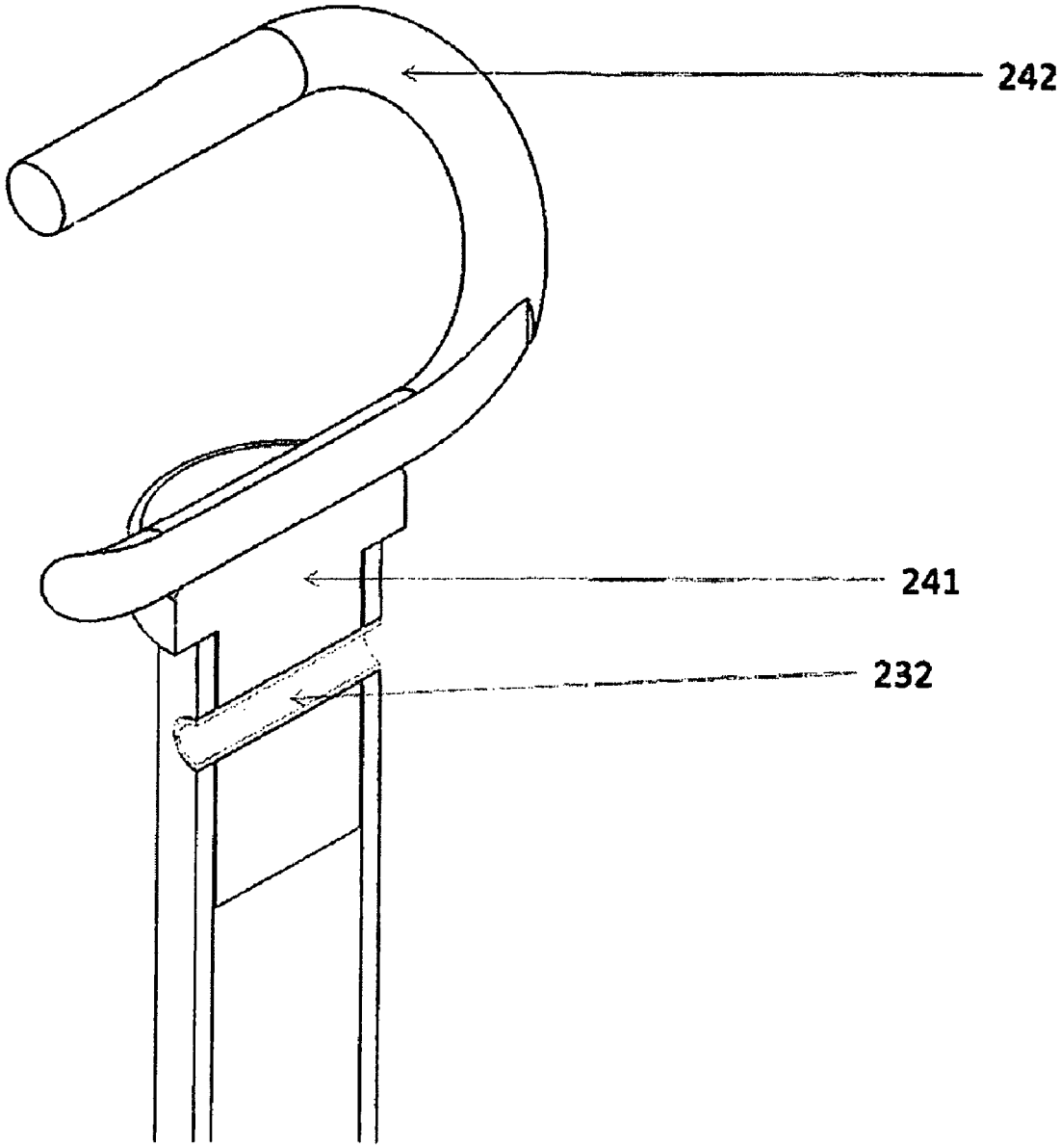
FIG. 37 shows a diagram of components of an IV pole in one embodiment of the invention.

In some embodiments, as shown in the figures, each ladder rail 510, comprises a plurality of orifices that serve a variety of purposes. For example, as shown in FIG. 12, a ladder rail 510 comprises a circular orifice 531 that pivotally attaches to a head end cross tube 81 (e.g., shown in FIG. 11). As shown in FIG. 30, in some embodiments, a ladder rail 510 comprises an orifice that comprises a plurality of angled teeth 529 and a plurality of notches 528, 530 (as well as unlabled notches residing between 528 and 530) on one side of the orifice, and a plurality of "ramps" 531 on the other side of the orifice. In some embodiments, the ramps 531 dynamically force the ladder rail 510 to jump into and/or onto the next notch if cot is dropped while unsupported (e.g., thereby precluding a hot-drop of a cot (e.g., supporting a subject) of the present invention). In some embodiments, bearings 523 (e.g., as shown in FIGS. 14 and 31) permit free spinning of ladder rod 520, thereby promoting engagement of the rod 520 into the ladder rails 510 (e.g., into a notch 528, 530 (as well as unlabled notches residing between 528 and 530) as shown in FIG. 30).

Configuration of a cot as described herein permits a user(s) to raise or lower a cot (e.g., supporting subject) without the worry of a rapid dropping of the cot from an elevated height (e.g., a hot-drop of the patient litter from an elevated height supported by the legs (e.g., that are supported by the base frame that is supported on a surface (e.g., the ground)) to a more fully collapsed position (e.g., completely collapsed (e.g., in an uncontrolled manner)). Such drops have been associated with serious injury of both subjects being transported by cots as well as subjects using cots (e.g., EMTs, firefighters, etc,) to transfer others.

Figure 2B:
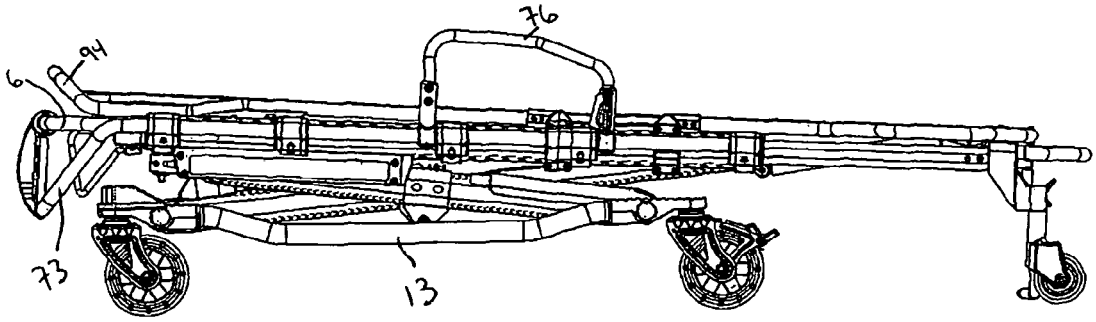

For example, a cot of the present invention can be raised or lowered (e.g., in order to raise or lower a subject supported by the cot). In some embodiments, a cot of the present invention is positioned into a raised position (e.g., as shown in FIGS. 1 and 2A) from a collapsed position (e.g., as shown in FIG. 2B) without activating (e.g., pulling) a release handle 518 or 516 (e.g., shown in FIG. 11). For example, as the cot is lifted, the ladder rail assembly comprising ladder rails 510, under its own weight and the force of the down spring 524 encompassing the ladder guide rod 512, allows the ladder rod 520 to roll and/or slide along ramped bottom side of the rail profile (e.g., shown in FIG. 30), permitting engagement of the ladder rod 520 into a desired notch (e.g., at a desired height). This in turn permits the bearing holders 522 and ladder rod 520 to move along the lower side of the litter and the positioning of the leg assemblies into a more expanded, higher position. Under these circumstances, the base frame and wheels (e.g., under their own weight) remain in contact with the surface upon which the cot resides (e.g., the ground) as the litter (e.g., comprising a patient) is lifted (e.g., by one or more users of the cot pulling upward on the team lift rail 73), unless the base frame is lifted or otherwise caused to be elevated together with the litter (e.g., by the force of an object pushing upward on the base).

In some embodiments, the configuration of a cot of the present invention prevents accidental disengagement of the ladder rail assembly (e.g., of an unsupported cot (e.g., a cot that is not supported by forces other than components of the cot (e.g., by one or a plurality of users of the cot and/or an ambulance deck))). For example, if either of the release handles 518 or 516 (e.g., shown in FIG. 11) are activated (e.g., pulled) without the cot being supported (e.g., the ends of the cot being supported by one or a plurality of users and/or an ambulance deck), the lift spring(s) 527 are compressed, thereby providing a lifting force to disengage the ladder rod 520 from the rails 510. However, the force of the ladder rails 510 onto the ladder rod 520 under the load weight of the litter (e.g., supporting a subject), due to the angled teeth 529 is greater than the force of the compressed lift springs 527 and therefore the ladder rails 510 remain engaged to the ladder rod 520 (e.g., thereby precluding an accidental disengagement of the rails 510 from the rod 520 and a rapid falling of the patient litter (e.g., supporting a subject (e.g., a hot-drop)).

In some embodiments, a cot of the present invention can be positioned into a lower and/or collapsed position (e.g., as shown in FIG. 2B) from a raised position (e.g., as shown in FIGS. 1 and 2A). For example, if both ends of the cot are supported (e.g., lifted and/or held by one or a plurality of users of the cot and/or by an ambulance deck), activation (e.g., pulling) of a release handle 518 or 516 (e.g., shown in FIG. 11) results in the ladder rails 510 disengaging from the notched side of the orifice of the rail 510 (e.g., shown in FIGS. 28-30). The ladder rod 520 moves (e.g., rolls freely) along the ramps 530 of the opposite side of the rail 510 orifice until a handle 518 or 516 is released or until the cot is in its lowest position (e.g., until the rod 520 reaches the end of the orifice at which notch 528 resides. As the rod 520 passes over each ramp 530, the lift springs 527 are compressed and decompressed (e.g., over each ramp 530) until the handle 518 or 516 is released and the rod 520 snaps into a notch (e.g., a notch pair (e.g., a notch on a first rail 510 and the corresponding notch on a second rail 510 of the ladder rail assembly.

Thus, as described herein, in some embodiments, a ladder rail assembly of a cot of the present invention acts within a vertical plane (e.g., the plane of gravity). Thus, in some embodiments, a cot of the present invention provides a ladder rail assembly that benefits from the earth's gravitational force (e.g., gravity assists engagement of the ladder rod into a notch or pair of notches within a ladder rail assembly of the present invention (e.g., precluding a rapid, uncontrolled lowering (e.g., hot dropping) of the patient litter)). Thus, in contrast to conventional cots that utilize a ladder system that acts in a horizontal plane (e.g., wherein gravity does not assist rail engagement), a cot of the present invention provides the advantage of having a force responsible for rapid, uncontrolled lowering of a patient litter (e.g., hot-dropping) in conventional cots actually assist the anti-hot drop safety feature of a cot of the present invention. This safety feature provides significant safety benefits (e.g., not present in conventional cots) to both a use of the cot (e.g., an EMT) as well as to a subject transported on a cot.

Thus, in some embodiments, under conditions of repositioning the cot to a lower position that occur with one of the handles pulled and a deliberate, controlled motion (e.g., at a safe (e.g., slow) speed), the cot is positioned to a desired height by users of the cot. However, if a cot (e.g., supporting a subject) is accidently dropped (e.g., from either end or both ends (e.g., from a position above the lowest, fully collapsed position)), as the ladder rod 520 passes over the ramps 530 on the opposite side of the ladder rail orifice (e.g., see FIG. 30), the ladder rod 520 is forced (e.g., by the elevating force generated by the rod 520 launching off the ramp 530) into the next notch down, thereby minimizing the distance and duration of fall (e.g., reducing and/or eliminating the ability of the cot to hot-drop to a fully collapsed position. Thus, in some embodiments, a cot of the present invention provides an anti-hot drop safety feature for subjects transported by a cot described herein as well as for users of a cot described herein (e.g., who risk serious finger, hand, foot and other injuries). For example, other cots fail to provide a means to dynamically re-engage a ladder rail during an unsupported fall, often times leading to serious injury of a subject transported by the cot as well as to a user of the cot (e.g., others cots (e.g., comprising a notched side of a one-sided ladder profile and return engagement springs) are routinely susceptible to dynamic jumping of the ladder all the way down to a fully collapsed position (e.g., to a hot-drop)).

Figure 15:
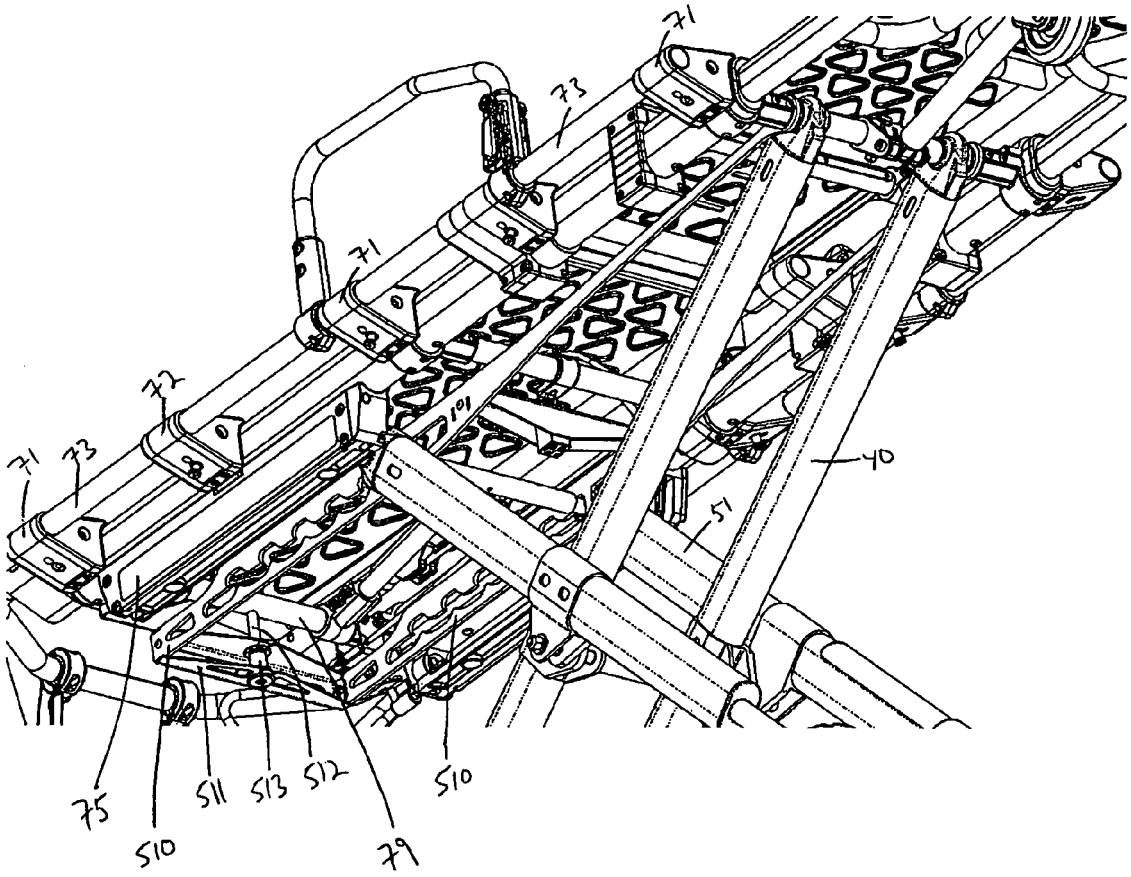
FIG. 15 shows components of a foot end notched ladder rail stiffener in one embodiment of the invention.

FIGS. 11 and 15 illustrates that, in some embodiments, the top frame 74 comprises a foot-end cross tube 79, a middle region cross tube 80 and a head-end cross tube 81, wherein the cross tubes 79, 80, 81 are fastened to cross tube castings 71 that are fastened to the top frame 74. The top frame 74 fastens to a team lift rail 73 via cross tube castings 71 and team lift mount extrusions 72 that comprise an orifice into and/or through which the team lift rail 73 extends. The team lift rail 73 surrounds the foot end region and both sides of the top frame 74. In some embodiments, the foot end portion of the team lift rail 73 provides a location for attachment of additional components (e.g., a control panel (e.g., user interface) for use with a tip angle monitoring, recording and alert system described herein)). In some embodiments, a foot end rail/lift handle 6 is attached to the foot end of the top frame 74.

In some embodiments, various components attach to the top frame 74. For example, the top frame 74 attaches to a telescoping load rail assembly comprising wheels (e.g., utilized for rolling the cot out of and into an ambulance deck). As shown in FIGS. 18-22, in some embodiments, the wheels 188 of a telescoping load rail assembly are pivotably attached to the load wheel forks 191 which are fastened to the load wheel casting 185. The load wheel castings are attached to the load rail 184 via fasteners 197. The load rail bushings 203 attached to the load rail 184 provide a hard stop against a cap on the top frame fastened to the end of the main rail 74, to prevent the load rail assembly from being pulled completely out.

Figure 19:
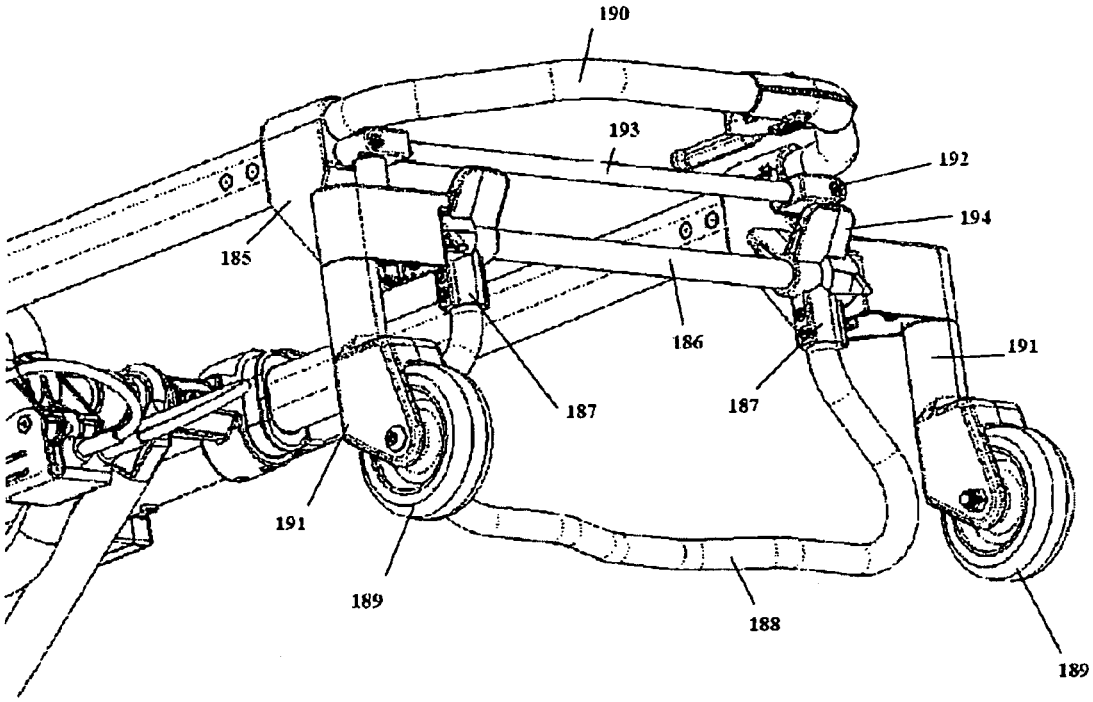
FIG. 19 shows components of a telescoping load rail assembly in one embodiment of the invention.
Figure 20:
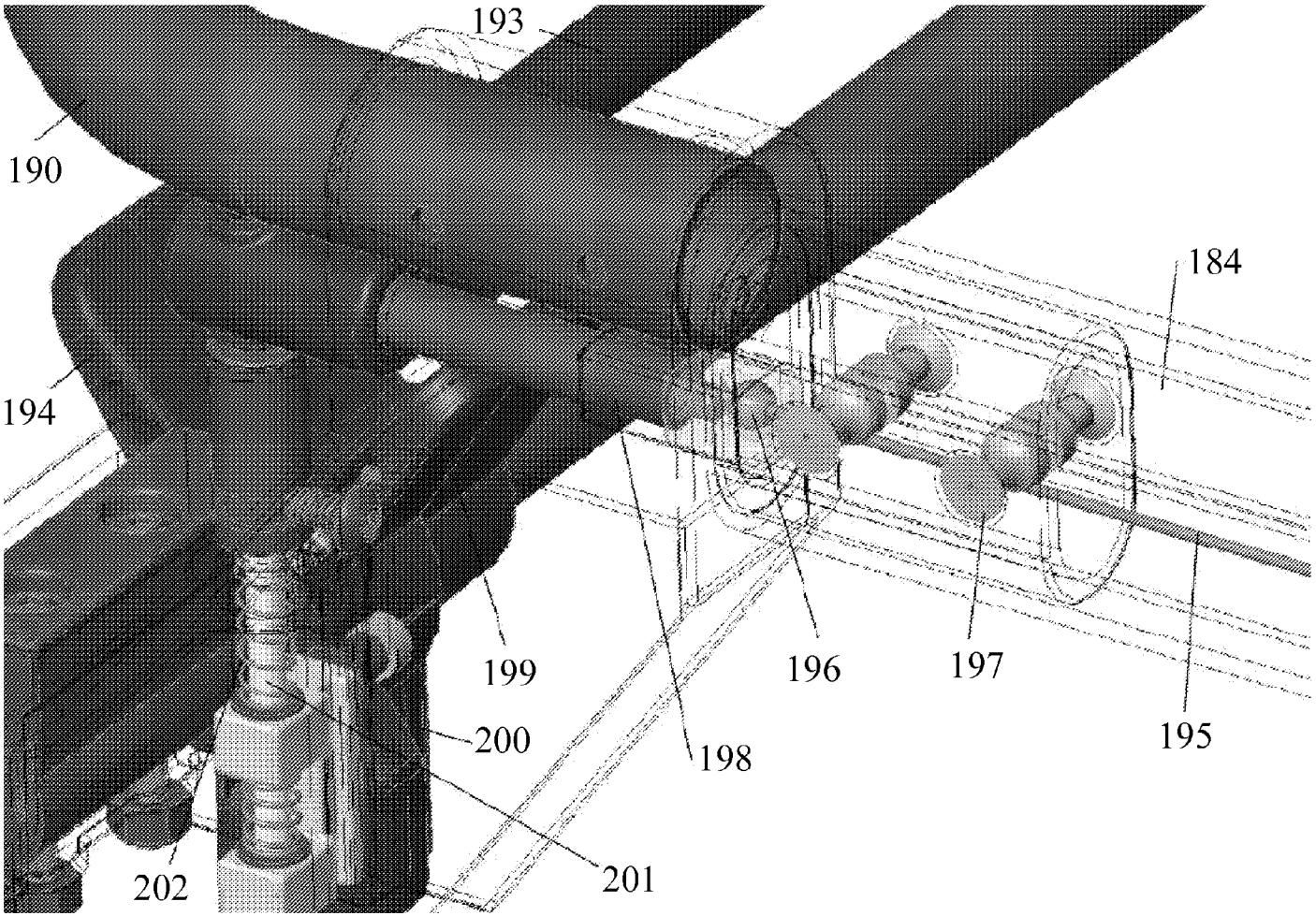
FIG. 20 shows components of a telescoping load rail assembly in one embodiment of the invention.
Figure 21:
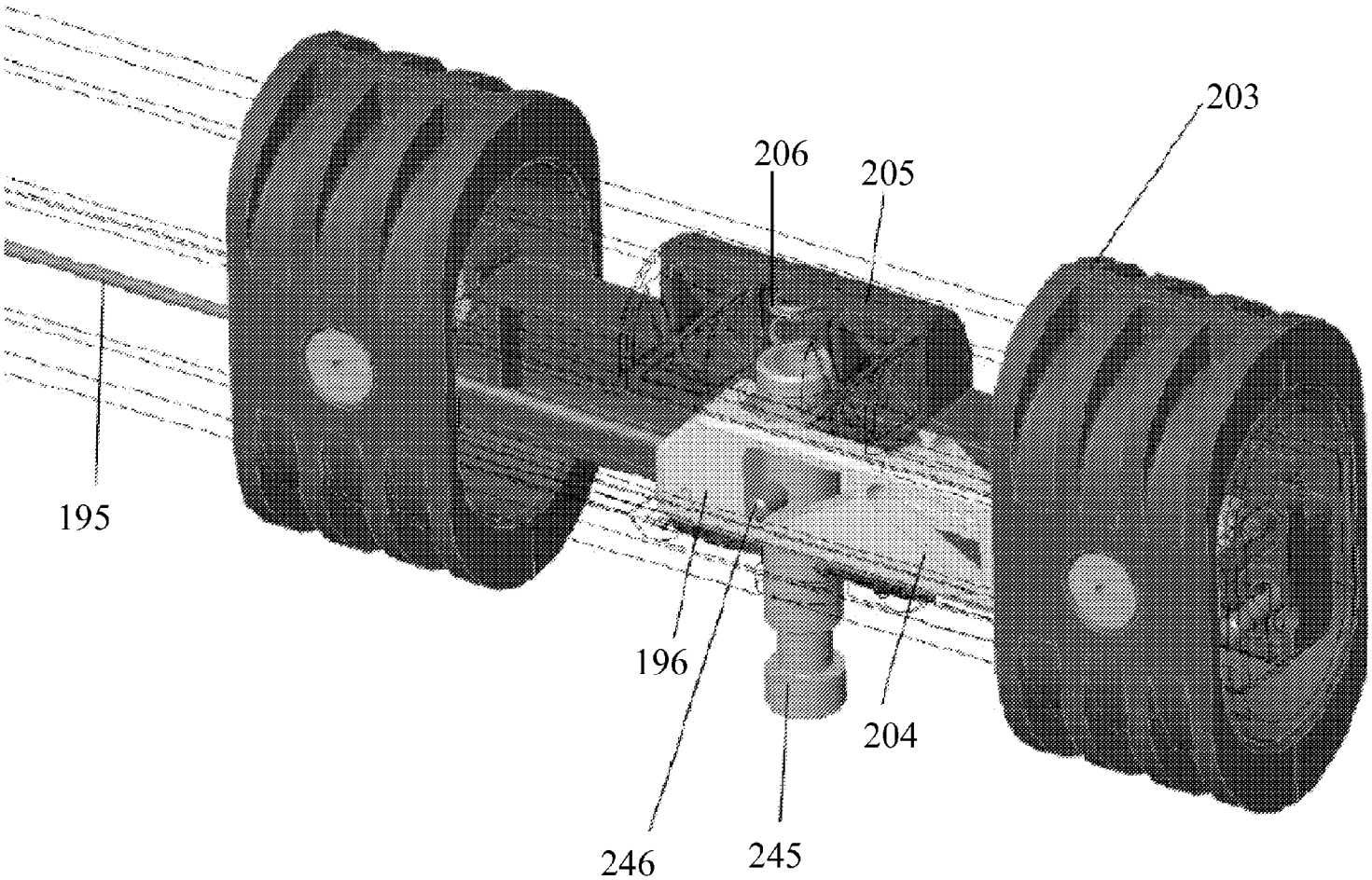
FIG. 21 shows components of a telescoping load rail assembly in one embodiment of the invention.

As shown in FIGS. 19 and 20, the load rail assembly is extended or retracted by pulling back on a release rod 193. The release rod 193 is attached to load release connectors 192. The release connectors 192 are attached to a release nut. A load release bushing 198 provides a bearing surface against the load wheel casting 185 for the load rail release mechanism as it slides within the bore of the load rail. The load release bushing 198 also acts as a spacer positioning a load release nut that is attached via a socket head screw at the appropriate distance from the load release rod 193. The release nut also provides a pocket into which a cable stop 196 can be placed. The cable stop 196 is attached to cable 195. The opposite end of the cable 195 has a similar cable stop 196 which is contained between two mating detent slides 204. When the release rod 193 is pulled, the cable 195 translates that motion to the detent slides 204, driving up the spring loaded detent plunger 245 as the detent plunger pin 246 rides up the ramped surface of the detent slide 204. The release nut bottoms out in a pocket of the load wheel casting 185 to provide a travel stop.

In some embodiments, the telescoping load-rail assembly is designed to shorten the overall length of the cot when being used in confined spaces (e.g., narrow hallways, small elevators, etc.). In some embodiments, the load-rail assembly is released by pulling back on a round tube (e.g., ½" round tube) 193 that runs horizontally between the two load-wheel casting fork assemblies 191. This tube 193 is attached to a small connector assembly 192 at each end. These connector assemblies 192 run axially within the load-rails 184 and disengage, via cable assembly 195, a spring-loaded lock-pin assembly 201 mounted within each load-rail 184. The spring-loaded lock-pin assembly engages either of two holes placed within each of the outer main rails 74 of the litter assembly. One of these two holes provides the standard length position for the load-rails 184 and the other provides the shortened length. In some embodiments, more than two holes are placed in the outer main rails 74 in order to provide greater than two lengths at which the telescoping load rail assembly may be positioned. In some embodiments, the telescoping load-rail assembly also features a system whereby properly securing the cot in a mount system prevents unintentional disengagement of a spring-loaded lock-pin assembly while the cot is secured within an ambulance. For example, the pin 201 is used to lock-out the telescoping rail release rod 193 when in ambulance. The catch bar pivots 187 attached to the catch bar 188 rotate pivotally about load rail cross tube 186 when properly secured in an ambulance. The catch bar pivots 187 push up the spring loaded pin assembly 201. The pin 201 engages a pocket in the release connector assemblies 192 and prevents the rod 193 from being pulled.

Figure 24:
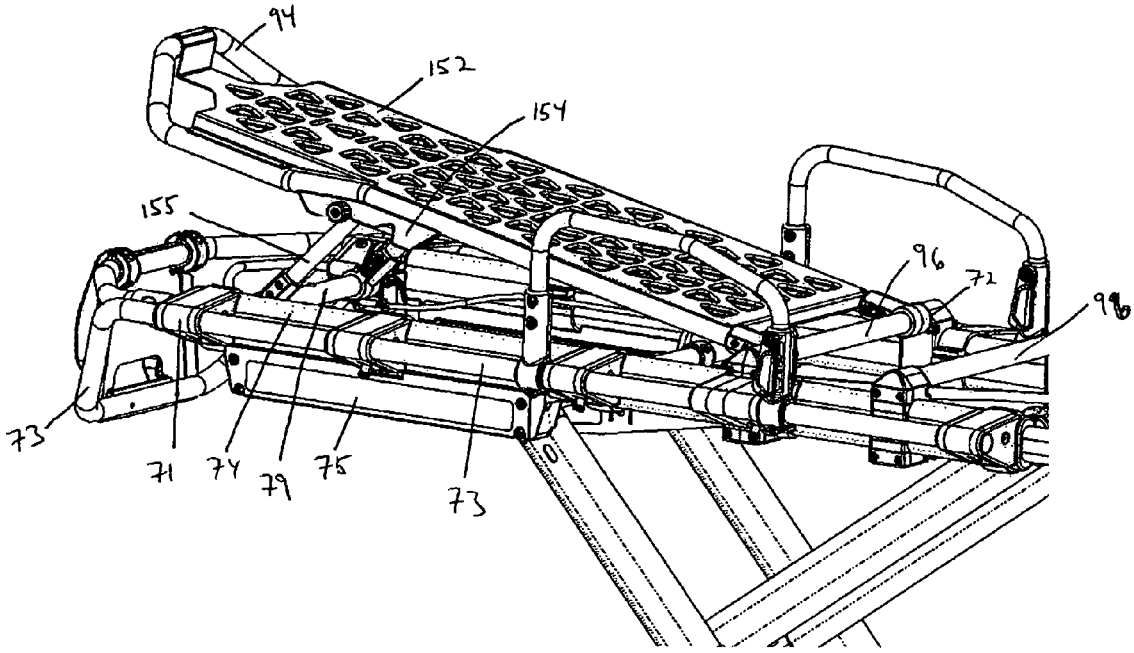
FIG. 24 shows components of a cot in a raised leg litter configuration in one embodiment of the invention.
Figure 25:
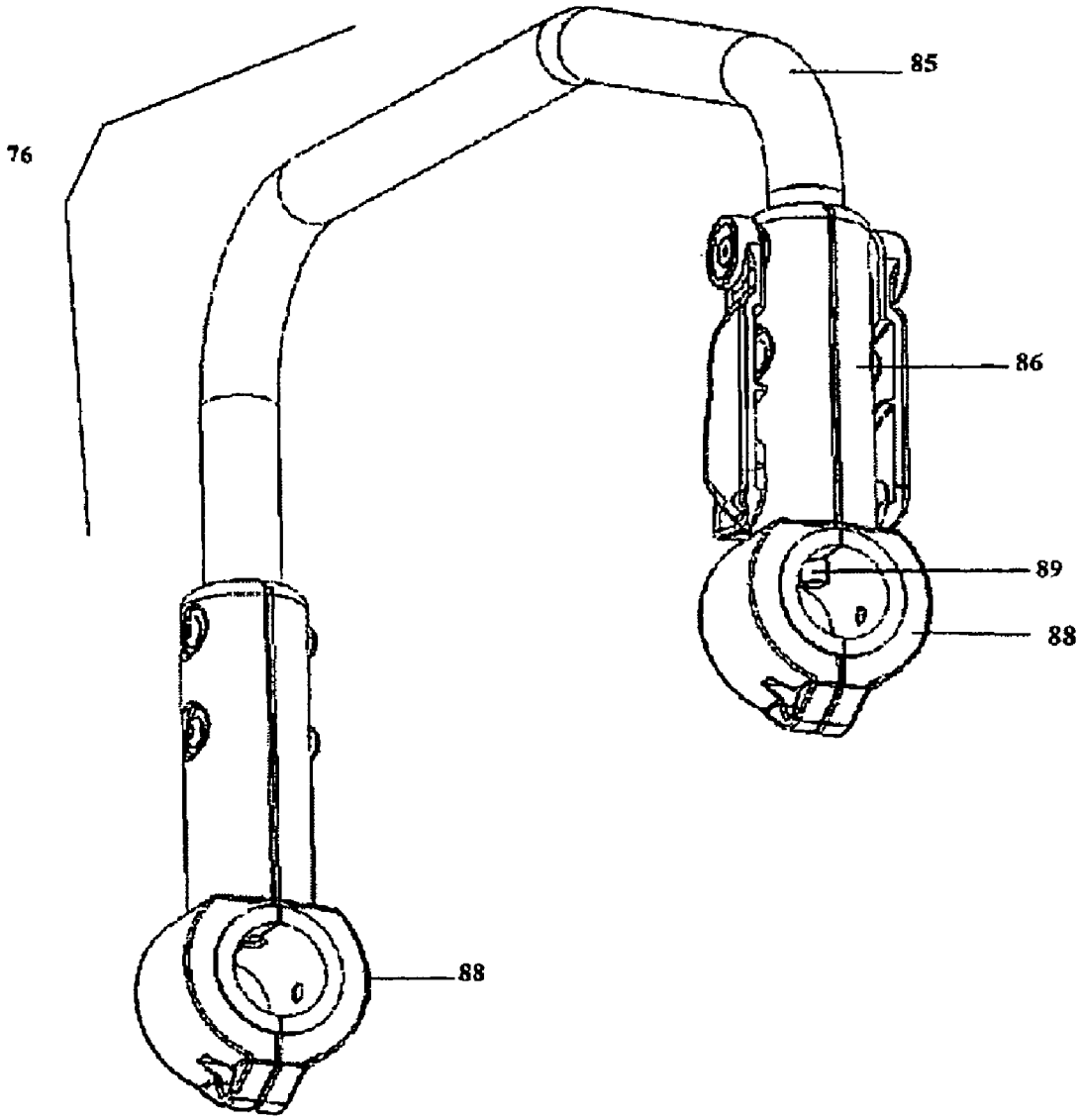
FIG. 25 shows a side rail in one embodiment of the invention.
Figure 26:
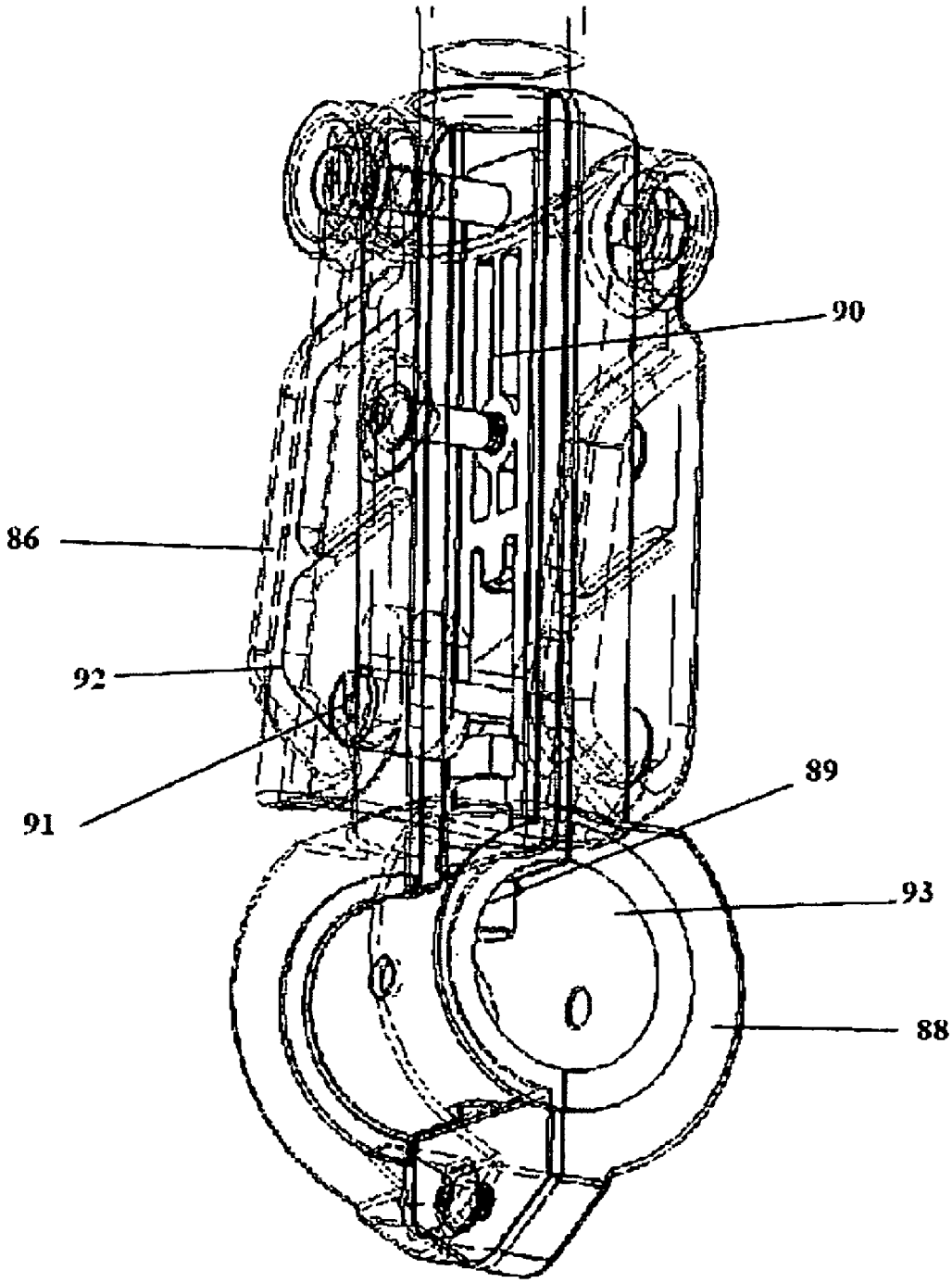
FIG. 26 shows components of a side rail in one embodiments of the invention.
Figure 27:
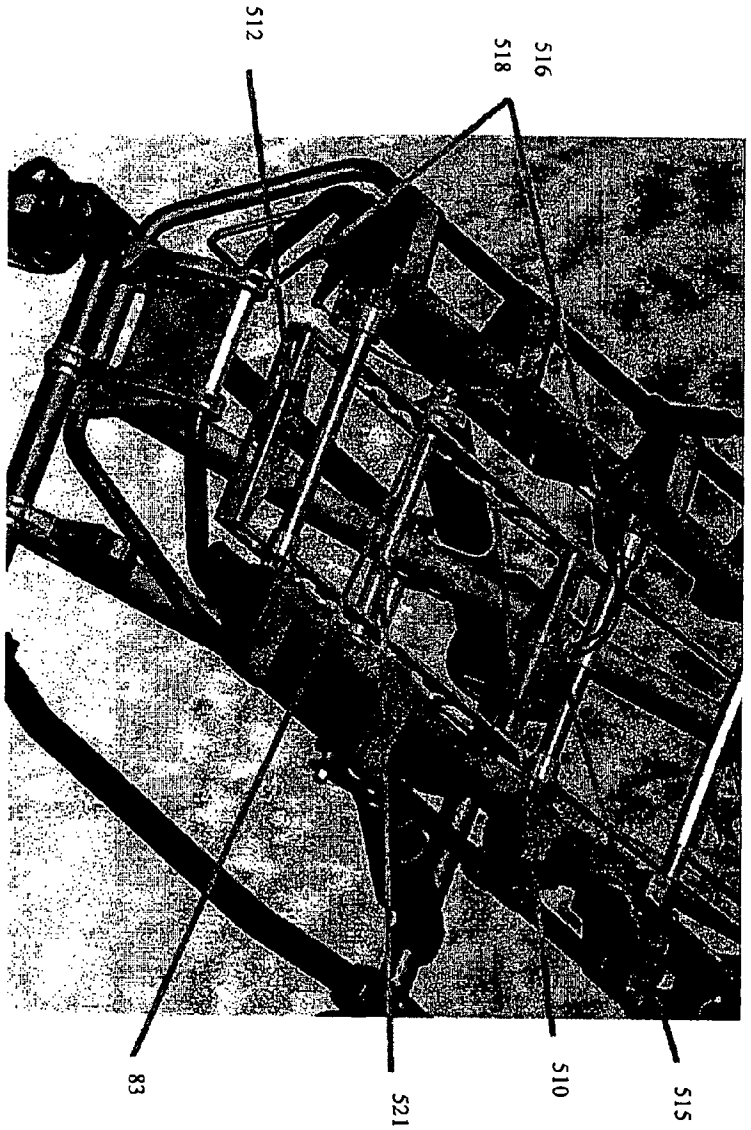
FIG. 27 shows components of a ladder rail assembly in one embodiment of the invention.

Components utilized to attach a patient litter to the top frame 74 also attach to the top frame 74. For example, as shown in FIG. 24, a litter leg tube 94 pivotally attaches to a seat pivot tube 96 attached to team lift mount extrusion 72 attached to the top frame 74 between the middle-region cross tube castings and the head-end cross tube castings. In some embodiments, a second pivot tube 96 attaches to litter pivots attached to the top frame 74. The head/upper torso litter pivotally connects to the second seat pivot tube. Fasteners can be utilized to attach one or more litter components (e.g., a seat/lower torso litter) to pivot tubes.

In some embodiments, a patient litter (e.g., shown in FIG. 2A) of the present invention comprises a three section patient litter comprising a leg/thigh litter 152, a seat/lower torso litter 161, and a head/upper torso litter 164. In some embodiments, a patient litter of the invention comprises a four section litter comprising a leg litter, a thigh litter, a seat/lower torso litter, and a head/upper torso litter. In some embodiments, the patient litter comprises a two section litter comprising a lower torso and upper torso litter. In some embodiment, the patient litter comprises no sections. In some embodiments, the litter is made of roto-molded plastic. In some embodiments, litter components are stamped aluminum (e.g., to reduce weight of the cot). The litter may be made of any of a variety of materials including, but not limited to, rubber or other type of composite material. In some embodiments, the stamped aluminum and/or roto-molded and/or blow-molded patient litter of the present invention provides superior cleanability compared to other litters. In some embodiments, a litter comprises tapered ends for maximum safety for a subject transported on the litter (e.g., the ends function to keep a subject centered on the litter, as well as provide additional space for a user of the cot to access the team lift rail 73 (e.g., shown in FIG. 2A)).

The present invention is not limited by the type of cot mattress utilized with a cot system of the invention. Indeed, a variety of cot mattresses find immediate use with a cot system described herein. Similarly, future cot mattresses may be designed specifically for use with a cot system described herein. In some embodiments, mattress design conforms to the unique design of the attachment point position of a shoulder strap harness of the present invention. In some embodiments, a cot mattress is constructed of a puncture resistant and/or rip resistant material (e.g., pliable vinyl or similar material). In some embodiments, a cot mattress is heat sealed (e.g., for maximum durability and cross-contamination prevention). In some embodiments, a cot mattress is constructed of an impervious, non-porous material (e.g. that is easy to clean and/or that comprises anti-microbial properties). In some embodiments, a cot mattress comprises built-in articulation seams (e.g., for maximum performance (e.g., around the knee gatch and torso joint areas)). In some embodiments, a cot mattress comprises recessed indentions for allowing a user to easily secure fasteners around the mattress (e.g., for attachment to the molded litter). In some embodiments, hook and loop fasteners (e.g., 3M DUO-LOCK fasteners) are utilized (e.g., with or without industrial grade adhesive) to attach a mattress to the blow-molded patient litter. In some embodiments, a cot mattress comprises a two-tone color pattern (e.g., for increased visibility and/or patient alignment upon the mattress). In some embodiments, a cot mattress comprises a padded flap on the head-end (e.g., to cover an oxygen bottle holder present at the head-end of the cot (e.g., for increased patient safety and/or comfort)). In some embodiments, a cot mattress comprises a visoelastic foam (e.g., TEMPERPEDIC mattress) or other type of memory foam. In some embodiments, a cot mattress comprises a neck roll head support. In some embodiments, a cot mattress is temperature controlled (e.g., utilizing the cot battery power and/or another power source). In some embodiments, temperature control includes both warming as well as cooling functionality (e.g., to warm (e.g., for hypothermia) and/or cool (e.g., heart condition, heat exhaustion, spinal injury, etc.) subjects residing on the cot). The present invention is not limited by the manner in which a cot mattress is heated or cooled. In some embodiments, a temperature controlled cot mattress utilizes heat consolidating beads. In some embodiments, a temperature controlled cot mattress utilizes heated and/or cooled water from an external source. In some embodiments, a temperature controlled cot mattress is reusable and/or disposable. In some embodiments, a disposable cot mattress is heated and/or cooled using similar chemical reactions found in a hot pack and or cold pack. In some embodiments, a temperature controlled cot mattress is stored flat on the cot and/or is rolled like a sleeping bag for easy storage and deployment. In some embodiments, a cot mattress comprises a design similar to that of a roller bearing warehouse shipping table (e.g., that assists in moving a subject off of the cot (e.g., onto an emergency room table or hospital bed).

In some embodiments, a cot of the present invention comprises side rails 76 (e.g., shown in FIGS. 1, 2A, 25 and 26). In some embodiments, the side rails 76 are pivotably attached to the team lift rail 73 via side rail pivots 88. Side rail bearings 93 are located within the side rail pivot 88 to reduce friction and wear. The side rails 76 are locked in position by a spring plunger assembly 89. The spring plunger assembly 89 mounts within two mating rail lock housings 90 located within the side rail tube 85. The spring plunger 89 is mated with a spring block 91. The spring block 91 slides along a ramped surface on a side rail handle 92 which is pivotably attached to the side rail tube 85. As this side rail handle 92 is rotated, the pin block 91 slides along the ramped surface, lifting the spring plunger assembly 89 pin thereby disengaging it from a hole located in the team lift rail 73 allowing the side rail 76 to be rotated to the desired position. In some embodiments, there are a plurality of holes in the team lift rail 73 into which the plunger assembly 89 pin can engage. In some embodiments, the patient side rails extend out sideways (e.g., to accommodate a subject that does not fit within the confines of rails not extended out sideways).

In some embodiments, a cot of the present invention comprises a system that provides energy to retract the leg assemblies described herein (e.g., from a raised position to a retracted and/or collapsed position (e.g., when a cot described herein is loaded into an ambulance)). The present invention is not limited by the type of system utilized to provide energy to retract the legs. In some embodiments, the system comprises the ability to store mechanical energy, and the stored mechanical energy is utilized to retract the legs. In some embodiments, the system comprises an air pressurized cylinder. In some embodiments, the system comprises fluid and fluid valves. In some embodiments, the system does not utilize electrical energy (e.g., from a direct current or alternating current source) for retraction of the legs. In some embodiments, the system utilizes electrical energy (e.g., from a direct current or alternating current source) for retraction of the legs.

In some embodiments, a cot system of the present invention comprises a patient restraint system. In some embodiments, the patient restraint system comprises a lower leg restraint, lap restraint, and/or upper torso/shoulder restraint. In some embodiments, the restraint system comprises restraint attachment points (e.g., present on team lift mount extrusions). In some embodiments the restraint attachment point is a shoulder bolt fastened to the team lift mount extrusion. In some embodiments, the restraints have a quick clip and/or snap clip belt end (e.g., similar to those used in automobile racing) that attach to the shoulder bolt (e.g., thereby providing for quick removal). In some embodiments, restraints may comprise an antimicrobial substance and/or an impervious material (e.g., that inhibits and/or reduces absorption of bodily fluids (e.g., blood)). In some embodiments, a restraint system of the present invention comprises a sensor and/or alert system (e.g., added to a female or male belt attachment point (e.g., that provides a warning tone when a subject is not strapped in (e.g., prior to and/or upon movement of an ambulance))). In some embodiments, a restraint strap comprises a male attachment point (e.g., so that if the attachment points on the cot line up across a subject's joint (e.g., knee, hip, etc.), the strap can attach to itself on the team lift handle (e.g., thereby avoiding strapping across the joint)).

Figure 38:
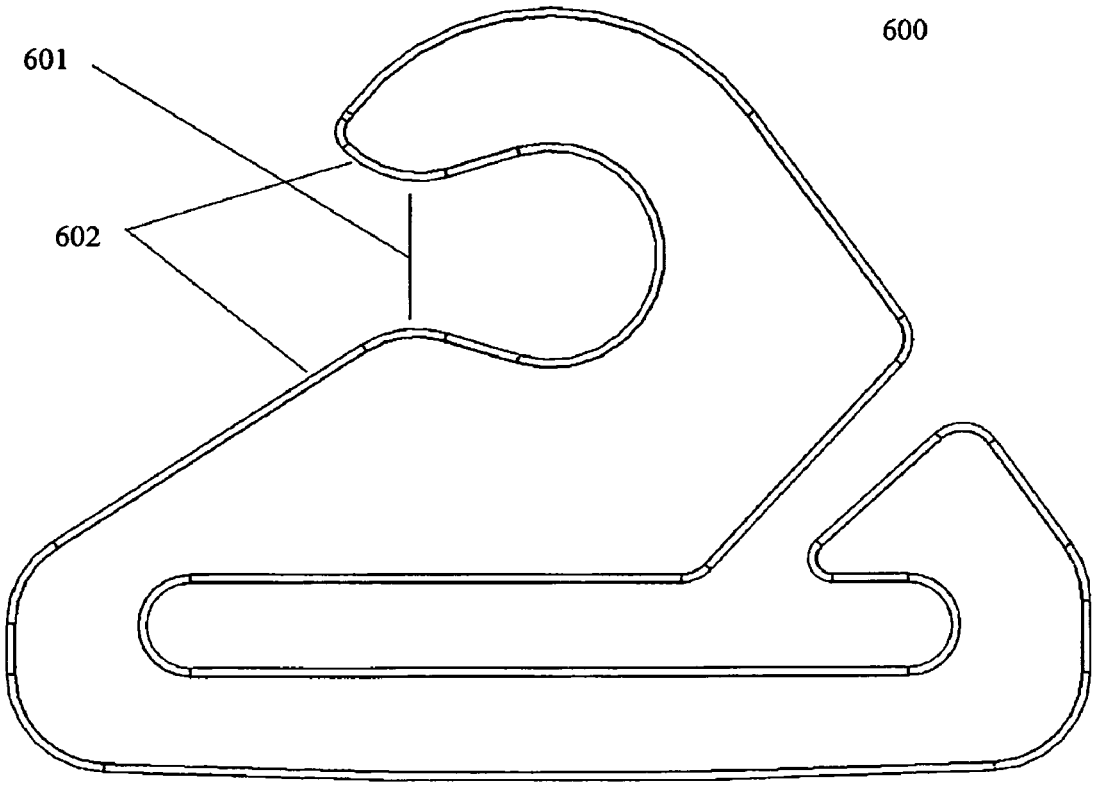
FIG. 38 shows components of a restraint system of the present invention.
Figure 39:
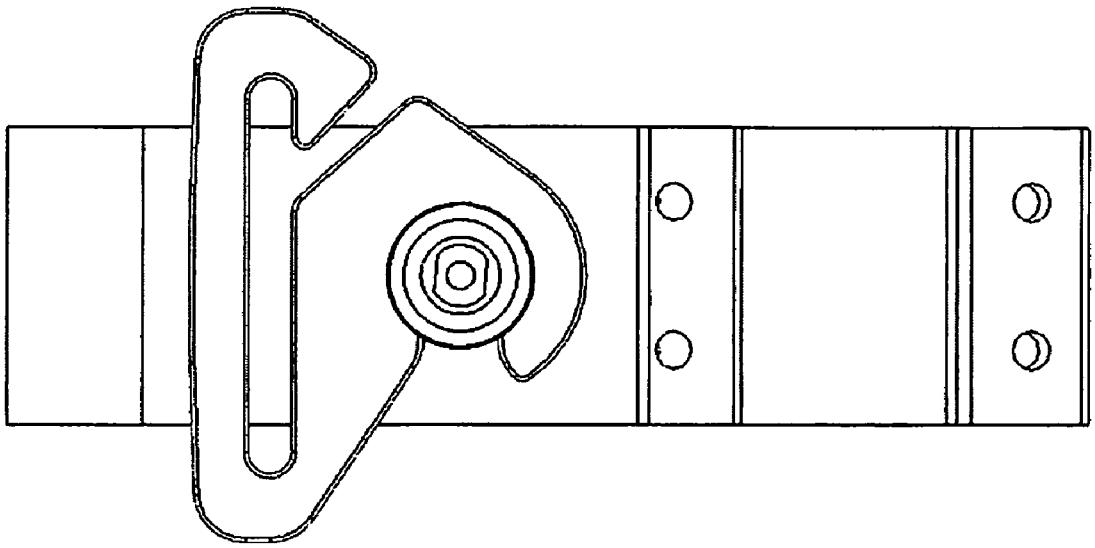
FIG. 39 shows components of a restraint system of the present invention.
Figure 40:
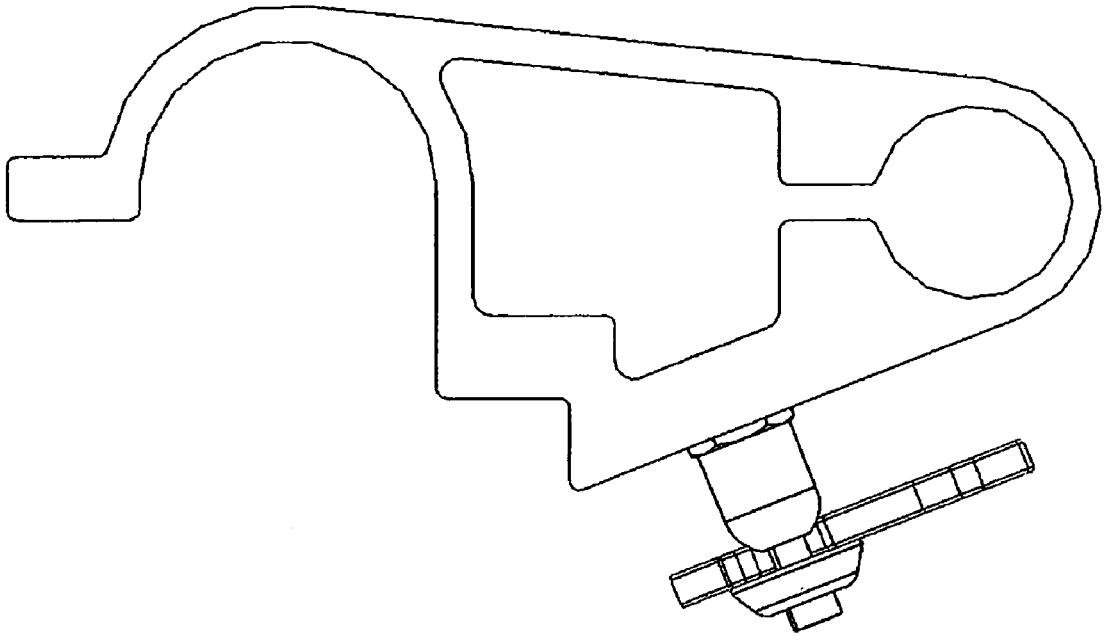
FIG. 40 shows components of a restraint system of the present invention.
Figure 41:
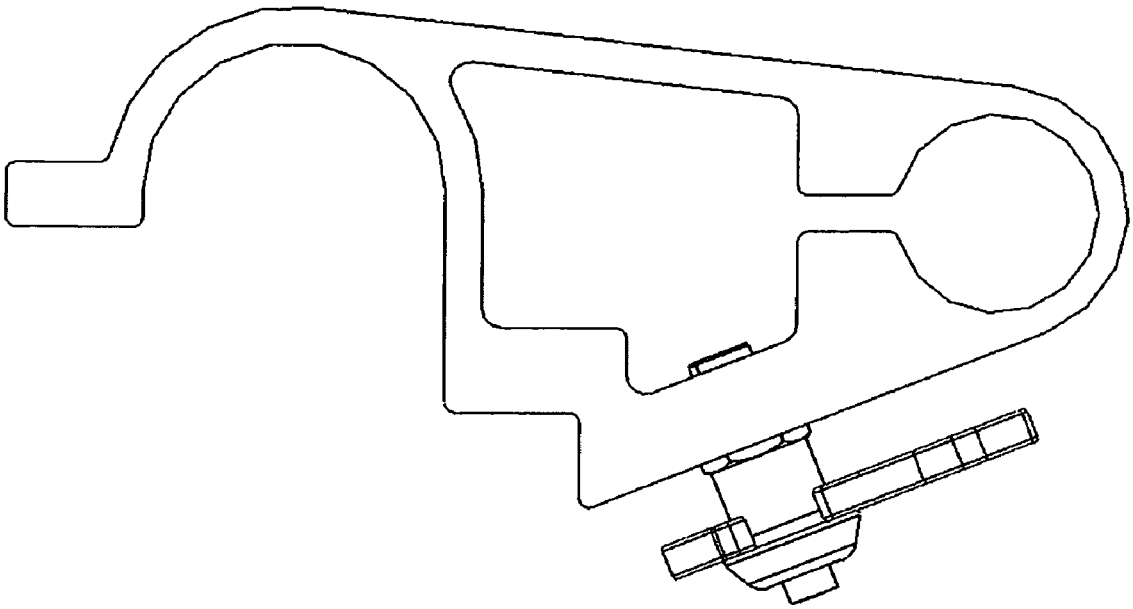
FIG. 41 shows components of a restraint system of the present invention.
Figure 42:
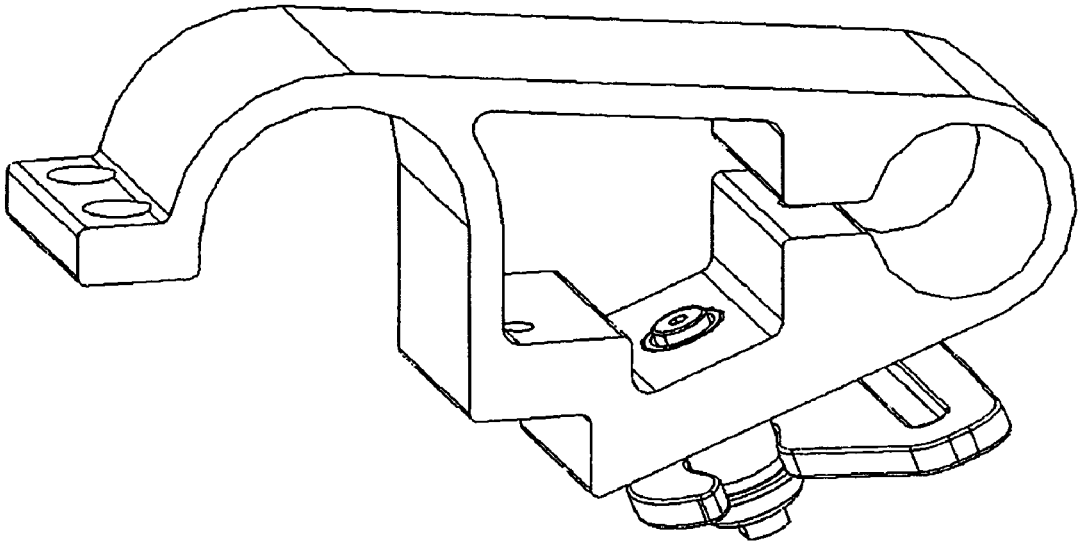
FIG. 42 shows components of a restraint system of the present invention.
Figure 43:
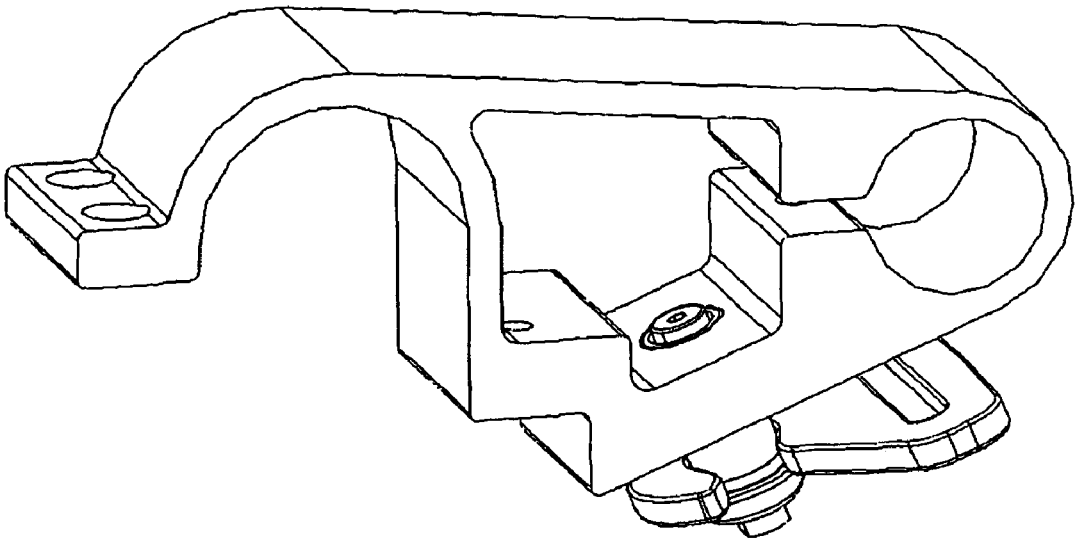
FIG. 43 shows components of a restraint system of the present invention.
Figure 44:
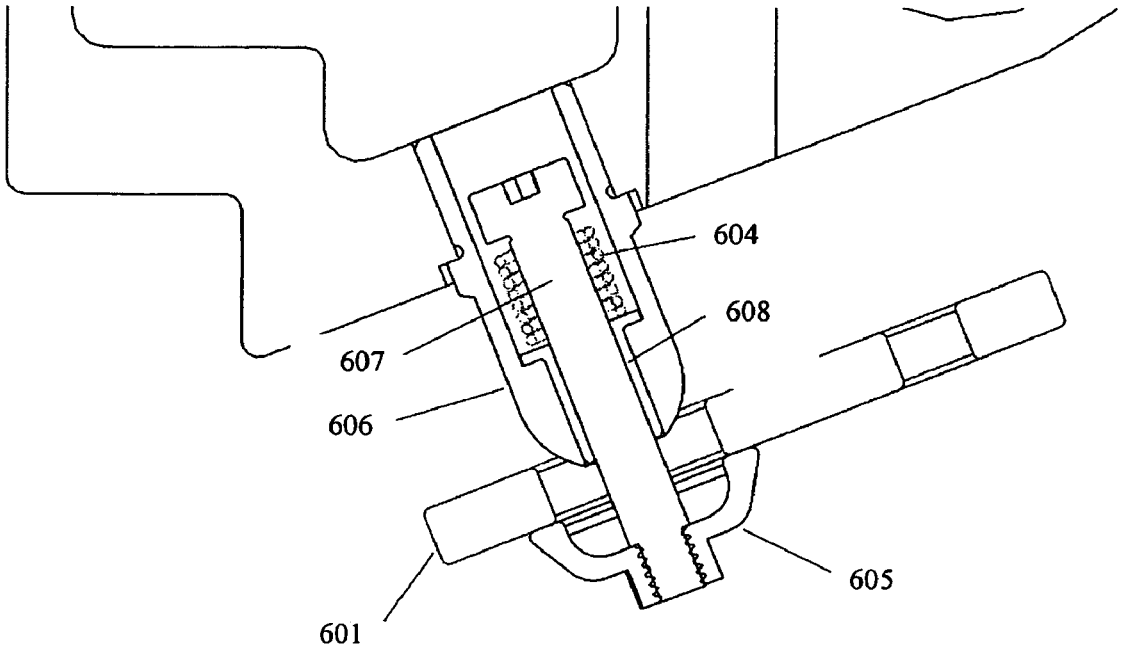
FIG. 44 shows components of a restraint system of the present invention.

In some embodiments, the present invention provide a restraint system comprising a restraint clip 600 (e.g., shown in FIGS. 38 and 39) and a restraint clip anchoring assembly 603 (e.g., shown in FIG. 44). In some embodiments, a restraint belt is fastened (e.g., sewn on) to the clip 600 (e.g., fastened to the belt attachment slot 609). In some embodiments, the restraint system functions via a spring present in the anchoring system 604 snapping an anchoring cap 605 tight to the bottom of an anchoring body 606, thereby retaining the clip 600 (e.g., as shown in FIGS. 38, 42, and 44). To engage the clip 600 on the body 606, the clip 600 is pressed down on the anchor cap 605 with the clip 600 and snapping it around a shaft component 607 present within the body 606. In some embodiments, a bushing 608 surrounds the shaft 607.

In some embodiments, the body 606 is designed with a spherical "bullet nose" end. This design provides several advantages including, but not limited to, functioning to automatically center the clip 600 during installation, as well as to effectively reduce the diameter of the body 606 (e.g., so that when the cap 605 is pressed down, the choke point 601 on the clip 600 passes over the body 606). The choke point 601 is smaller than the body 606 diameter, therefore the clip 600 cannot be removed unless the cap 605 is first pushed down.

In some embodiments, the cap 605 is designed with a cavity in order to push the clip 600 higher up on the body 606 (e.g., as shown in FIG. 44). The clip 600 contacts (e.g., engages) the cylindrical shaft 607 portion of the body 606, not the spherical portion (e.g., of the cap 605). This prevents the clip 600 from becoming unintentionally removed.

In some embodiments, to engage the restraint system, one holds the restraint clip 600 near the bottom, and using a surface 602 (e.g., shown in FIG. 38), pushes down the cap 605, allowing the clip 600 to engage the body 606 (e.g., the shaft 607 within the body 606). In order to remove/release, one holds the restraint clip 600, pushes down on the cap 605, and slides the clip 600 away from the body 606. Thus, a restraint system of the present invention provides for a user to use only a single hand to install/engage and/or remove/release the restraint. For example, to remove requires only two motions; one to push down the cap, the other a sideways motion to remove the clip. In some embodiments, forces on the belt can only be in tension and will not act in a sideways manner, thus the clip cannot become disengaged accidentally through use.

FIGS. 39-43 show the attachment of a clip 600 to an anchoring assembly 603. In some embodiments, the anchoring assemblies are fastened to a plurality of extrusions/castings 71, 72 as shown in FIGS. 11 and 15. Thus, the present invention provides a restraint system that allows a user to place restraints upon a subject such that the restraint only contacts specific regions of a subject transported by the cot.

A cot of the present invention can be placed into a number of different positions. In some embodiments, the head/upper torso litter 164 elevation is controlled by a gas charged spring (strut) 168 (e.g., shown in FIG. 17) that is pivotably attached to the head/upper torso litter 164 and a strut mount 167 that is affixed to the head-end cross tube 81. Elevation can be changed by actuating a strut release handle (e.g., that is pivotably attached to the backrest assembly). In some embodiments, actuating the strut release handle depresses a pin within the strut piston rod (e.g., allowing the gas charged spring (strut) 168 to extend or contract in length). Also shown in FIG. 17, the fixed legs 40 pivotally attach to the head-end cross tube 81 of the top frame 74.

As shown in FIG. 24, the leg litter portion of the cot can be configured into a Trendelenburg shock position by lifting up on the foot end of the litter leg tube 94 until a trendel rod (located between and attached to each trendle tube 155) slides from its down position along the trendel ramp 154 and becomes engaged in an elevated notch position along the trendel ramp 154. In some embodiments, an elasticized shock cord (e.g., a bungee type cord) serves to limit disengagement of the trendel rod 153 from the trendel ramp 154. In some embodiments, the shock cord provides the necessary force to engage the trendel rod 153 into the trendel ramp 154 notch positions. The trendel knob 158 provides a grab point for the user to disengage the trendel rod 153 from the trendel ramp 154 when going from an elevated (Trendelenburg) position to a lowered (flat) position. A patient litter of the present invention can also be placed into other positions including, but not limited to, flat, elevated head, and elevated head and legs.

In some embodiments, a cot system 1 of the present invention comprises a hydraulic system (e.g., that is utilized to raise and lower the leg assemblies of the cot (e.g., thereby raising and lowering the patient litter (e.g., for loading a subject onto the cot and/or for loading a cot carrying a subject into an ambulance))). The present invention is not limited to any particular hydraulic system. Indeed, a variety of hydraulic systems may be utilized in the present invention including, but not limited to, a hydraulic system described in U.S. patent application Ser. No. 11/968,013, hereby incorporated by reference in its entirety for all purposes. Thus, in some embodiments, controlling (e.g., powering) the raising and collapsing of leg assemblies (e.g., fixed leg assembly and a telescoping leg assembly comprising a roller bearing system) is performed by a hydraulic system.

In some embodiments, a cot described herein comprises a tip angle monitoring, recording and alert system. For example, in some embodiments, a cot system of the present invention comprises a tip angle monitoring, recording and alert system. A tip angle system of the present invention comprises the ability to simultaneously, and in real time, measure cot load, cot height and cot angle, and utilize each of these measurements to calculate tip angle of the cot. As used herein, the term "tip angle," refers to the position at which a cot (e.g., not bearing a load, or bearing load weight (e.g., of any weight (e.g., ranging from about 10 pounds to about 1000 pounds))) is at that angle at which the cot will tip (e.g., dependent upon factors such as cot height, load weight, and the angle of lateral (e.g., side-to-side) movement of one or more reference points upon the cot (e.g., a 3-axis accelerometer mounted upon the cot) with respect to a horizontal plane that is more or less perpendicular to the earth's gravitational force). The present invention is not limited by the method of determining load weight upon a cot of the present invention. In some embodiments, load weight is determined utilizing a pressure transducer or similar device (e.g., a load cell, use of a pressure switch, or a combined use of one or more pressure switches and/or motor current feedback). Similarly, the present invention is not limited by the method of determining cot height. In some embodiments, cot height is measured using an ultrasonic sensor. Likewise, the present invention is not limited by the method of determining the angle of lateral movement of one or more reference points upon the cot. For example, in some embodiments, one or more reference points are used to determine angle of side-to-side movement of the cot utilizing an accelerometer and/or gyroscope.

In some embodiments, a tip angle measuring, recording and alert system comprises a controller (e.g., comprising a processor, and memory component (e.g., used to monitor, record and store cot use information). In some embodiments, the tip angle monitoring, recording, and alert system captures and records cot operational use information. In some embodiments, recorded cot operational use information is stored in a memory component (e.g., present on a circuit board housed within the controller housing). In some embodiments, cot operational use information comprises cot angle (e.g., all angles recorded by the tip angle system described herein (e.g., any angle of the cot that is outside a range (e.g., three degrees) approaching the tip angle of the cot (e.g., an angle at which a cot is parallel to a horizontal plane that is perpendicular to the earth's gravitational force), angles of the cot that are within a range (e.g., three degrees or less) of the tip angle, angles that are equal to the tip angle and/or angles that are greater than the tip angle (e.g., calculated for a cot)))). The present invention is not limited by the type of cot operational use information recorded and stored. For example, cot operational use information includes, but is not limited to, cot angle, cot height, cot load weight, calendar date, time, identification of user, etc. In some embodiments, cot operational use information comprises unsafe cot operational angles.

In some embodiments, a cot of the present invention comprises a pole for placement of one or more intravenous (IV) fluid bags. For example, as shown in FIGS. 32-37, the IV pole 213 rotates about two separate and offset axes allowing it to not only fold down from the in use position, but to stow underneath the patient litter. In the stowed configuration the end of the pole 213 snaps into a IV clasp 214 that holds the pole in place when not in use (See, e.g., FIG. 32). The user pulls the IV Stage 1 229 to disengage it from the IV clasp 214 and continues to rotate the folded pole 213 approximately 210 degrees so that the IV pivot housing 215 is vertical (See, e.g., FIG. 33). The IV pole 213 then rotates about the IV pivot housing pin 217 and bearing 218 until it is in line with the IV pivot housing 215, approximately 90 degree (See, e.g., FIG. 34). In some embodiments, the pole 213 can continue to rotate past 90 degrees. The IV position grip 216 then can be pushed down onto the IV spring pin assembly 221 and compress the IV spring pin assembly spring 222. The IV spring pin assembly 221 is now located by a hole in the team lift handle 73 and IV pole locating block 225 and the IV pivot housings 223 are also located in the IV position grip 216. The IV position grip 216 is stopped when the IV position grip dowel pins 220 come in contact with the IV pivot housing 223. This prevents the assembly from having any rotation about aforementioned 2 axes. Turning the IV position grip 216 approximately 90 degrees and then releasing allows the IV spring pin assembly spring 222 to push the IV spring pin assembly 221 up which in turn pushes the IV grip dowel pins 220 up and into a relief in the IV pivot housing 223. At this point the IV position can be neither raised up nor twisted.

In some embodiments, the second stage 230, when extended, is held in place by a compression fitting 234. The third stage 236 is held in place by flexible stamping (flat spring) 237 that protrudes out when the IV stage 3 236 is pulled out from inside the IV stage 2 230, similar to an umbrella.

In some embodiments, the IV pole locating block 225 is located inside of the team lift handle 73 via 2 screw holes that are used to also capture the IV sleeve bearing top 224 and IV sleeve bearing bottom 226. There is an additional hole that captures the IV spring pin assembly 221 when it is pushed down.

In some embodiments, the IV sleeve bearing top 224 and IV sleeve bearing bottom 226 are attached to the team lift handle 73 (e.g., by one or a plurality of screws). They provide a bearing surface for the IV pivot housing 223 to rotate on and also provide an over travel stop when the stowed and folded pole is rotated up.

The IV pivot housing 223 has several functions including, but not limited to attaching the IV pole 213 to the team lift handle 73, via fasteners around the team lift handle 73 and to is constrain the IV pivot pin 219 (e.g., constrains the IV pin assembly 221, both the minor and major diameter); possessing a shelf feature to contact the IV sleeve bearings 224,226 to prevent over travel; and slot features that allow for retention of the IV position grip dowel pin 220.

IV spring pin assembly 221 minor diameter is used to prevent motion between the IV pivot housing 223 and the IV pole locating block 225. The major diameter is used as bearing surface between the IV position grip dowel pin 220. The diameter and thickness are sufficient enough that when the pin is raised the slots in the IV pivot housing 223 for retention of the IV position grip dowel pin 220 are closed. Thus, this prevents foreign objects (e.g., clothing, IV tubes, etc.) from getting caught in the slot and damaged when the IV position grip 216 is pulled down.

In some embodiments, the IV spring pin assembly spring 222 is used to bias the IV spring pin assembly 221 up and out of the team lift handle 73. IV position grip 216 retains the IV position grip dowel pins 220. In addition the IV position grip 216 slides over the IV pivot housing 223 to lock out one of the axis of rotation. The IV position grip dowel pins 220 contact the IV pin assembly 221 and hold it down against the IV spring pin assembly spring 222. They also provide the lockout features to the IV pivot housing 223.

The IV pivot pin 219 has features that allow it to rotate about the IV pivot housing pin bearing 218. It is slotted to allow clearance for the IV position grip dowel pins 220. An additional slot allows retention of an E-ring 228. There are also features to allow for IV Stage 1 229 retention. The IV pivot housing pin 217 retains the IV pivot housings 223 and is the axle for the IV pivot pin 219. It is knurled to create better retentions in the IV pivot housings 223. The IV pivot housing pin bearing 218 provides a smooth bearing surface for the IV pivot pin 219. The E-ring 228 snaps onto the IV pivot pin 219 and provides a surface for the IV position grip spring 227 to push on.

The IV position grip spring 227 provide an upwards bias force to the IV position grip 216 to allow the grip 216 to be clear of the IV pivot housing 233 when folding. Thus, in some embodiments, an IV pole 213 of the present invention reduces and/or eliminates damage caused by a user not pulling the lock out tube up far enough.

The IV stage 1 229 provides the necessary height for the IV bag hook 242 to allow for IV Bag fluid to flow. It is threaded at one end to allow for the IV collet 233 to be attached, slides over IV pivot pin 219 and is retained by a roll pin 232.

The IV collet bushing 235 is located on top of IV Stage 1 229 and is used as a bearing between the IV collet 233 and the IV collet compression ring 234. It has a chamfered edge that the IV collet compression ring 234 sits on to help decrease the normal acting on the IV collet compression ring 234 (e.g. thereby reducing friction (e.g., wear)). This allows the IV collet compression ring 234 to compress and decompress repeatedly.

The IV collet compression ring 234 is used to apply pressure to the IV Stage 2 230 and hold it in place. The IV collet 233 and the IV collet compression ring 234 have chamfered surfaces, that when the IV collet 233 is screwed down the IV Stage 1 229, it cause the IV collet compression ring 234 to decrease in diameter. This decrease in diameter causes the ring to tighten onto the IV Stage 2 230. There is a slot in the IV collet compression ring 234 to allow for the decrease in diameter.

The IV Stage 2 230 provides the necessary height for the IV bag hook 242 to allow for IV bag fluid to flow. On the lower end it allows for the retention of the IV Stage 2 bottom cap 231. There is a form area at the top that provides a stop for the IV Stage 3 bottom cap 239, to prevent the IV Stage 3 236 from coming completely out of the IV Stage 2 230. On the upper end it allows for a flange bearing 238 to be pressed in that the IV Stage 3 locking spring 237 rests upon.

IV Stage 2 bottom cap 231 provides a tighter fit to the IV Stage 1 229 and a better bearing surface.

IV Stage 3 236 provides the necessary height for the IV bag hook 242 to allow for IV bag fluid to flow. On the lower end it slides over and allows for the retention of the IV Stage 3 bottom cap 239 by a roll pin 232. It also has slots that allow for the IV Stage 3 locking spring 237 to be retained. On the upper end it slides over the IV Stage 3 top cap assembly 241 and is retained by a roll pin 232.

IV Stage 3 bottom cap 239 retains an O-ring 240 that provides a tighter fit to the IV Stage 2 230 and acts to window lock the IV Stage 3 236. The window locking prevents a free fall in the event the IV Stage 3 locking spring 237 is depressed and then the IV Stage 3 236 is let go.

IV Stage 3 locking spring 237 protrudes out of the IV Stage 2 230 when the IV Stage 3 236 in pulled out a sufficient distance. When the IV Stage 3 locking spring 237 is flexed out, it prevents the IV Stage 3 236 from falling down. IV Stage 3 top cap assembly 241 allows for an IV bag to be attached to the IV pole 213.

The pre-hospital arena (e.g., treatment (e.g., with one or more pharmaceutical drugs) of a subject prior to arrival at a hospital) is subject to many problems related to pharmaceutical drug protocols. For example, problems range from security (e.g., for controlled substances such as opiates (e.g., morphine)), inappropriate storage temperature, absence of proper dosing/presence of drug delivery error, poor lighting, lack of record keeping and event recording procedures, and inefficient procurement/restocking, accountability. Thus, in some embodiments, the present invention provides a drug bag and/or drug box (e.g., that accompanies and/or attaches to a cot of the present invention) that addresses these problems.

A drug bag/box of the present invention provides a secure system to handle narcotics generally carried by pre-hospital service teams (e.g., EMS, EMTs, etc.) as part of their patient pain management (e.g., opiates such as morphine) and/or seizure control (e.g., valium) protocols. Thus, a drug bag/box of the present invention provides a security system that reduces and/or eliminates employee theft of drugs (e.g., narcotics).

A drug bag/box of the present invention also provides a controlled environment for drugs that are required to be maintained at a certain temperature for efficacy. Many intravenous and intramuscular drugs are exposed to extreme temperatures that fall outside of the manufactures specified storage temperature for the drug to retain drug efficacy. For example, extreme heat in the South and Southwest regions of America can elevate internal drug bag/box temperatures well over 100 degrees (e.g., while a drug bag/box is stored in an external vehicle compartment in an ambulance/rescue vehicle that is out of the station). Cold temperatures are also an issue during the winter northern climates. Even in a department's vehicle bay, drugs can be subject to temperatures that exceed the maximum or minimum limits. In general, the stated temperature range on most pre-hospital drugs is 59° F. to 86° F. degrees (15° C. to 30° C.). Thus, in some embodiments, the present invention provides a drug temperature bag/box that maintains an internal temperature (e.g., at, within or near the suggested storage temperature (e.g., between 59° F. to 86° F. degrees, although lower (e.g., less than 59° F.) and higher (e.g., greater than 86° F.) temperatures may be maintained)). In some embodiments, the drug bag/box can be used when attached to a cot described herein, whereas in other embodiments, the bag/box can be removed and carried (e.g., using a strap and/or handle) away from a cot (e.g., to places not accessible to the cot).

A drug bag/box of the present invention can also be used for accuracy in dosing. For example, a drug bag/box may comprise a dosing system (e.g., that identifies a drug pulled from the bag and provides suggested dosage (e.g., based on patient weight, age, medical status, etc.). Thus, in some embodiments, the present invention provides a drug bag/box that decreases and/or eliminates administration of the wrong medication and/or drug and/or dosage of the same. In some embodiments, a drug bag/box of the invention provides identification of the proper sequence to administer two or more drugs. In some embodiments, a drug bag/box comprises a lighting system (e.g., that provides sufficient light to illuminate a scene (e.g., for reading a label on a bottle).

The present invention also provides a drug bag that records removal of drugs from the bag and/or the type and/or amount of drug administered (e.g., to a patient/subject in the field). For example, in some embodiments, a drug bag recording system replaces other methods of determining what and/or how much of a certain drug or medication was administered (e.g., counting empty packaging on an ambulance floor and/or writing present on a glove or medical tape used by the emergency medical service provider or on the provider's hand). In some embodiments, the drug bag is integrated with an event recording system (e.g., to monitor and record what was done (e.g., therapy provided) and in what order and time events occur (e.g., if a proper order was followed (e.g., whether defibrillation shocks were delivered and what drugs were given in between the shocks and/or after the shocks)). The drug bag may also be used for procurement and restocking and/or accountability. For example, restocking the drug bag after a call is a requirement. The drugs may come from the hospital pharmacy (which is not Medicare lawful) and/or from suppliers that ship the medications. In this more common practice, the service is subject to ordering errors, shipping errors, receiving errors, etc. With EMS having a 24/7/365 response liability to the community, the EMS service should be performing drug bag inventory checks after and before each shift change. A drug bag (e.g., utilized with a cot of the present invention) addresses these needs.

In some embodiments, the present invention provides a temperature controlled drug bag (e.g., for use in combination with a cot system (e.g., hydraulic cot system or manual cot system) of the present invention). For example, in some embodiments, the drug bag is utilized by an emergency medical service provider (e.g., an emergency medical technician) or other person prior to arrival of a subject at a hospital. The drug bag may comprise heating and/or cooling functionality. In some embodiments, a drug bag comprises bar code verification (e.g., to identify a proper user (e.g., that is accessing the bag)), or to identify that the correct drug and/or correct dose is being retrieved from the bag. In some embodiments, a drug bag comprises a voice prompt verification system. In some embodiments, a drug bag comprises a RFID tag narcotic authorization system. A drug bag for use with a cot system (e.g., hydraulic cot system or manual cot system) may comprise auxiliary lighting, an event recording system, and/or an inventory control system. In some embodiments, the drug bag is battery powered.

In some embodiments, the present invention provides software that tracks and/or manages data collected, recorded and stored by a tip angle monitoring, recording and alert system of the present invention. In some embodiments, the software comprises setup, import, search, report and/or backup functionalities. In some embodiments, the software comprises a set-up function that allows a user to configure the program to behave the way the user desires (e.g., collection of data in a specific way (e.g., by date, user, patient weight, cot angle, etc.). In some embodiments, retrieval of information from a memory component of a cot system of the present invention is password protected. In some embodiments, data can be exported into any type of database (e.g., MICROSOFT EXCEL, ACCESS, SQL database, etc.). In some embodiments, the software comprises import functionalities that permit a user to remove data from the cot (e.g., from a memory component of the cot (e.g., via USB, cable, wireless technology). In some embodiments, importing data comprises importing information associated with each "run" of the cot (e.g., that are identified by a serial number assigned (e.g., by the controller) to each run). In some embodiments, the software comprises a search function that allows a user to search for specific data (e.g., imported from the memory component). For example, a user can search for data specific to a particular user of a cot, all data related to a particular cot, data related to specific events (e.g., failure data (e.g., sensor and/or transducer error, battery low error, etc.)), data related to a specific date and/or time, data related to a specific range of subjects transported on the cot (e.g., all subjects with a weight within the range of 275-375 pounds) etc.). Thus, the search function allows a user to select only that data that the user is interested in. The software is also configured to permit generation of results based upon search criteria (e.g., tables and/or diagrams for reports).

In some embodiments, software configured to track and/or manage information and/or data collected, recorded and/or stored by a tip angle monitoring, recording and alert system of the present invention is housed and/or run on a personal digital assistant (PDA), a personal computer (PC), a Tablet PC, and/or a smartphone. In some embodiments, the software is configured to run independently of other software. In some embodiments, the software is configured to run within or together with other software including, but not limited to, WINDOWS (e.g., WINDOWS XP, WINDOWS CE, or other WINDOWS based operating system), JAVA, cell phone operating systems, or other type of software. In some embodiments, information and/or data collected, recorded and/or stored by a tip angle monitoring, recording and alert system of the present invention is communicated to a software configured to track and/or manage such information via BLUETOOTH, ZIGBEE, infrared, FM, AM, cellular, WIMAX, WIFI, or other type of wireless technology. In some embodiments, information and/or data collected, recorded and/or stored by a tip angle monitoring, recording and alert system of the present invention is made available over a network (e.g., TCP/IP, SANS, ZIGBEE, wireless, wired, USB, and/or other type of network) or via mobile information recording devices (e.g., flash card, memory stick, disc, jump drive, etc.). In some embodiments, a network is configured to comply with certain government protocols (e.g., Health Insurance Portability and Accountability Act rules and/or regulations, Joint Commission on the Accreditation of Healthcare Organizations rules and/or regulations, and/or other types of rules and/or regulations). In some embodiments, software configured to interact with a cot system of the present invention comprises a mobile resource a cot user in the field. For example, in some embodiments, software is configured to provide a user of a cot of the present invention a variety of information including, but not limited to, drug information (e.g., prescription drug, herbal and/or over the counter generic and trade names (e.g., with extensive kinetics and mechanism of action information)), drug compatibility information (e.g., permitting a user to identify items that can be used interchangeably between different manufactures and applications (e.g., a user can determine whether a certain IV line is compatible with certain IV catheters (e.g., thereby decreasing the confusion for a user regarding compatibility between standard IV products and needleless IV products))), administration protocols, instructional videos, decision trees, inventory information, or other types of information.

Having described the invention in detail, those skilled in the art will appreciate that various modifications, alterations, and changes of the invention may be made without departing from the spirit and scope of the present invention. Therefore, it is not intended that the scope of the invention be limited to the specific embodiments illustrated and described.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields, are intended to be within the scope of the following claims.

We claim:

1. An ambulance cot comprising:

a base frame;

a top frame, wherein said top frame attaches to a patient litter; and a ladder rail assembly, comprising two ladder rails and a ladder rod, wherein each ladder rail comprises a plurality of notches, angled teeth, and ramps, and wherein said ladder rod is received in one of said notches of said ladder rails to position said ambulance cot at given height.

2. The ambulance cot of claim 1, wherein said ladder rail assembly further comprises a foot end ladder rail stiffener and a centrally located ladder rail stiffener.

3. The ambulance cot of claim 2, wherein said foot end ladder rail stiffener is attached to a foot end cross tube of said top frame.

4. The ambulance cot of claim 3, wherein said foot end ladder rail stiffener is fastened to said foot end cross tube of said top frame via a guide rod.

5. The ambulance cot of claim 4, wherein said guide rod is fastened to said foot end stiffener via a guide bearing.

6. The ambulance cot of claim 2, wherein said rail stiffeners are fastened to each of said ladder rails.

7. The ambulance cot of claim 1, wherein said ladder rod is covered on both ends by bearing holders, wherein said ladder rod is freely rotatable within said bearing holders.

8. The ambulance cot of claim 7, wherein said cot has a foot end; and said bearing holders attach to slider blocks, wherein said slider blocks slideably reside within slider housings attached to the foot end of said cot.

9. The ambulance cot of claim 1, wherein said ramps and angled teeth prevent hot dropping of said cot.

10. The ambulance cot of claim 9, wherein said ladder rod, when passing over said ramps of said ladder rail in an uncontrolled manner, is forced into a notch by one of said ramps, thereby stopping an uncontrolled collapsing of the cot.

11. The ambulance cot of claim 1, wherein said ladder rails of said ladder rail assembly are pivotally attached to a head end cross tube of said top frame.

12. The ambulance cot of claim 1, wherein said cot comprises a restraint system that is engaged and/or released with a single hand.

13. The ambulance cot of claim 1, further comprising a team lift rail fastened to said top frame.

14. The ambulance cot of claim 13, wherein said top frame fastens to said team lift rail via cross tube castings and mount extrusions that have an orifice into or through which said team lift rail extends.

15. The ambulance cot of claim 13, wherein said top frame has an end and two opposite sides, and said team lift rail extends along the end and the two opposite sides of the top frame.

16. An ambulance cot comprising:

a base frame;

a top frame having an end and two opposite sides, wherein said top frame attaches to a patient litter;

a ladder rail assembly comprising two ladder rails, wherein each ladder rail comprises a plurality of notches, angled teeth, and ramps; and a team lift rail fastened to said top frame, wherein said team lift rail extends along the end and the two opposite sides of the top frame.

17. The ambulance cot of claim 16, wherein said top frame fastens to said team lift rail via cross tube castings and mount extrusions that comprise an orifice into or through which said team lift rail extends.

18. The ambulance cot of claim 16, wherein a foot end portion of said team lift rail provides a location for attachment of an additional component.

19. The ambulance cot of claim 18, wherein said additional component is a control panel.

20. The ambulance cot of claim 16, wherein said team lift rail reduces exposure of a user of said cot to pinch points.

* * * * *